US009856079B2

(12) United States Patent
Manssourian

(10) Patent No.: US 9,856,079 B2
(45) Date of Patent: Jan. 2, 2018

(54) RETAINER MECHANISM

(71) Applicant: Grigooris Manssourian, Glendale, CA (US)

(72) Inventor: Grigooris Manssourian, Glendale, CA (US)

( * ) Notice: Subject to any disclaimer, the term of this patent is extended or adjusted under 35 U.S.C. 154(b) by 679 days.

(21) Appl. No.: 14/247,094

(22) Filed: Apr. 7, 2014

(65) Prior Publication Data

US 2014/0299602 A1 Oct. 9, 2014

Related U.S. Application Data

(60) Provisional application No. 61/810,210, filed on Apr. 9, 2013.

(51) Int. Cl.
*E05C 3/02* (2006.01)
*B65F 1/16* (2006.01)

(52) U.S. Cl.
CPC ..... *B65F 1/1615* (2013.01); *B65F 1/16* (2013.01); *Y10T 16/5407* (2015.01)

(58) Field of Classification Search
CPC ..... Y10T 24/1016; B65F 1/16; B65F 1/1615; B65F 1/1623
USPC ..... 292/130, 131, 134, 136, 230, 231, 236, 292/238, 256, 258, 262, 288; 16/349; 220/315, 317, 318
See application file for complete search history.

(56) References Cited

U.S. PATENT DOCUMENTS 74,367 A * 2/1868 Hurd ..... A44B 11/12 24/163 R
203,817 A * 5/1878 Brock ..... B65F 1/1623 220/828
1,639,870 A * 8/1927 Valsvig ..... B65D 45/16 16/109
2,531,503 A * 11/1950 Talbert ..... A24F 19/06 220/264
3,893,725 A * 7/1975 Coulter ..... B65D 45/02 220/318
3,980,202 A 9/1976 Monyak et al.
4,136,422 A * 1/1979 Ivanov ..... A44B 11/125 24/170
4,182,530 A 1/1980 Hodge
4,371,092 A 2/1983 Teague
4,413,851 A 11/1983 Ritter
4,549,770 A * 10/1985 Kurtti ..... B60R 22/1855 24/136 K
4,869,697 A * 9/1989 Ackert ..... B63B 35/812 24/134 R
4,942,647 A * 7/1990 Wallner ..... A44B 11/125 24/170
4,955,501 A 9/1990 Hodge
4,976,371 A * 12/1990 Wise ..... B65D 45/02 220/315

(Continued)

FOREIGN PATENT DOCUMENTS

DE 3028233 A1 * 2/1982 ..... B65F 1/1436

*Primary Examiner* — Carlos Lugo
(74) *Attorney, Agent, or Firm* — Peter Ganjian; Patent Law Agency, LLC

(57) ABSTRACT

A retainer mechanism for actively securing a lid (holding and maintaining content) of a container even if the container is overfilled and for passively (and automatically) self-releasing the lid to fully open when and as a result of the container appropriately titled to a particular orientation for unhindered, unobstructed emptying of the container.

29 Claims, 44 Drawing Sheets

(56) References Cited

U.S. PATENT DOCUMENTS 5,102,001 A 4/1992 Teague et al.
5,118,000 A 6/1992 Howell et al.
5,297,692 A 3/1994 Kronmiller
5,373,959 A 12/1994 Haasewinkel
5,599,050 A 2/1997 Tinsley
5,738,395 A * 4/1998 Probst ..... B65F 1/1615 220/315
5,772,264 A * 6/1998 Bettenhausen ..... B65F 1/1615 292/130
5,920,963 A * 7/1999 Chou ..... F16G 11/106 24/170
6,175,994 B1 * 1/2001 Nicoletti ..... A43C 11/1413 24/68 SK
6,290,093 B1 * 9/2001 Obriot ..... B65F 1/1615 220/324
6,381,810 B2 * 5/2002 Hsieh ..... A44B 11/06 24/170
6,560,825 B2 * 5/2003 Maciejczyk ..... A44B 11/14 24/170
6,666,485 B1 * 12/2003 Moret ..... B65F 1/1615 220/315
6,802,550 B1 * 10/2004 Griggs, Jr. ..... B60N 2/4686 292/136
6,868,587 B2 * 3/2005 Rard ..... A44B 11/125 24/170
6,880,717 B1 4/2005 O'Conor
6,902,080 B2 6/2005 Busch
6,902,081 B2 6/2005 Walker
7,334,301 B2 * 2/2008 Huang ..... B60P 7/0823 24/170
7,506,902 B2 * 3/2009 Sheng ..... G03G 21/1666 16/221
7,712,191 B2 * 5/2010 Huang ..... A44B 11/065 24/170
D634,912 S 3/2011 Pouliot et al.
8,459,487 B2 * 6/2013 Sharma ..... B65F 1/1615 220/315
8,935,833 B2 * 1/2015 Kaneko ..... A44B 11/12 24/170
9,010,824 B2 * 4/2015 Hayes ..... B65G 7/12 294/150
9,351,539 B2 * 5/2016 Briggs ..... A43C 11/146
9,376,255 B2 * 6/2016 Banik ..... B65F 1/1615
2004/0163216 A1 * 8/2004 Simonson ..... B60P 7/083 24/68 CD
2007/0226958 A1 * 10/2007 Clifton, Jr. ..... A45F 5/02 24/3.12
2008/0169289 A1 7/2008 Dawn
2009/0050627 A1 2/2009 Shinault
2010/0102575 A1 4/2010 Ferkovich et al.

* cited by examiner

RETAINER MECHANISM

CROSS-REFERENCE TO RELATED APPLICATIONS

This Application is a Non-Provisional Utility Patent Application that claims the benefit of priority of the U.S. Provisional Utility Patent Application No. 61/810,210, filed 9 Apr. 2013, the entire disclosure of which is expressly incorporated by reference in its entirety herein. Where a definition or use of a term in an incorporated reference is inconsistent or contrary to the definition of that term provided herein, the definition of that term provided herein applies and the definition of that term in the incorporated reference does not apply.

BACKGROUND OF THE INVENTION

Field of the Invention

This invention relates to a retainer mechanism and, more particularly, to a retainer mechanism for actively securing a lid (holding and maintaining content) of a container even if the container is overfilled and for passively (and automatically) self-releasing the lid to fully open when and as a result of the container appropriately titled to a particular orientation for unhindered, unobstructed emptying of the container.

Description of Related Art

Conventional locking mechanisms for trash bins (residential or commercial trash bins) with lids are well known and have been in use for a number of years. Regrettably, most suffer from any one or more of the following obvious disadvantages in that the lock mechanisms are complex and may not be compatible with bins used by automated garbage collection trucks, may not properly secure (lock and prevent or block access to) the content of the container, or do not passively, automatically, self-unlock or release during operation of emptying the bin to fully open the lid to allow unhindered, unobstructed emptying of trash. Further, most conventional lock mechanisms do not allow securing of the content if the lid is not fully closed due to overfilling of the bin (the material content of the bin exceeds the height of the bin).

Accordingly, in light of the current state of the art and the drawbacks to current lock mechanism mentioned above, a need exists for a retainer mechanism that would allow for actively securing a lid (holding and maintaining content) of a container even if the container is overfilled and for passively (and automatically) self-releasing the lid to fully open when and as a result of the retainer mechanism appropriately titled to a particular orientation for unhindered, unobstructed emptying of the container.

BRIEF SUMMARY OF THE INVENTION

A non-limiting, exemplary aspect of an embodiment of the present invention provides a retainer mechanism, comprising:

a retainer member that is associated with a container; and an adjusting member associated with a lid of the container and the retainer member.

Another non-limiting, exemplary aspect of an embodiment of the present invention provides a retainer mechanism, comprising:

a retainer member; and an adjusting member associated with the retainer member;

the retainer member is comprised of:

a mounting support;

a pivotal member associated with the mounting support; and an arm assembly comprised of a first arm piece and a second arm piece.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

FIGS. 8A-1 to 9D are non-limiting, exemplary, detailed illustrations of a retainer mechanism illustratively shown in FIGS. 1A to 1G, detailing another embodiment of a retainer member in accordance with one or more embodiments of the present invention.

DETAILED DESCRIPTION OF THE INVENTION

Figure 1A:
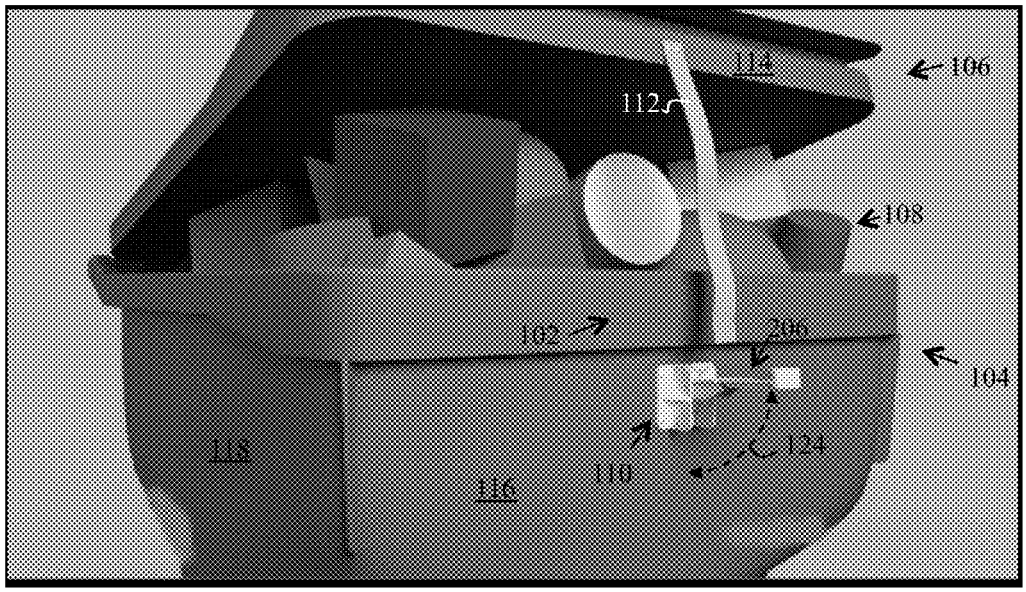
FIGS. 1A to 1E are non-limiting, exemplary illustration that progressively show securing and eventual release of a lid of a container using an embodiment of a retainer mechanism in accordance with the present invention.

The detailed description set forth below in connection with the appended drawings is intended as a description of presently preferred embodiments of the invention and is not intended to represent the only forms in which the present invention may be constructed and or utilized.

Further, unless otherwise noted and distinguished specifically, throughout the disclosure, the use of specific terms such as a bin, container, receptacle, can, trashcan (residential or commercial), etc. should be interpreted as synonymous, as interchangeable, meant as illustrative, and for convenience of example, only.

The present invention provides a device for actively securing or tightly holding down a lid of a bin even if the bin is overfilled (for compacting the content) and for passively (and automatically) self-releasing or self-unlatching the lid to fully open when and as a result of the device appropriately titled to a particular orientation for unhindered, unobstructed emptying of the bin. The present invention may be used to compact content of an overfilled bin, securing content of the bin even if the lid of the bin is not fully closed due to bin overfill. The present invention is lightweight, and easily installs on most containers without requiring any special equipment. The present invention is comprised of mechanism with minimal parts and simple articulations, easily usable by most. The present invention may be retrofitted with any existing container or be manufactured as part of container itself. For example, a mounting support portion (detailed below) may be molded with the container, with an arm and other components affixed or mounted onto the mounting support.

FIGS. 1A to 1E are non-limiting, exemplary illustration that progressively show securing and eventual release of a lid of a trash bin using an embodiment of a retainer mechanism in accordance with the present invention. As illustrated, the retainer mechanism 102 of the present invention is comprised of a retainer member 110 illustrated as associated with a front side 116 of a bin 104, and a distal end 126 of an adjusting member 112 associated with a front side 114 of the lid 106 of the bin 104. The lid 106 may easily be secured and tightly held down in relation to the bin 104 when the adjusting member 112 is associated with the retainer member 110. That is, even if the bin 104 is overfilled with content 108 as illustrated, the lid 106 may still be easily secured and tightly held down in relation to the bin 104 by associating the adjusting member 112 with the retainer member 110 (which would in fact, aid in further compacting content 108 of the bin 104). Accordingly, the retainer member 110 holds and securely maintains the adjusting member 112 at a fixed position along a length of the adjusting member 112, which, in turn, holds and securely maintains the lid 106 in relation to the bin 104. The adjustable nature of the adjusting member 112 in relation to the retainer member 110 enables the retainer mechanism 102 to maintain the hold position of the lid 106 even if the bin 104 is overfilled. It should be noted that the adjusting member 112 may comprise of any flexible material, non-limiting examples of which may include webbing, a strap, or any flat belt made of materials such as polyester, polyurethane, leather, rubber, plastic, nylon etc.

In general, the retainer member 110 is comprised of substantially rounded smooth edges, and its dimensions may be varied. Material used for the retainer member 110 may be comprised of any metallic material, plastic or any type of materials so long as the material has substantial structural integrity so that the retainer member 110 can withstand holding forces when the adjusting member 112 is pulled through the retainer member 110 to tightly hold the lid 106 in relation to the bin 104. It should be noted the parts or components constituting the retainer member 110 may each comprise of different material so long as they exhibit minimal flexure.

The retainer member 110 passively releases the adjusting member 112 when the retainer member 110 is tilted to a specific orientation (or direction) only, which, in turn, frees the lid 106 to an open position. If the bin 104 is tilted outside the specific orientation (e.g., backward, side ways, or falls side ways), the retainer member 110 maintains its frictional engagement or "grip" onto the adjusting member 112, securely holding and maintaining the adjusting member 112 at a fixed position to maintain the lid 106 in a closed or hold position. The adjusting member 112 is passed through the retainer member 110, which maintains the adjusting member 112 at a desired position (e.g., length, tightness, etc.). When the bin 104 is picked up and tilted to the appropriate orientation to be emptied, an arm 206 of the retainer member 110 passively moves to a release position, and allows the release of the adjusting member 112 to allow the lid 106 to "fling" open. In other words, the retainer member 110 includes an arm 206, which is passively moved (due to gravity) when the retainer member 110 is tilted to a specific orientation to passively release the adjusting member 112. Accordingly and as further detailed below, the retainer member arm 206 is actively moved to one of hold or release positions to hold or release the adjusting member 112, and is passively moved to release the adjusting member 112 when the retainer member 110 is tilted to a specific orientation. If the bin 104 is tilted to any other orientation (e.g., side or back tilted verses the correct forward tilted), the retainer member 110 will not passively release the adjusting member 112, which will maintain the lid 106 in a hold position, keeping the content 108 inside the bin 104.

Figure 1B:
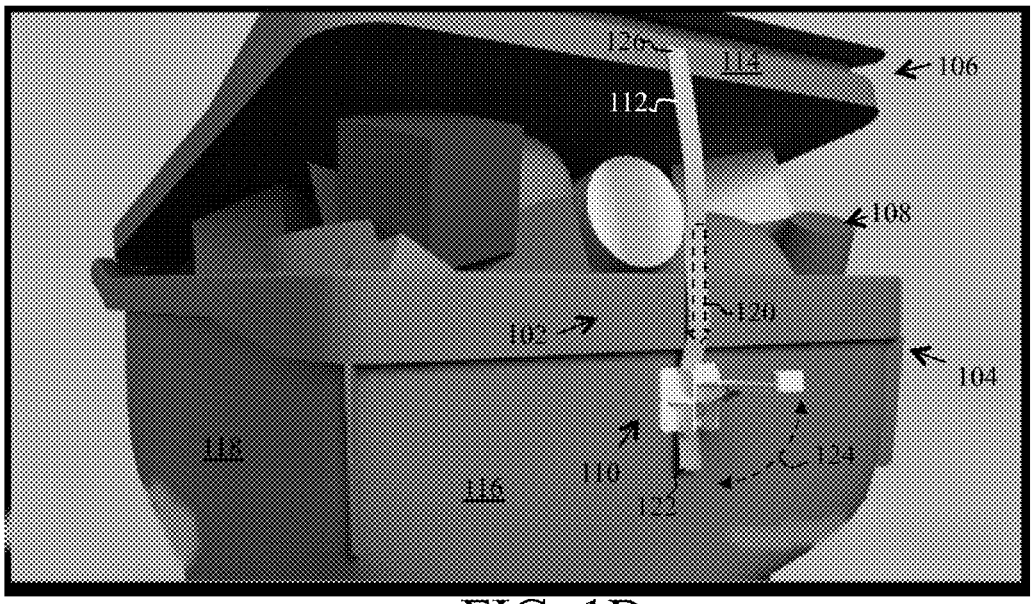

As illustrated in FIGS. 1A to 1E, the retainer mechanism 102 may be used to actively secure or tightly hold down the lid 106 of the bin 104 and for passively (and automatically) self-release or self-unlatch the lid 106 to fully open when and as a result of the retainer mechanism 102 appropriately titling to a particular orientation for unhindered, unobstructed emptying of the bin 104 of its content 108. As illustrated in FIGS. 1A and 1B, the arm 206 (FIG. 2A) of the retainer member 110 of the retainer mechanism 102 may be first moved along a reciprocating path 124 to a disengagement or release position as illustrated, with a free end 122 of the adjusting member 112 maneuvered in the direction illustrated by the arrow 120 through an insertion side 208 and out the extraction side 210 of the retainer member 110. It should be noted that the arm 206 dangles and moves freely due to the pull of the gravity onto an assembled weight 222 and therefore, may be actively held in the illustrated disengagement or release position by users or passively moved to the disengagement or release position when and as a result of the retainer mechanism 102 appropriately titling to a particular orientation. Depending on the degree of tightness desired, pulling onto the free end 122 of the adjusting member 112 from the extraction side 210 of the retainer member 110 would lower (pull in) the lid 106 to a further closed position and if the bin 104 is overfilled with content 108 as illustrated, the lid 106 would simply compact the content 108.

Figure 1C:
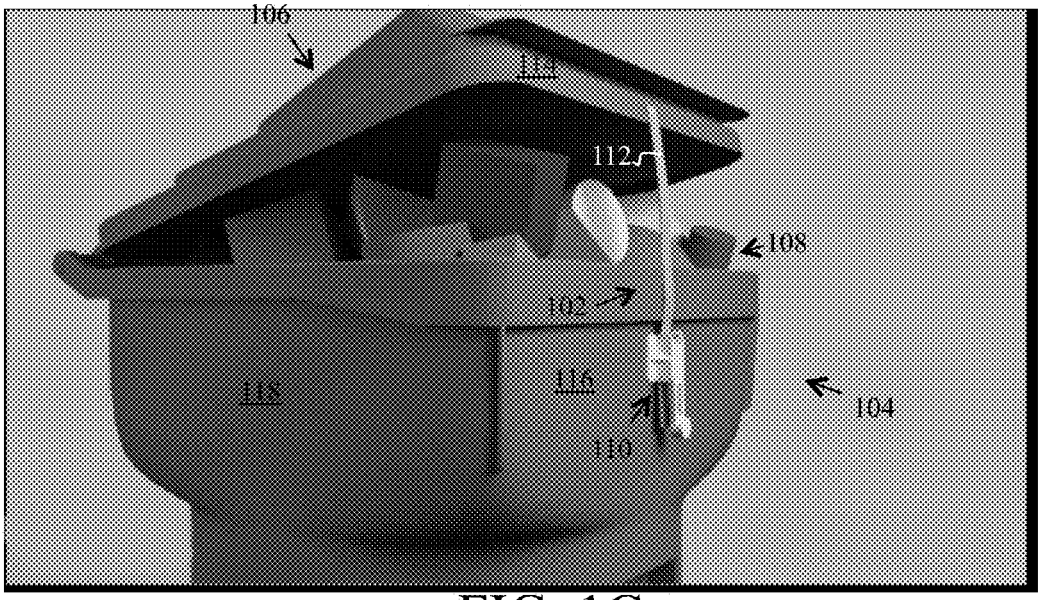
Figure 1D:
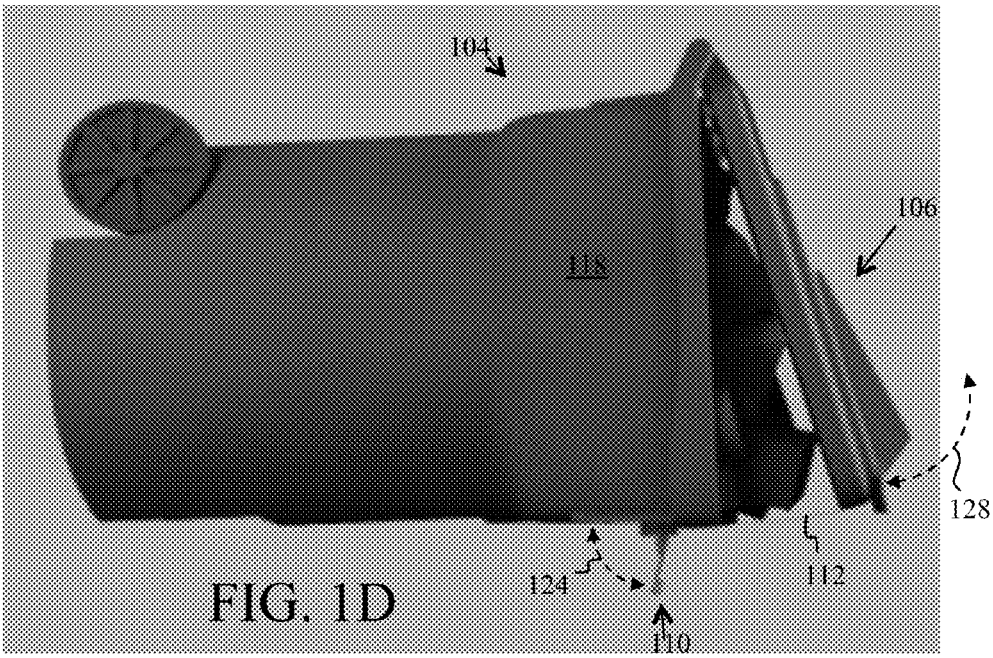
Figure 1E:
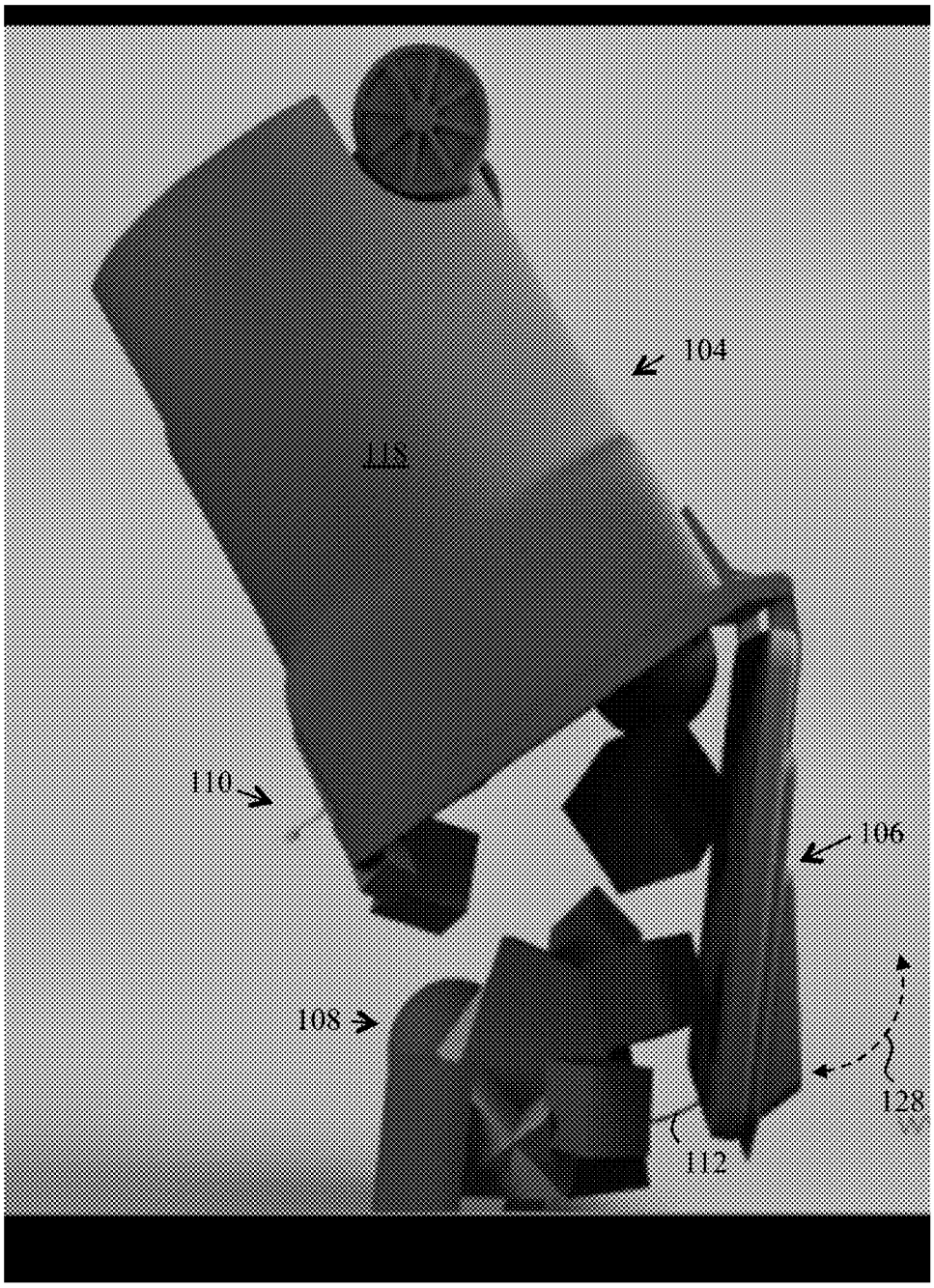

As illustrated in FIG. 1C, once the adjusting member 112 is pulled to a desired degree of tightness out from the extraction side 210 of the retainer member 110, the arm 206 is simply moved along the reciprocating path 124 to an engagement or hold position as illustrated, retaining and holding the adjusting member 112 at the desired tightness. As best illustrated in FIGS. 1D and 1E, when the bin 104 is forward tilted (FIG. 1D) and substantially upside down (FIG. 1E) to empty out the content 108 in normal operation, the arm 206 passively (and automatically) self-releases or self-unlatches due to gravity, dangling free and moving along path 124 to a disengagement or release position, which disengages the retainer member 110 engagement with the adjusting member 112 to free the lid 106 to a fully open position along path 128. The motion of the lid 106 along path 128 pulls out the free end 122 of the adjusting member 112 from the insertion side 208 of the retainer member 110, completely disengaging the adjusting member 112 from the retainer member 110, which allows for unhindered, unobstructed emptying of the bin 104 of its content 108 as shown in FIG. 1E. Accordingly, one or more embodiments of the present invention provide a retainer mechanism 102 that allows for actively securing the lid 106 by a user for holding and maintaining content 108 of the bin 104 even if the container 104 is overfilled and for passively (and automatically) self-releasing the lid 106 to fully open when and as a result of the retainer mechanism 102 appropriately titled to a particular orientation for unhindered, unobstructed emptying of the container 104. However, while the lid 106 of the bin 104 is secured by the retainer mechanism 102, if the bin 104 is tilted and falls onto any one of its vertical sides 118, the lid 106 will remain secure as shown in FIG. 1C, and continue to hold and maintain content 108 of the bin 104. Accordingly, the lid 106 is passively (automatically) released only when and only as a result of the retainer mechanism 102 being tilted to a particular orientation where the arm 206 of the retainer mechanism 102 is able to passively move to a disengaging or release position as illustrated.

Figure 1F:
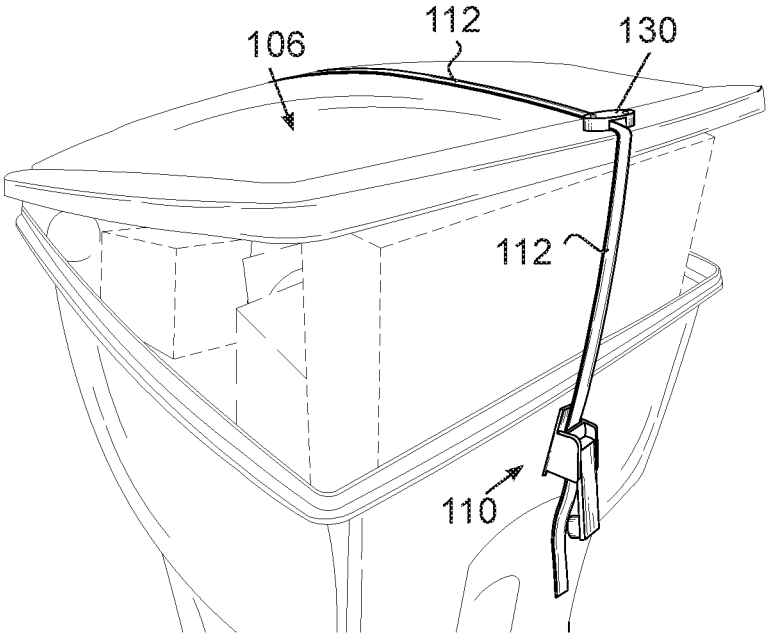
FIGS. 1F and 1G, are non-limiting, exemplary illustration of a retainer mechanism using an optional guide in accordance with an embodiment of the present invention.
Figure 1G:
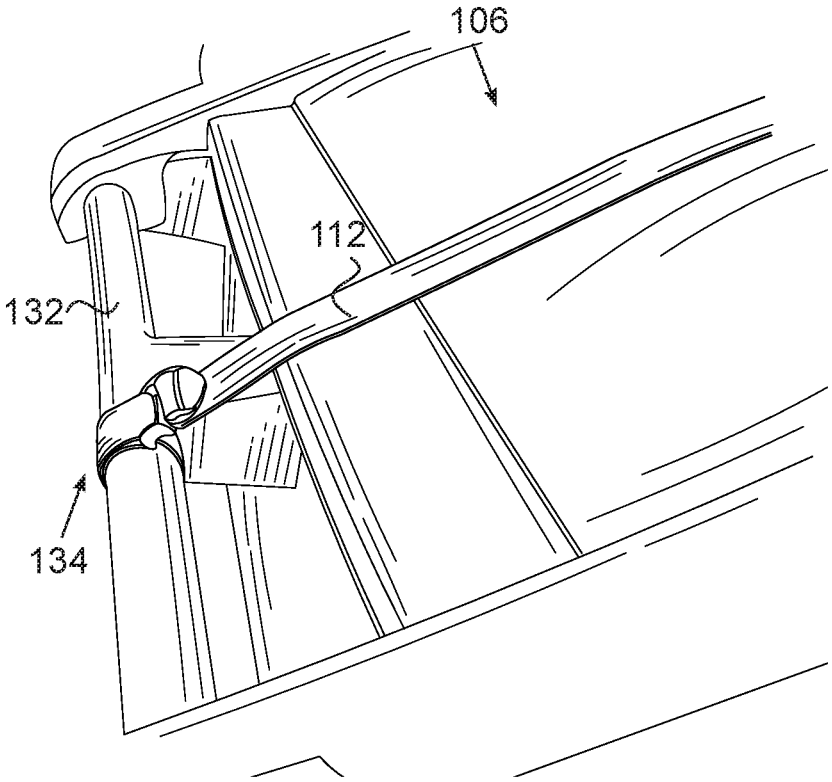

In the non-limiting, exemplary instance illustrated in FIGS. 1A to 1E, a distal end 126 of the adjusting member 112 may be harnessed (secured) to the front 114 of the lid 106 by a variety of mechanisms, non-limiting examples of which may include the use of rivets, screws, through slots, or other fasteners (e.g., glue). Therefore, in one non-limiting, exemplary embodiment one end of the adjusting member 112 may be secured to the front edge 114 of the lid 106 and the other end is free and associated with the retainer member 110. That is, the lid 106 is hinged at one side of the opening of the bin 104 forming a hinged lid, and the adjusting member 112 is coupled with the free, open front side 114 of the lid 106. In another non-limiting, exemplary instance illustrated in FIGS. 1F and 1G, the adjusting member 112 may be lassoed coupled 134 with the back handle 132 of the bin 104, placed over the lid 106, and inserted into the retainer member 110. This enables the adjusting member 112 to be removed for cleaning (rather than a permanent attachment illustrated in FIGS. 1A to 1E). With an embodiment illustrated in FIGS. 1F and 1G, an optional guide 130 may be used to guide and maintain the adjusting member 112 aligned in relation to the retainer member 110 on the lid 104.

The remaining descriptions below detail the various embodiments of a retainer mechanism in accordance with the present invention.

FIGS. 2A to 2J are non-limiting, exemplary, detailed illustrations of a retainer mechanism illustratively shown in FIGS. 1A to 1G, detailing an embodiment of a retainer member in accordance with an embodiment of the present invention. As illustrated in FIGS. 1A to 2J, an embodiment of a retainer mechanism 203 (FIGS. 2B-1 and 2B-2) of the present invention includes a retainer member 205 (FIG. 2A) that is comprised of a mounting support 202, a pivotal member 204 associated with the mounting support 202, and an arm 206 associated with the mounting support 202. The mounting support 202 allows connection or retrofitting of the retainer member 205 with the bin 104 or, alternatively, the mounting support 202 may become an integral part of bin 104 itself (by well known molding or fusing processes).

Figure 2A:
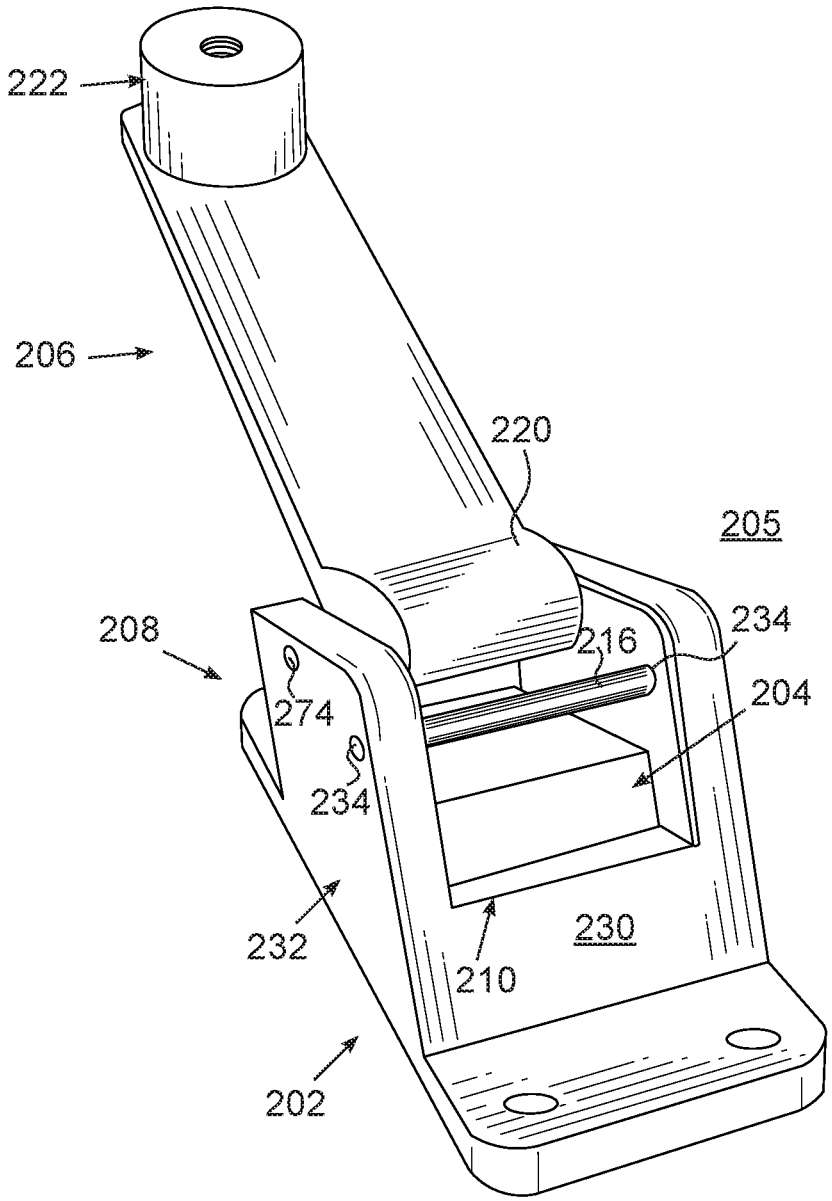
FIGS. 2A to 2J are non-limiting, exemplary, detailed illustrations of a retainer mechanism illustratively shown in FIGS. 1A to 1G, detailing an embodiment of a retainer member in accordance with one or more embodiments of the present invention.
Figures 1, 2B:
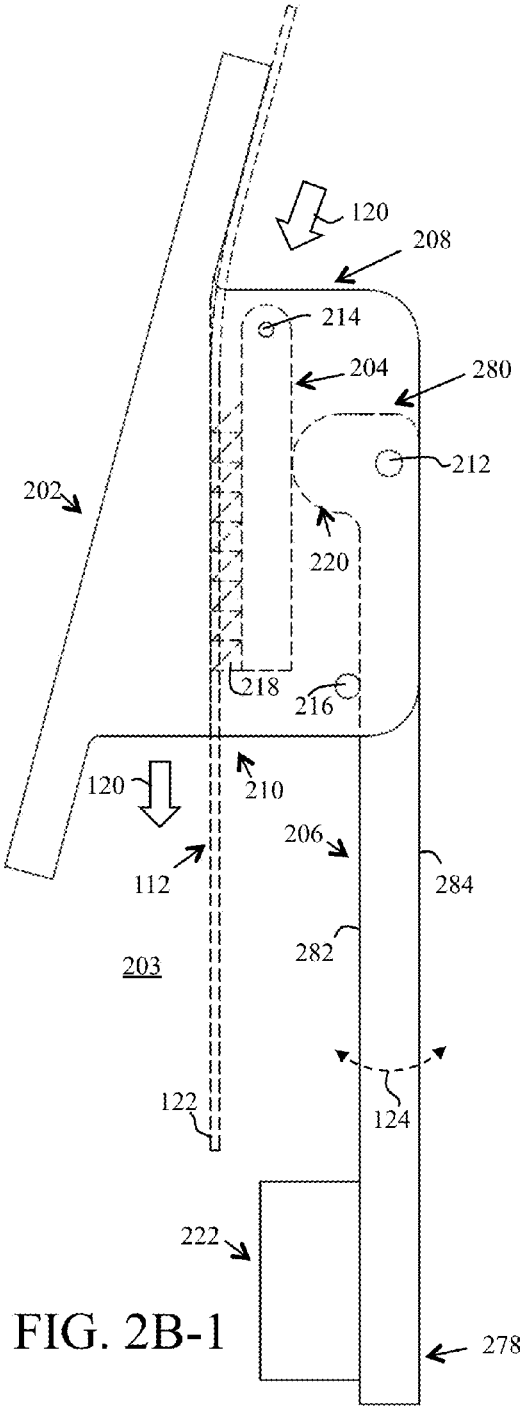
FIGS. 3A-1 to 3D are non-limiting, exemplary, detailed illustrations of a retainer mechanism illustratively shown in FIGS. 1A to 1G, detailing another embodiment of a retainer member in accordance with one or more embodiments of the present invention.

As illustrated, the retainer member 205 of the retainer mechanism 203 has the insertion side 208 that receives a free end 122 of the adjusting member 112 in the direction of the indicated arrow 120, and an extraction side 210 from which the adjusting member 112 is pulled in the direction of the arrow 120, and extracted out to tighten the hold position of the lid 106 of the bin 104. In general, the adjusting member 112 is maneuvered at the insertion side 208 and inserted to pass underneath the illustrated pivotal member 204, while the arm 206 is in the disengaged or release position (FIG. 2A), and exit out the extraction side 210. FIG. 2B-1 exemplarily illustrates the arm 206 in an engagement or hold position in relation to the mounting support 202, which presses the pivotal member 204 against an already inserted adjusting member 112, while FIG. 2B-2 exemplarily illustrates the arm 206 in disengagement or release position in relation to the mounting support 202, which relieves the pressure exerted on the pivotal member 204 to frees the pivotal member 204 to move away from engagement with the adjusting member 112, to thereby allow removal and release of the inserted adjusting member 112.

Figure 2C:
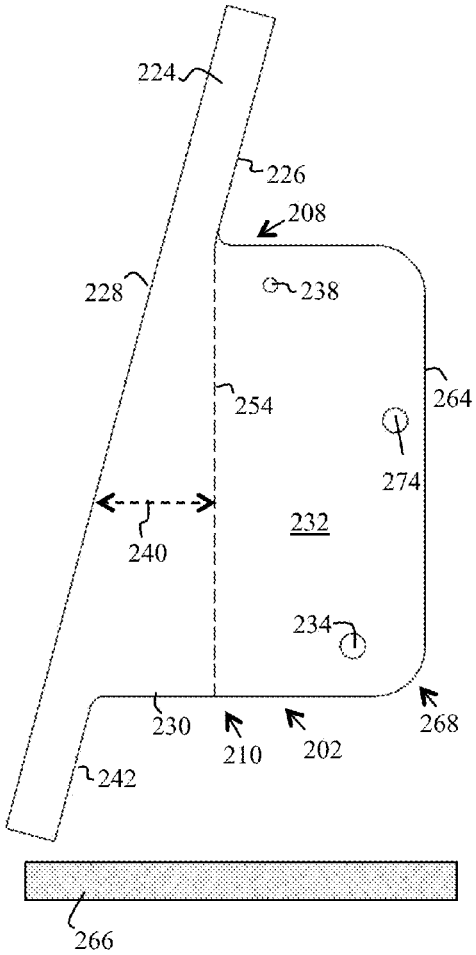

The mounting support 202 of the retainer member 205 is comprised of mounting mechanism that facilitates the coupling of the mounting support 202 with a bin 104. The mounting mechanism may comprise of fastener holes 252 (FIG. 2D) that enable the use of fasteners to couple the mounting support onto the bin 104. The position of the fastener holes 252 may be varied. For example, the bottom surface 228 (FIG. 2C) of the mounting support 202 may have transverse extension instead of the illustrated longitudinally extensions (or the mounting mechanisms) 226 and 242 with the fastener holes 252 positioned at four corners of the transverse extensions. It should be noted that the mounting mechanism may include or use magnets, glue, spring clip or others to fasten onto a bin 104 instead of using fasteners. The mounting support 202 further includes lateral supports 232 and 236 for supporting the arm 206, the pivotal member 204, and an alignment mechanism 216 on the mouthing support 202. The lateral supports 232 and 236 have straight upper edges 264 that are angled in relation to the base 224 of the mounting support 202 so that once the retainer member 110 is mounted onto the bin 104 that has an angled wall, the angled orientation of the straight edges 264 in relation to the base 224 become substantially vertically aligned and (almost or close to) perpendicular in relation to the ground 266 as illustrated in FIG. 2C. The apex 268 of the edges 264 is sufficiently high to ensure that the arm 206 is passively engaged in the hold or engagement position. This way in case the angle of the bin 104 is steeper than that accommodated by the retainer mechanism 102, the arm 206 would not "dangle," but continue to rest on the mounting support 202.

In the non-limiting, exemplary instance illustrated in FIGS. 1A to 2J, a component of the retainer member 205 may be sloped at an angle to commensurately offset an angular incline (if any) of a slanted side (if any) of a bin 104 with which the retainer member 205 is coupled to maintain the arm 206 at a hold position. The hold position may be thought of as the intended default or rest position of the arm 206 where due to gravity as illustrated in FIG. 2B-1, the arm 206 rests against the pivotal member 204 and holds and maintains the adjusting member 112 associated with the lid 106 of the bin 104 at a desired position. The arm 206 freely pivots and "hangs" or "dangles" at one end from the mounting support 202 as a result of an associated weight 222, where due to the pull of gravity the arm 206 with the weight 222 tend to be at a substantially vertical orientation against the ground 266 regardless of mounting support 202 orientation and hence, in order to maintain the arm 206 at a hold position (physically abutting against the pivotal member 204), the mounting support 202 is sloped to hold up the arm 206 against the pull of the gravity due to opposing slope of the bin 104.

As more specifically illustrated in FIGS. 2A to 2J and described below, the mounting support 202 has a base 224 that includes a first mounting mechanism 226 at an insertion side 208, and second mounting mechanism 242 at the extraction side 210, with both having fastener holes 252 for coupling the mounting support 202 to the bin 104. The base 224 is further comprised of a region 254, which progressively slopes (indicated by arrow 240) at an angle along its longitudinal axis 258 from a lower elevation at the insertion side 208 and rising at slope to a higher elevation of height 244, defining a vertical formation 230 at the extraction side 210.

Figures 2, 2B:
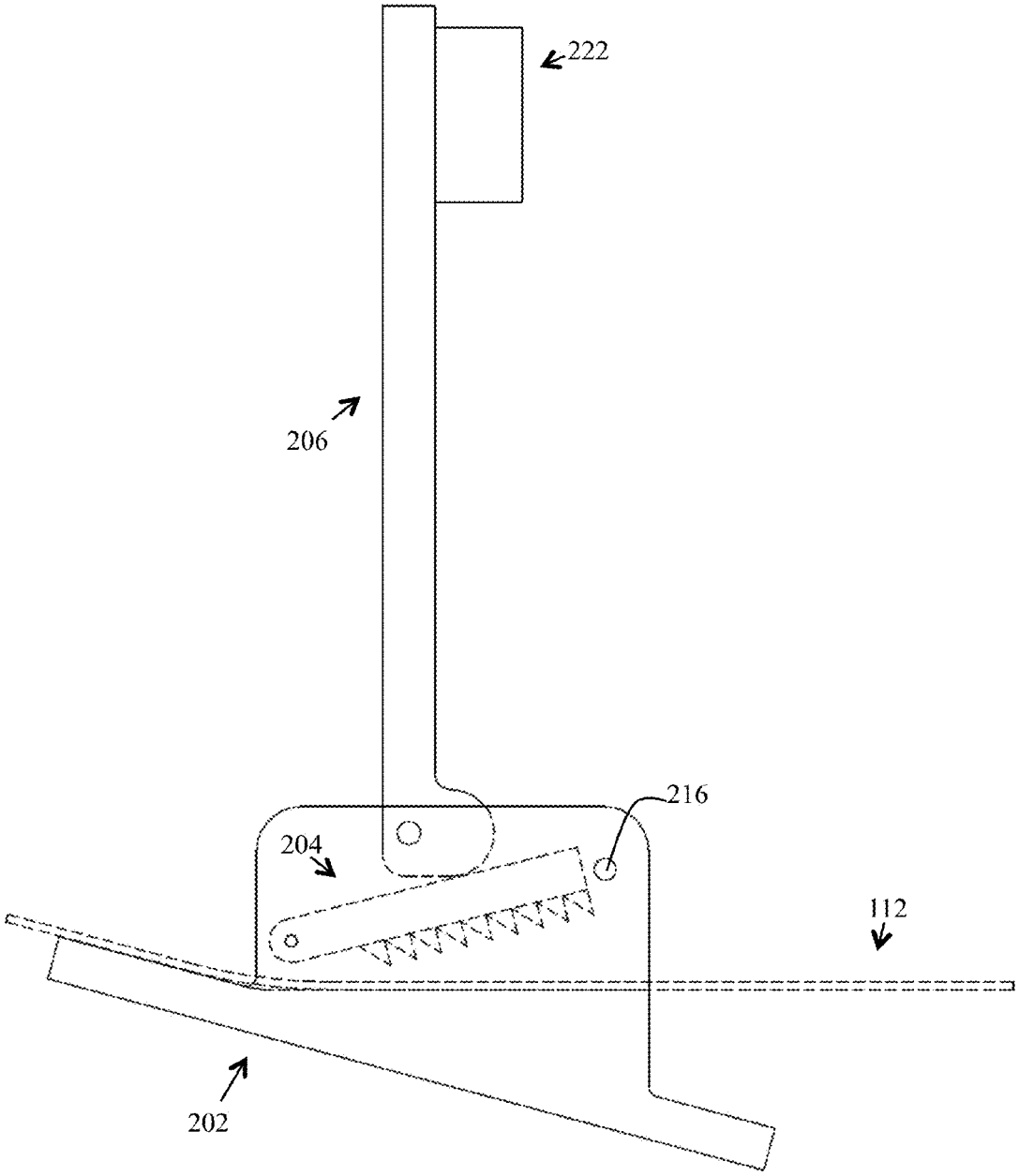
Figure 2D:
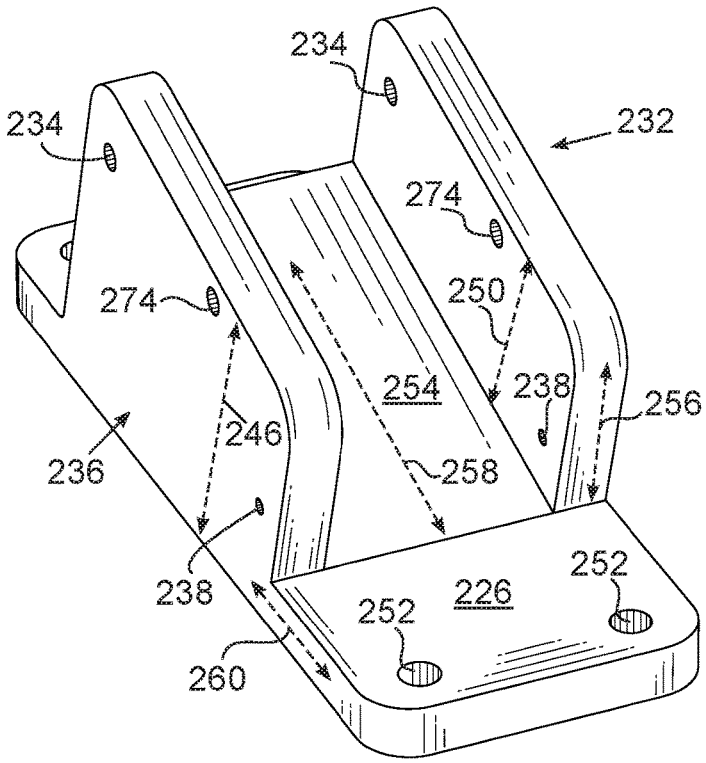
Figure 2F:
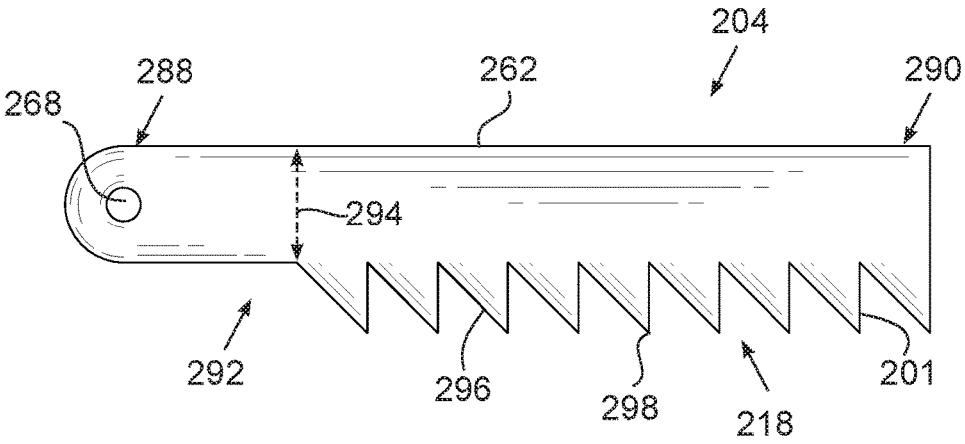
Figure 2E:
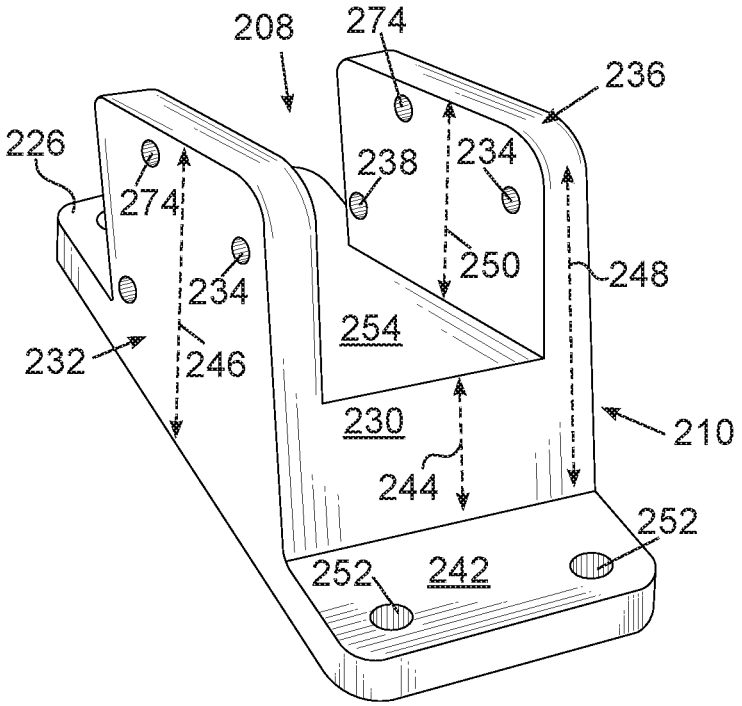
Figure 2G:
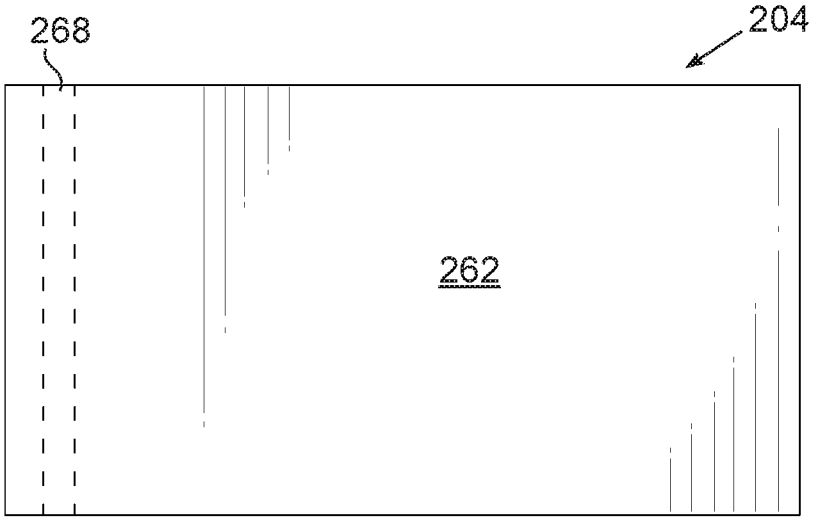
Figure 2H:
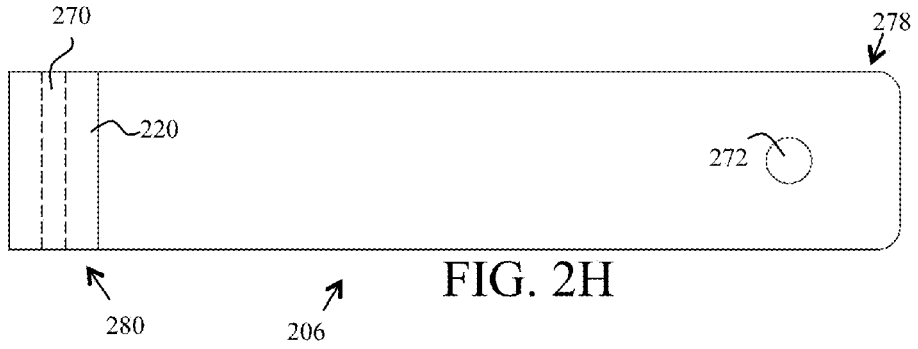

At the insertion side 208 of the mounting support 202 the lateral supports 232 and 236 have an insertion side height 256 (FIG. 2D) that is shorter than an extraction side height 248 (FIG. 2E). The insertion side height 256 progressively increasing to the height of the extraction side height 248 (in relation to the longitudinal direction 260 of the base 224) along the longitudinal axis 258 of the region 254 as indicated by the arrow 246, with the increase commensurate with the increase in the slope of the region 254. However, the interior facing height 250 of both of the lateral supports 232 and 236, which is measured from top surface of the region 254 at the bottom of the lateral support 232 and 236, is constant in relation to the region 254 along the entire span of the longitudinal axis 258 of the region 254. The region 254 in combination with the inner surfaces of the lateral supports 232 and 236 may be considered as a channel or a guiding slot for maneuvering (insertion or extraction) of the adjusting member 112.

As further indicated, the mounting support 202 further includes at least three pairs of aligned holes on the respective lateral supports 232 and 236, with the first pair of holes 238 near the insertion side 208 used for receiving a pivotal member hinge pin 214 that enables the pivotal member 204 to be hinge coupled with the lateral supports 232 and 236 of the mounting support 202. A second pair of holes 274 also near the insertion side 208 is used for receiving an arm hinge pin 212 that enables the arm 206 to be hinged coupled with the lateral supports 232 and 236 of the mounting support 202, and finally, a third pair of holes 234 near the extraction side 210 are used for receiving an alignment mechanism (in a form of a rod or bar) 216.

As further illustrated in FIGS. 1A to 2J, the retainer member 205 further includes the arm 206 for holding and maintaining the adjusting member 112 frictionally engaged with the retainer member 205 (via the pivotal member 204). The arm 206 may comprise of any shape so long as it has sufficient length 276 to provide the required torque (almost functioning as a lever) to enable itself to be passively moved to a release position when the retainer mechanism 203 is appropriately tilted. The arm 206 itself could be comprised of a heavy weight or mass and therefore, the added weight 222 at its free distal end 278 may be optional.

In the instance illustrated, the weight 222 at the free distal end 278 of the arm 206 (or the weight of the arm 206 itself) generates a force (i.e., a torque) that causes the arm 206 to rotate (along the reciprocating path 124) from hold to release position, pivoting about a hinged protruded portion 220 (of the arm 206) due to gravity when the retainer member 205 is appropriately tilted. The optional weight 222 is not only for maintaining the arm 206 at hold position, but to also facilitate the rotation of the arm 206 along path 124 by providing an appropriate torque due to pull of gravity on the weight 222, which moves (swings) the arm 206 to a release position (FIGS. 2A and 2B-2). The further the weight or heavier, the greater the toque-force generated and experienced at the distal end 280 of the arm 206. As illustrated, the weight or mass 222 may be coupled with the free distal end 278 of the arm 206 by a rivet or other mechanism, passed through aperture 272, with one or more weights 222 coupled to one or both underside 282 or topside 284 of the arm 206.

Figure 2I:
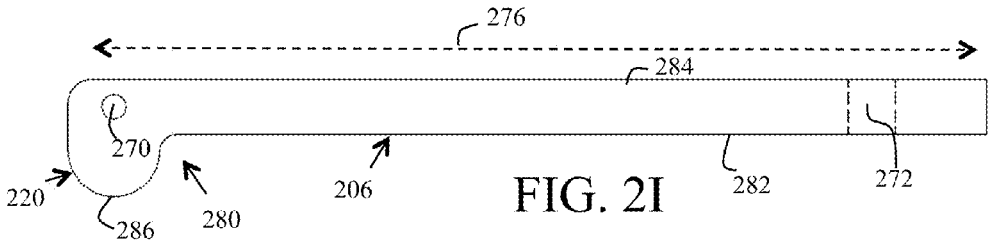
Figure 2J:
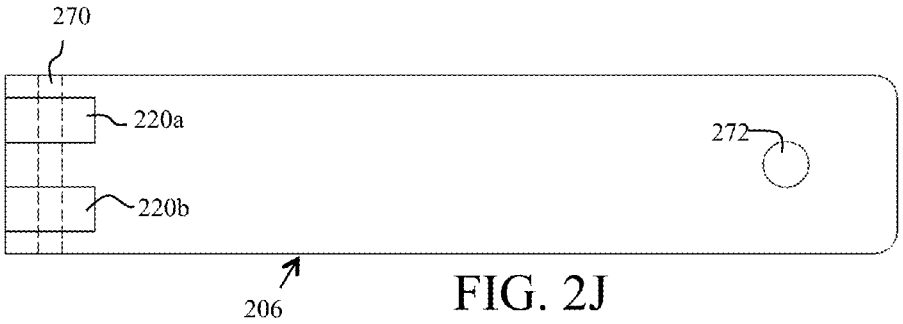

The arm 206 further includes another distal end 280 that has at least one protruded portion 220 that includes a hinge mechanism to pivotally couple the arm 206 with the mounting support 202. The hinge mechanism includes the hinge pin 212 that passes through a hinge barrel 270 and is coupled to the second pair of holes 274 on the lateral supports 232 and 236 of the mounting-support 202. As illustrated in FIGS. 2I and 2J, the protruded portion may be a single piece 220 (FIGS. 2H and 2I) or comprised of two or more pieces 220*a*, 220*b* (illustrated in FIG. 2J).

An apex 286 of the protruded portion 220 of the arm 206 is in sliding contact with a top surface 262 of the pivotal member 204 (detailed below) to impart motion thereto and move the pivotal member 204 in to a tight engagement (or hold position) with the adjusting member 112 by providing maximum pressure on the top surface 262 of the pivotal member 204. The protruded portion 220 of the arm 206 may be thought of as a cam, which is a projection on a rotating part of the arm 206, designed to make sliding contact with pivotal member 204 while rotating and to impart motion to the pivotal member 204, which moves the pivotal member 204 to tightly engage the adjusting member 112. The protruded portion 220 of the arm 206 at arm hold position (engagement) is maximally pressed against the pivotal member 204 and substantially at a middle section of the pivotal member 204.

As further illustrated in FIGS. 1A to 2J, the retainer member 205 further includes a pivotal member 204. The pivotal member 204 is pivotally hinged at one end 288 on the mounting support 202 to facilitate insertion and release of the adjusting member 112, and is free at a second distal end 290 thereof. The pivotal member hinge mechanism includes the hinge pin 214 that passes through a hinge barrel 268 and is coupled to the first pair of holes 238 on the lateral supports 232 and 236 of the mounting-support 202. The pivotal member 204 is comprised of a bottom surface 292 that is optionally serrated 218 or roughed up in known manners to improve grip with the associated adjusting mechanism 112, a top surface 262 that is substantially smooth to decrease friction with cam action (the protruded portion 220) of the arm 206, and has a uniform thickness 294.

The pivotal member 204 includes the optionally serrated 218 or roughed up surface to improve grip with the adjusting member 112. The adjusting member 112 is sandwiched between the pivotal member 204 and the region 254 to associate with the retainer member 205. It should be noted that it is preferred to have serrations 218 for improved grip, but a flat surface or wavy or any surface feature so as to create resistance against slippage of the adjustable member 112 would also function. The serrated surface 218 may have a saw-tooth configuration with each serration including a first surface 296 having a slope that ramp towards an apex 298, and a second surface 201 that drops substantially vertically from the apex 298 towards the bottom surface 292. The first surface 296 is inclined in an orientation opposite a directional movement that releases the adjusting mechanism 112 (to remove it out from the insertion side 208).

As indicated above, the mounting support 202 includes an alignment mechanism 216 that aligns the apex 286 of the protruded portion 220 of the arm 206 in sliding contact with the top surface 262 of the pivotal member 204 to impart motion thereto and move the pivotal member 204 in to a tight engagement with the adjusting member 112 by providing maximum pressure on the top surface 262 of the pivotal member 204. The alignment mechanism (the rod or bar) 216 is optional if the protruded portion 220 is of sufficiently large size that would provide continuous sliding contact (i.e., engage) with the top surface 262 of the pivotal member 204, regardless of the hold position of the arm 206. In other words, without the alignment mechanism 216 and with the given size of the protruded portion 220, the arm 206 would overshoot (along path 124) where the bottom side 282 of the arm 206 would contact the top surface 262 of the pivotal member 204. The overshooting of the arm 206 would also rotate the protruded portion 220 passed beyond its optimal hold position, which would basically void its cam affect on the pivotal member 204. That is, the overshoot of the arm 206 would cause the apex 286 of the protruded portion 220 to pass beyond its optimal hold or contact position with the top surface 262 of the pivotal member 204 to thereby reduce or eliminate any cam affect.

The engagement (or sliding contact) of the protruded portion 220 of the arm 206 is positioned substantially at a middle of the top surface 262 of the pivotal member 204 to substantially uniformly press down the entire pivotal member 204 against the adjusting member 112. The protruded portion 220 provides a pressure (force) on the middle of the top surface 262 of the pivotal member 204, which is substantially uniformly distributed on the pivotal member 204 to uniformly engage with maximum contact surface area of the adjusting member 112.

It should be noted that the retainer member 205 would function to retain and hold the adjusting member 112 in a desired position without using the pivotal member 204. However, the pivotal member 204 serves the important function of reducing friction between the protruded portion 220 of the arm 206 and the adjusting member 112. More particularly, the pivotal member 204 serves to reduce friction between the protruded portion 220 of the arm 206 and the top surface 262 of the pivotal member 204 to a point where the arm 206 is easily moved from its hold (or engagement) position to release (or disengagement) position to release the adjusting member 112. The pivotal member 204 also serves to hold the adjusting member 112 while the arm 206 is in the hold position, with the protruded portion 220 of the arm 206 pressing on the pivotal member 204. Without the pivotal member 204, the protruding portion 220 of the arm 206 would properly hold and maintain the adjusting member 112 at a desired hold position, but the very friction that would properly hold the adjusting member 112 would also prevent the arm 206 from releasing the adjusting member 112 due to friction. That is, the friction between the protruding portion 220 of the arm 206 and the adjusting member 112 (without using the pivotal member 204) would prevent the arm 206 from pivoting or rotating so that the protruded portion 220 is no longer engaged or in contact with the adjusting member 112, regardless of the tilt. Therefore, a pivotal member 204 may be used to enable easy (and passive) movement of the arm 206 from its hold position to release position. That is, the smooth top surface 262 of the pivotal member 204 eliminates friction that would prevent or impede passive movement of the arm 206 to a release position. Accordingly, if a pivotal member 204 is not used, then some other mechanism must be provided to reduce friction between the arm 206 and the adjusting member 112 so to overcome the friction between the adjusting member 112 and the arm 206, and enable passive movement of the arm 206 from a hold to a release position.

Figures 1, 3A:
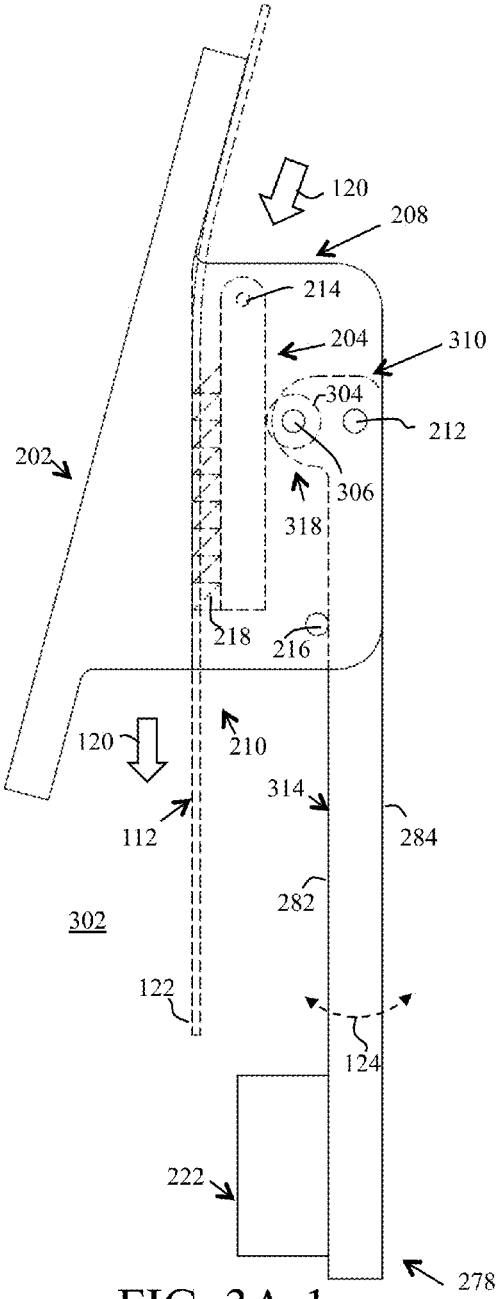
Figures 2, 3A:
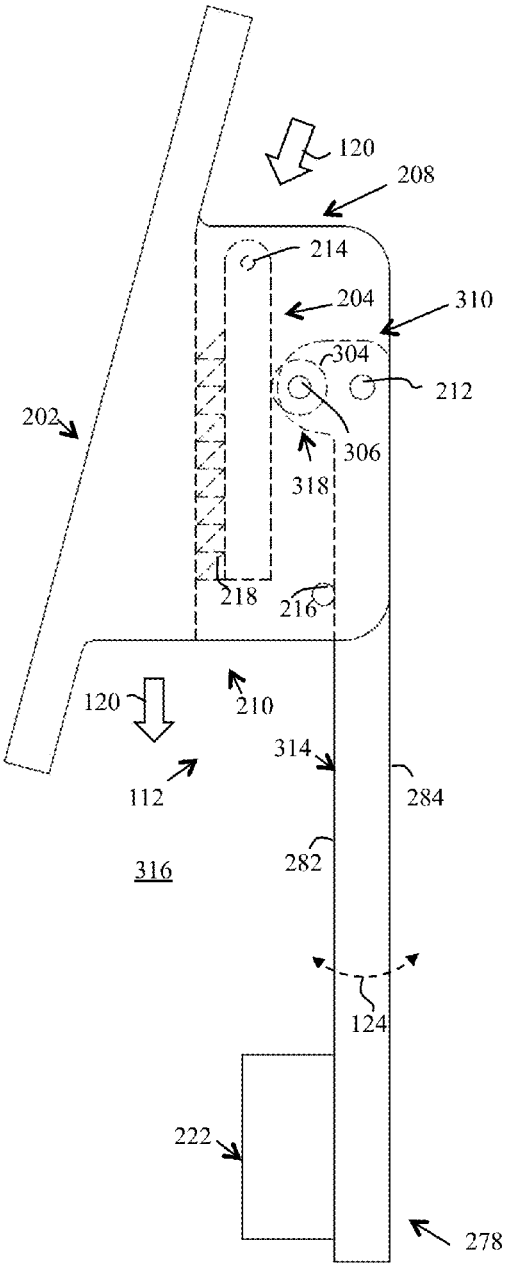
Figure 3B:
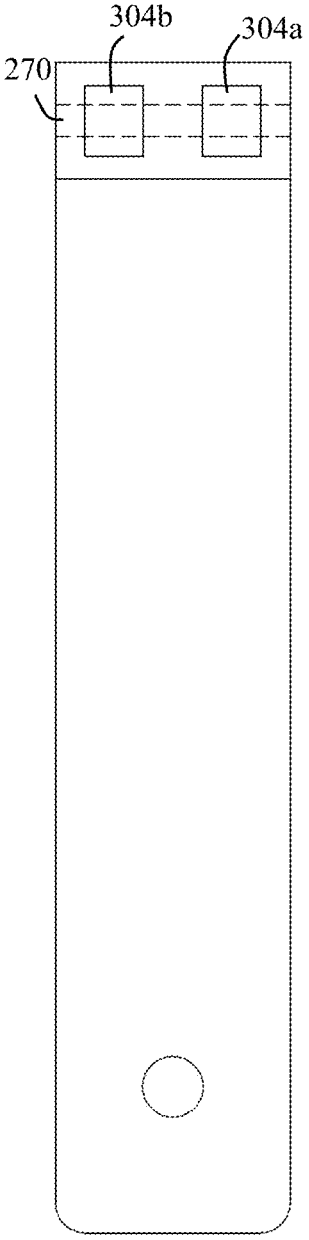
Figure 3C:
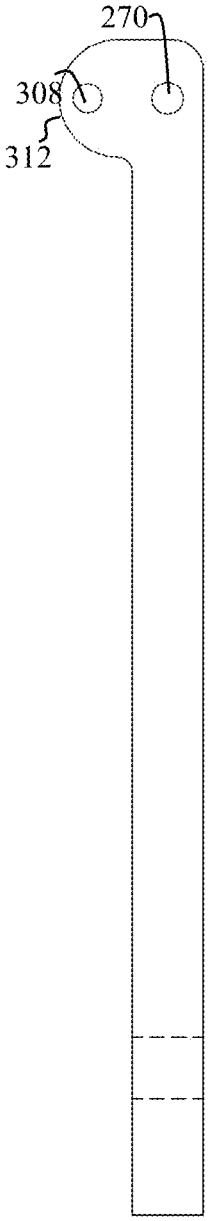
Figure 3D:
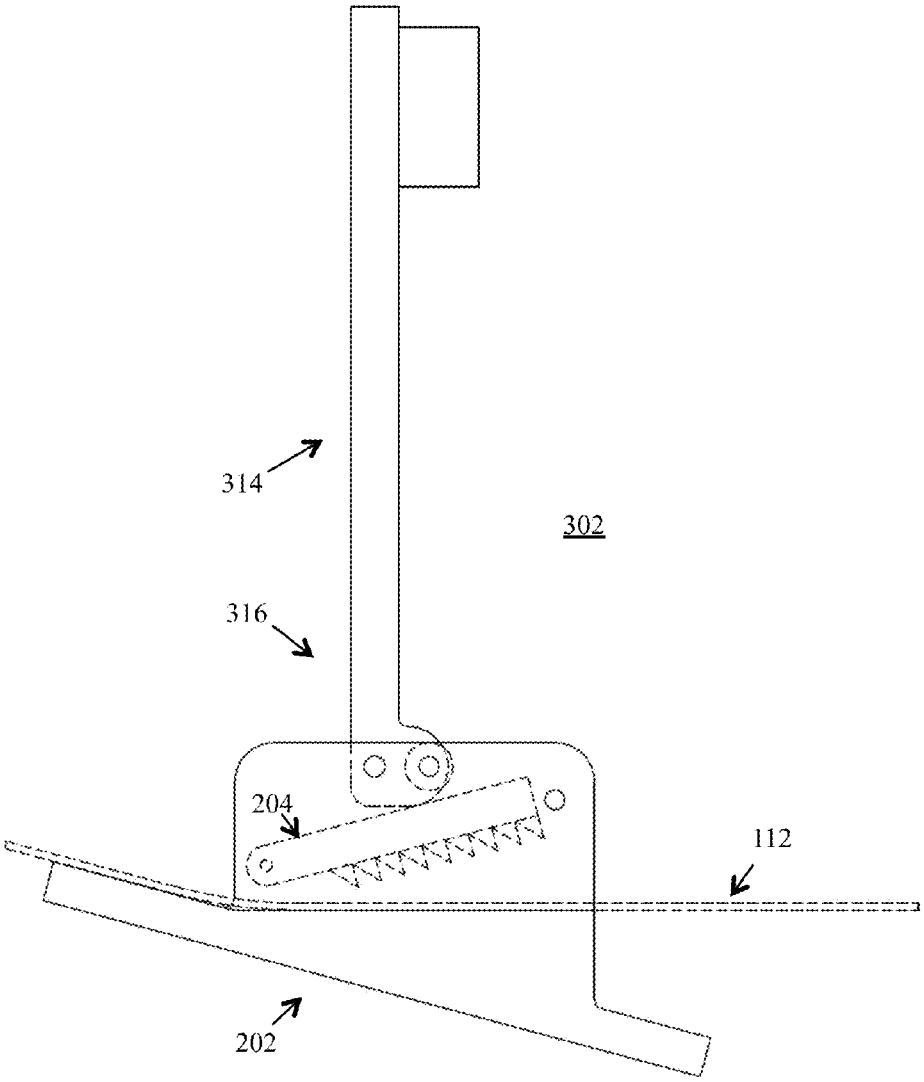
Figure 4A:
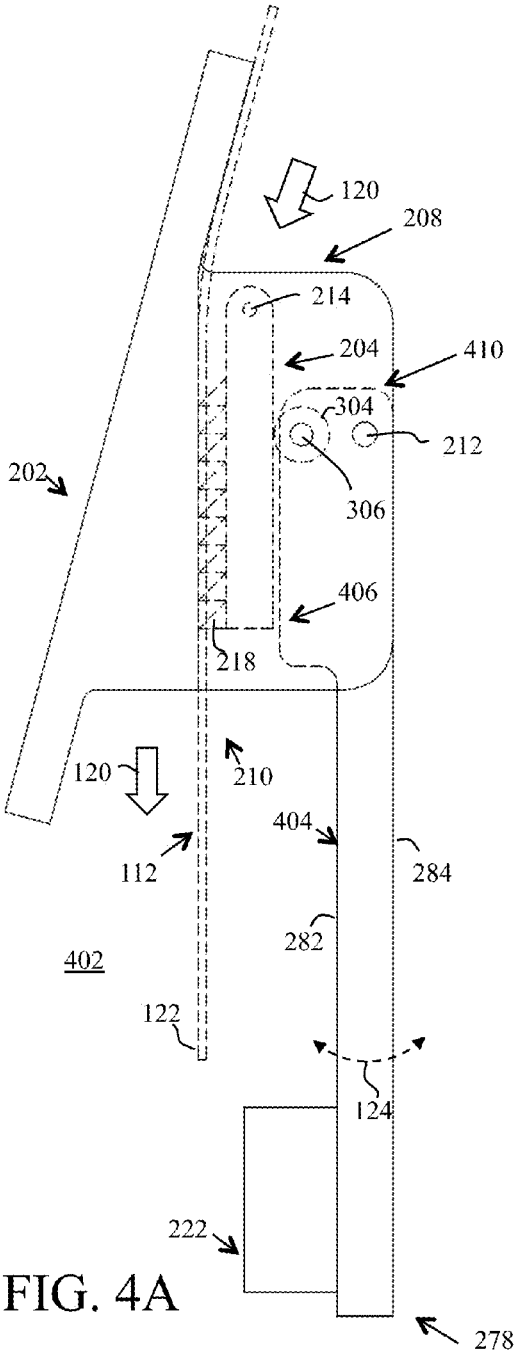
FIGS. 4A to 4D are non-limiting, exemplary, detailed illustrations of a retainer mechanism illustratively shown in FIGS. 1A to 1G, detailing another embodiment of a retainer member in accordance with one or more embodiments of the present invention.
Figure 4B:
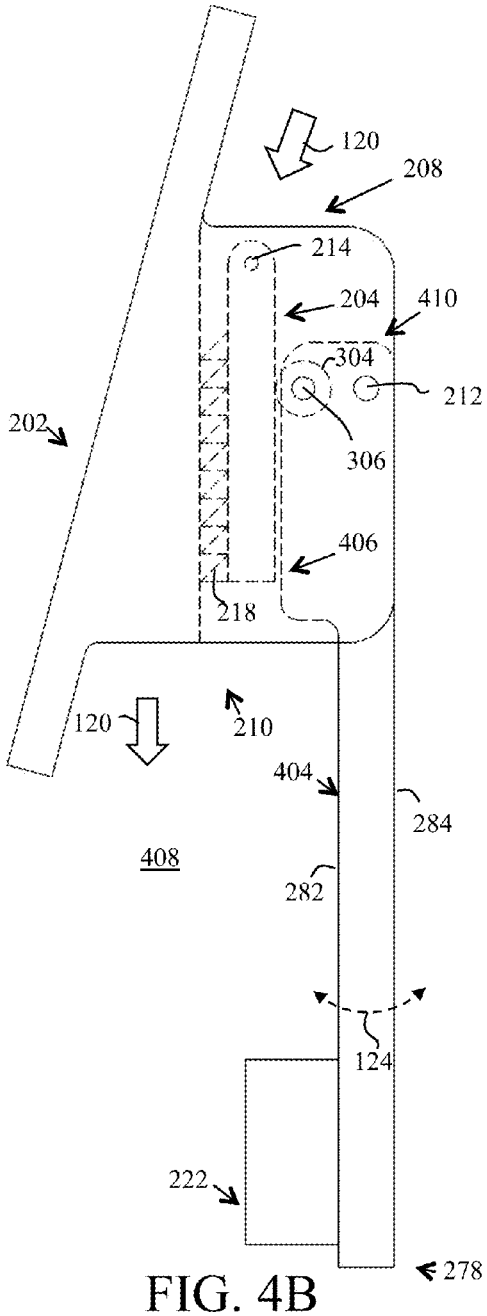
Figure 4C:
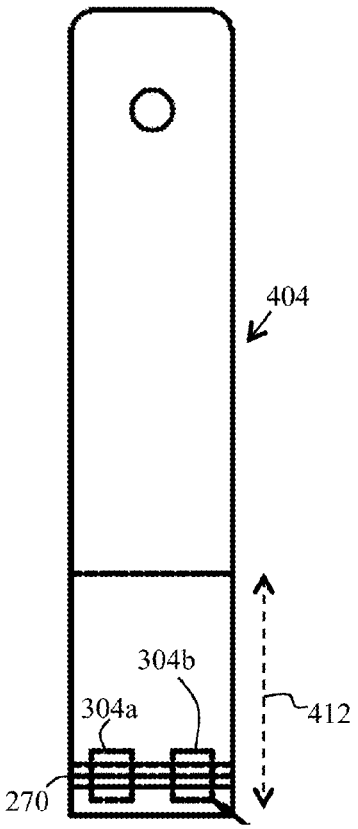
Figure 4D:
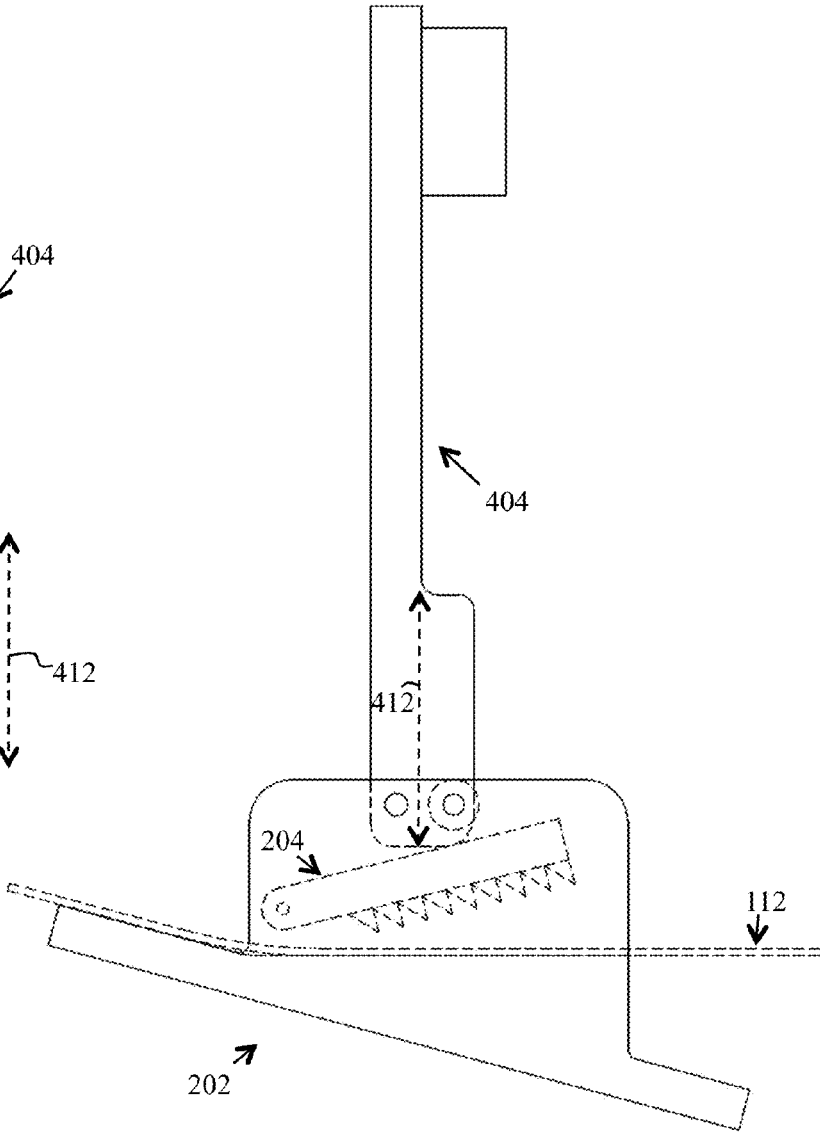

FIGS. 3A-1 to 3D are non-limiting, exemplary, detailed illustrations of an embodiment of a retainer mechanism illustrated in FIGS. 1A to 1G, detailing an embodiment of a retainer member in accordance with an embodiment of the present invention. The retainer mechanism illustrated in FIGS. 3A-1 to 3D includes similar corresponding or equivalent components, interconnections, functional, and or cooperative relationships as the retainer mechanisms 102 and 203 that is shown in FIGS. 1A to 2J, and described above. Therefore, for the sake of brevity, clarity, convenience, and to avoid duplication, the general description of FIGS. 3A-1 to 3D will not repeat every corresponding or equivalent component, interconnections, functional, and or cooperative relationships that has already been described above in relation to retainer mechanisms 102 and 203 that is shown in FIGS. 1A to 2J.

As illustrated in FIGS. 1A to 3D, in this non-limiting, exemplary embodiment, a retainer mechanism 302 is disclosed that has an arm 314 with a distal end 310 that includes at least one protruded portion 318 that includes a hinge mechanism to pivotally couple the arm 314 with the mounting support 202. The hinge mechanism includes the hinge pin 212 that passes through the hinge barrel 270 and is coupled to the second pair of holes 274 on the lateral supports 232 and 236 of the mounting-support 202. In this embodiment, the protruded portion 318 also accommodates a rotating member 304 such as a wheel (or bearing, etc.).

The rotating member 304 is coupled within the protruded portion 318 of the arm 314 through an axle 306 that is inserted in an axle hole 308 at the protruded portion 318. Accordingly, the one or more rotating member 304 facilitate to further reduce friction between the protruded portion 318 and the top surface 262 of the pivotal member 204 by their rolling action, which would also enable the use of lesser weight 222, reducing the required torque needed to move the arm 314 to the release position (FIG. 3D). In other words, the use of the rotating member 304 facilitate improved cam action of the protruded portion 318 while reducing friction. The rotating member 304 rotates on the top surface 262 of the pivotal member 204 (as best illustrated in FIGS. 3A-1 and 3D) rather than the sliding action of an apex 312 (FIG. 3C) of the protruded portion 318, enabling the arm 314 to easily move from a hold or engagement position (FIG. 3A-1)

to a release or disengagement position (FIG. 3D). As illustrated in FIG. 3B, the rotating member 304 may be a single piece 304 or comprised of two or more pieces 304*a*, 304*b*.

FIGS. 4A to 4D are non-limiting, exemplary, detailed illustrations of an embodiment of a retainer mechanism illustrated in FIGS. 1A to 1G, detailing an embodiment of a retainer member in accordance with an embodiment of the present invention. The retainer mechanism illustrated in FIGS. 4A to 4D includes similar corresponding or equivalent components, interconnections, functional, and or cooperative relationships as the retainer mechanisms 102, 203, and 302 that are shown in FIGS. 1A to 3D, and described above. Therefore, for the sake of brevity, clarity, convenience, and to avoid duplication, the general description of FIGS. 4A to 4D will not repeat every corresponding or equivalent component, interconnections, functional, and or cooperative relationships that has already been described above in relation to retainer mechanisms 102, 203, and 302 that are shown in FIGS. 1A to 3D.

In this non-limiting, exemplary embodiment, a retainer mechanism 402 is disclosed that has an arm 404 with a distal end 410 that includes a protruded portion 406 that also accommodates a rotating member 304 such as a wheel (or bearing, etc.). However, in this instance, the protruded portion 406 is a greater expanse or size, covering over a substantial part of the top surface 262 of the pivotal member 204. The extended or enlarged protruded portion 406, which continues to provide a cam action, would eliminate the need for an alignment mechanism 216. That is, as mentioned above in relation to FIG. 2B-1 for example, the mounting support 202 includes the alignment mechanism 216 that aligns an apex 286 of the protruded portion 220 of the arm 206 in sliding contact with the top surface 262 of the pivotal member 204 to impart motion thereto and move the pivotal member 204 in to a tight engagement with the adjusting member 112 by providing maximum pressure on the top surface 262 of the pivotal member 204. The alignment mechanism (the rod or bar) 216 is optional if the protruded portion 318 is of sufficiently large size (as illustrated in FIGS. 4A to 4D) that would provide continuous sliding contact (i.e., engage) with the top surface 262 of the pivotal member 204, regardless of the hold position of the arm 404. Accordingly, the bulk or size of the protruded portion 302 (shown in FIGS. 3A-1) may be increased to that which is illustrated in FIGS. 4A to 4D to facilitate better sliding contact and engagement with the pivotal member 204 without the use of the alignment mechanism 216. The larger size of the protruded portion 406 will always insure a sliding contact or engagement with the top surface 262 of the pivotal member 204 with no need for alignment (to prevent overshoot of the arm 404 when in to its hold position). In general, the thickness and the width of the protruded portion 406 need not be changed, only a length 412 of the protruded portion 406 may be expanded and extended with the same depth and the same width to span from the distal end 410 of the arm 406 to at least the distal end 290 of the pivotal member 204, while the total axial length 276 of the arm 406 remaining the same.

FIGS. 5A to 5G are non-limiting, exemplary, detailed illustrations of an embodiment of a retainer mechanism illustrated in FIGS. 1A to 1G, detailing an embodiment of a retainer member in accordance with an embodiment of the present invention. The retainer mechanism illustrated in FIGS. 5A to 5G includes similar corresponding or equivalent components, interconnections, functional, and or cooperative relationships as the retainer mechanisms 102, 203, 302, and 402 that are shown in FIGS. 1A to 4D, and described above. Therefore, for the sake of brevity, clarity, convenience, and to avoid duplication, the general description of FIGS. 5A to 5G will not repeat every corresponding or equivalent component, interconnections, functional, and or cooperative relationships that has already been described above in relation to retainer mechanisms 102, 203, 302, and 402 that are shown in FIGS. 1A to 4D.

In this non-limiting, exemplary embodiment, a retainer mechanism 502 is disclosed that has a mounting support 508 that is not slanted at its region 516 but, instead, a pivotal member 506 is disclosed that is sloped. As illustrated in FIGS. 5A to 5G, in this non-limiting, exemplary embodiment, a retainer member 504 includes a mounting support 508 that has a base 510 with a region 516 that is not slanted but, instead, the pivotal member 506 is sloped (i.e., has a varying thickness). As indicated above, a component of the retainer member may be sloped at an angle to commensurately offset an angular incline of a slanted side of a bin with which the retainer member is coupled to maintain the arm at a hold position.

Figure 5A:
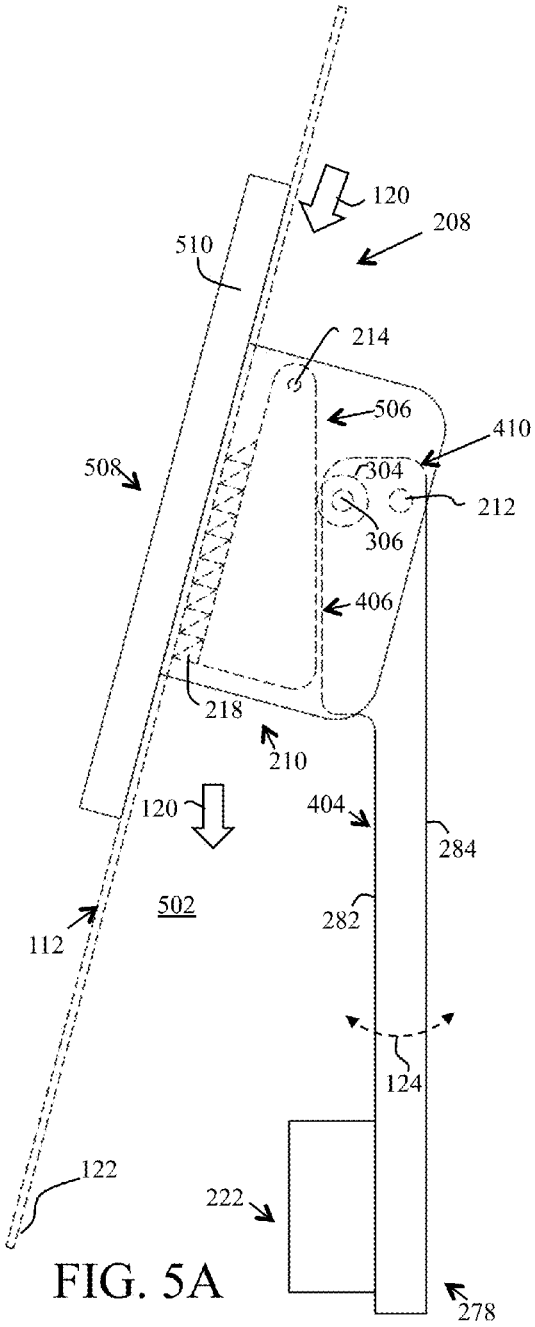
FIGS. 5A to 5G are non-limiting, exemplary, detailed illustrations of a retainer mechanism illustratively shown in FIGS. 1A to 1G, detailing another embodiment of a retainer member in accordance with one or more embodiments of the present invention.
Figure 5B:
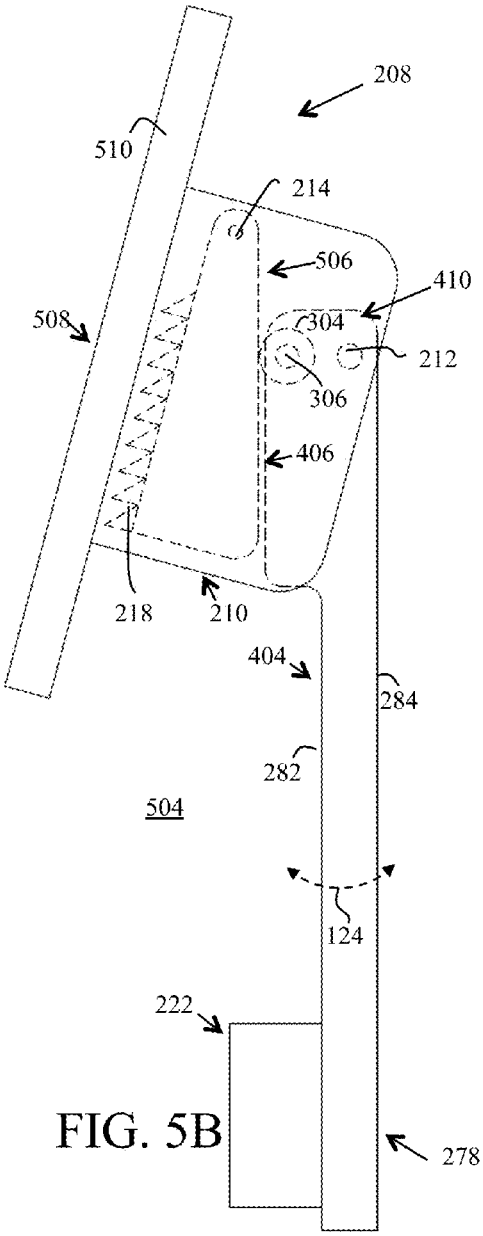
Figure 5C:
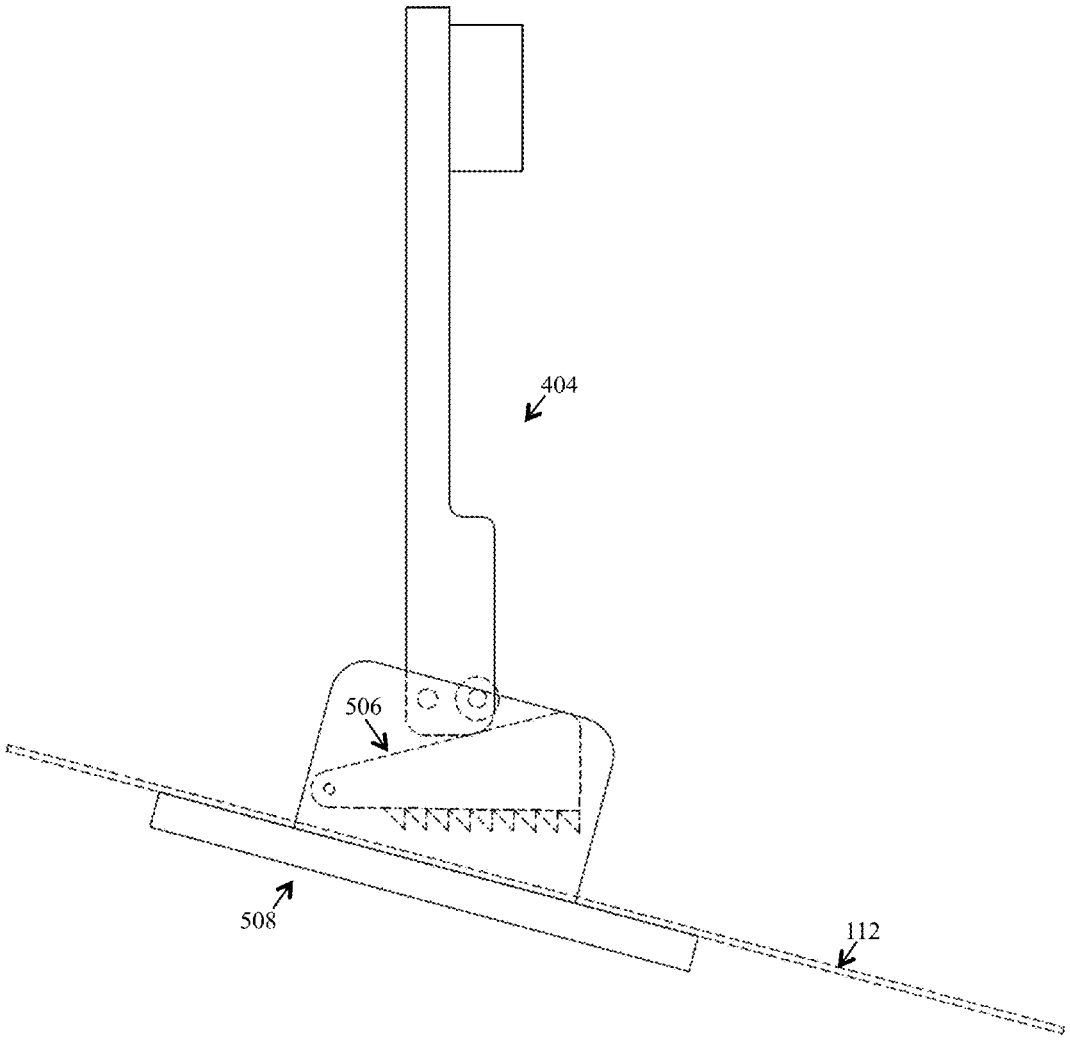
Figure 5D:
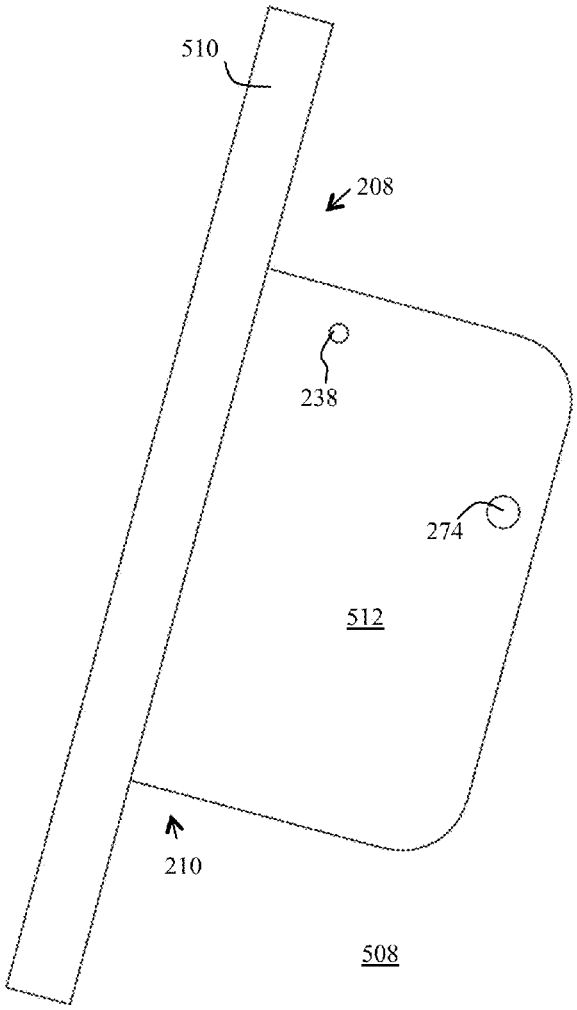
Figure 5E:
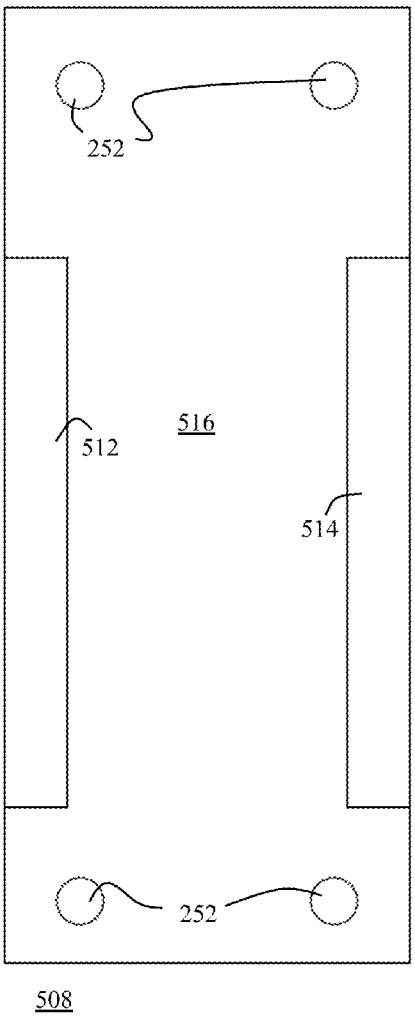

As illustrated in FIGS. 5D and 5E, the base 510 of the mounting support 508 is generally flat from the insertion side 208 to the extraction side 210. Therefore, at the insertion side 208 of the mounting support 508 the lateral supports 512 and 514 have an insertion side height that is equal to that of extraction side height, this includes the interior facing height of both of the lateral supports 512 and 514, which are measured from top surface of the region 516 at the bottom of the lateral support 512 and 514, which is constant in relation to the region 516 along the entire span of the base 510.

Figure 5F:
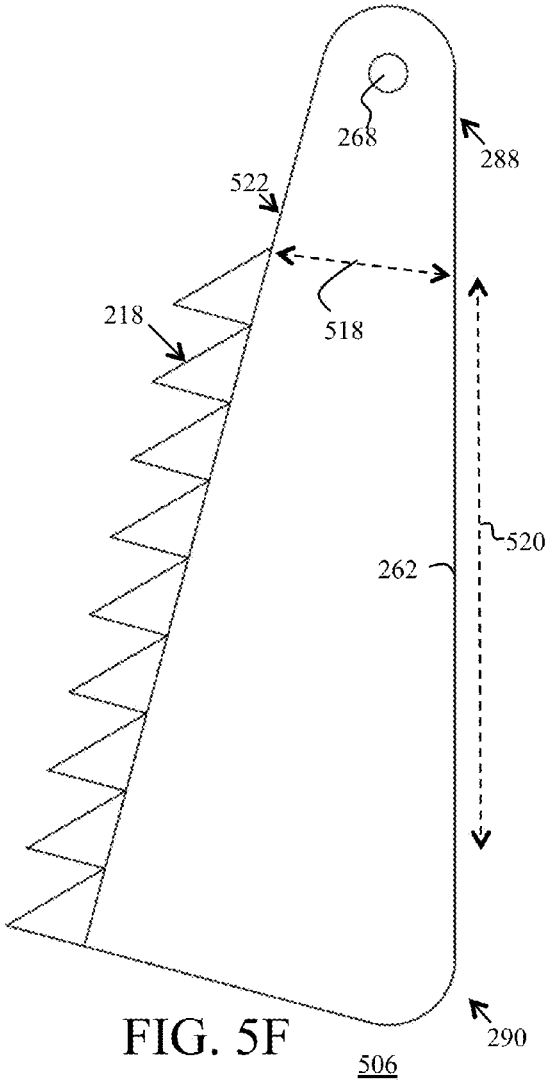
Figure 5G:
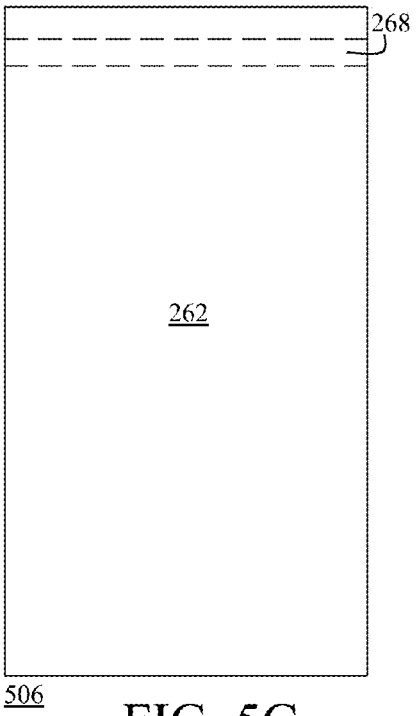

Further, as illustrated in FIGS. 5F and 5G instead of the region 254 having a tilt to compensate for the tilting angle of the bin, the pivotal member thickness 518 (FIG. 5F) may be varied instead to compensate for the bin tilt angle. Accordingly, the thickness 518 of the pivotal member 506 may be varied from its hinged end (the distal end 288) and ramp up at a desired angle to a higher thickness at the opposite end 290. In this instance, it is the bottom side 522 that progressively diverges away at an angle from the topside 262, which remains constant and flat.

FIGS. 6A to 6E are non-limiting, exemplary, detailed illustrations of an embodiment of a retainer mechanism illustrated in FIGS. 1A to 1G, detailing an embodiment of a retainer member in accordance with an embodiment of the present invention. The retainer mechanism illustrated in FIGS. 6A to 6E includes similar corresponding or equivalent components, interconnections, functional, and or cooperative relationships as the retainer mechanisms 102, 203, 302, 402, and 502 that are shown in FIGS. 1A to 5G, and described above. Therefore, for the sake of brevity, clarity, convenience, and to avoid duplication, the general description of FIGS. 6A to 6E will not repeat every corresponding or equivalent component, interconnections, functional, and or cooperative relationships that has already been described above in relation to retainer mechanisms 102, 203, 302, 402, and 502 that are shown in FIGS. 1A to 5G.

Figure 6A:
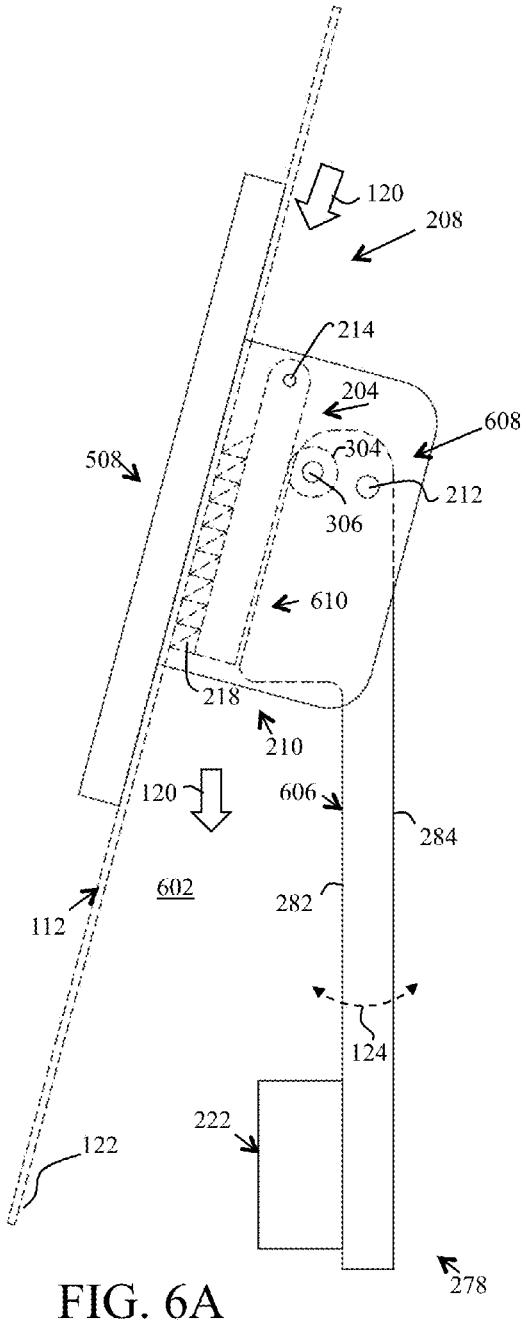
FIGS. 6A to 6E are non-limiting, exemplary, detailed illustrations of a retainer mechanism illustratively shown in FIGS. 1A to 1G, detailing another embodiment of a retainer member in accordance with one or more embodiments of the present invention.
Figure 6B:
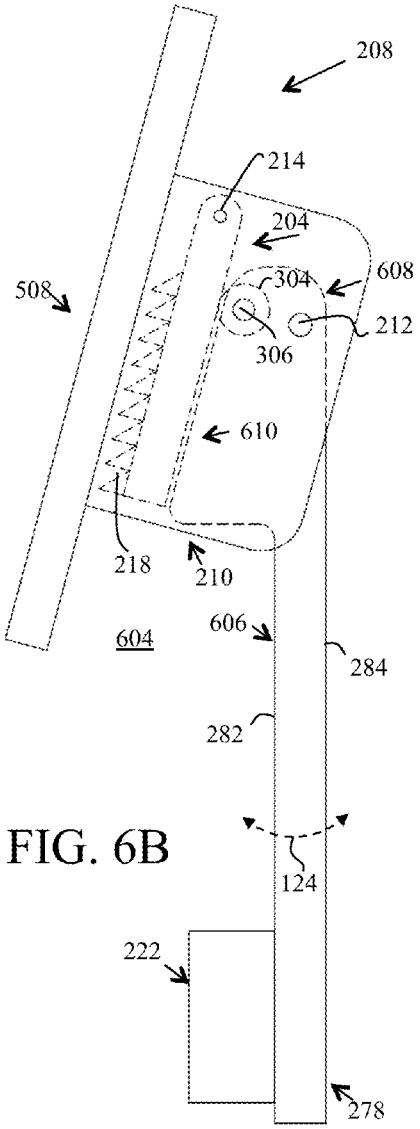
Figure 6C:
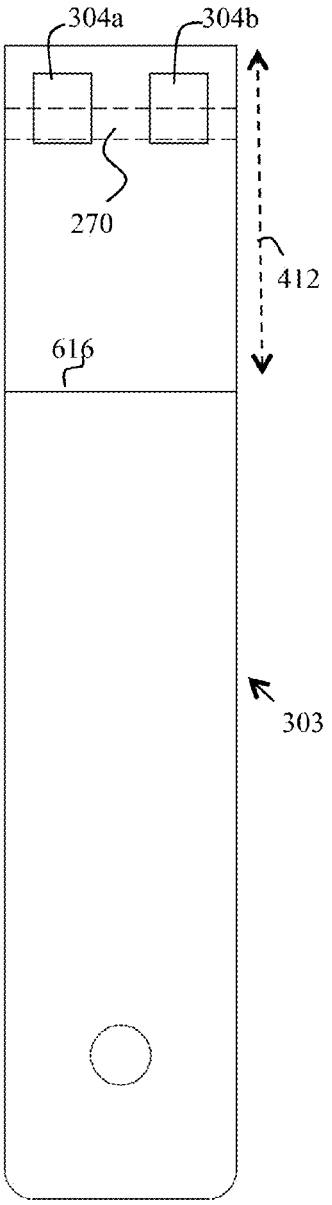
Figure 6D:
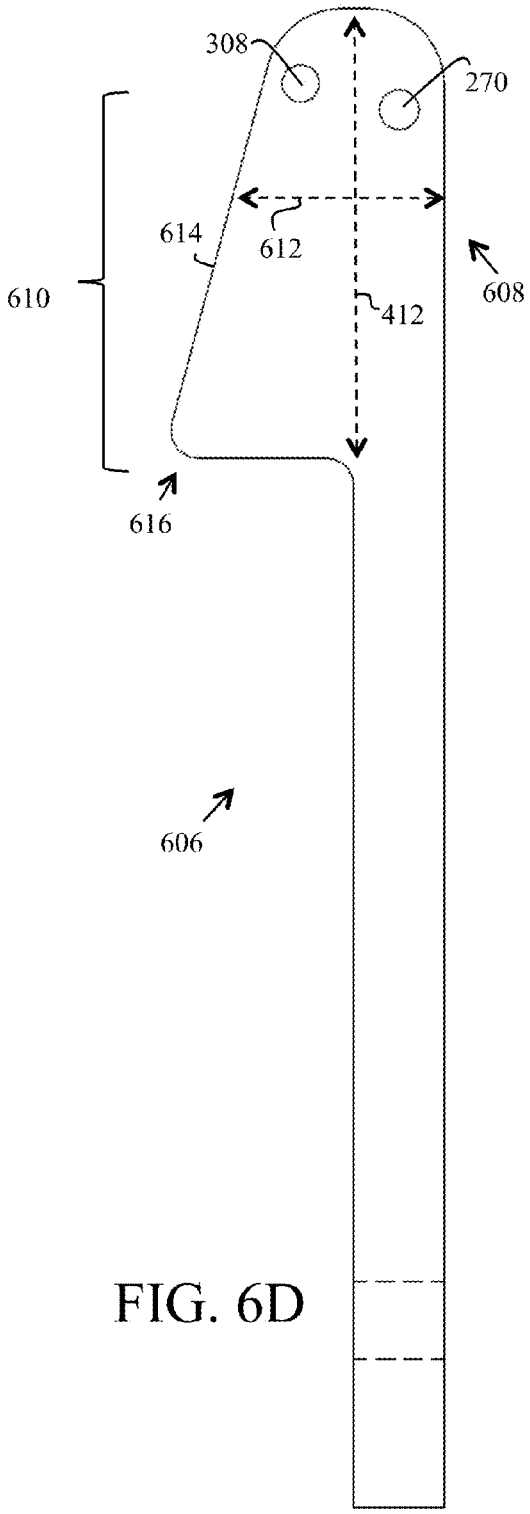
Figure 6E:
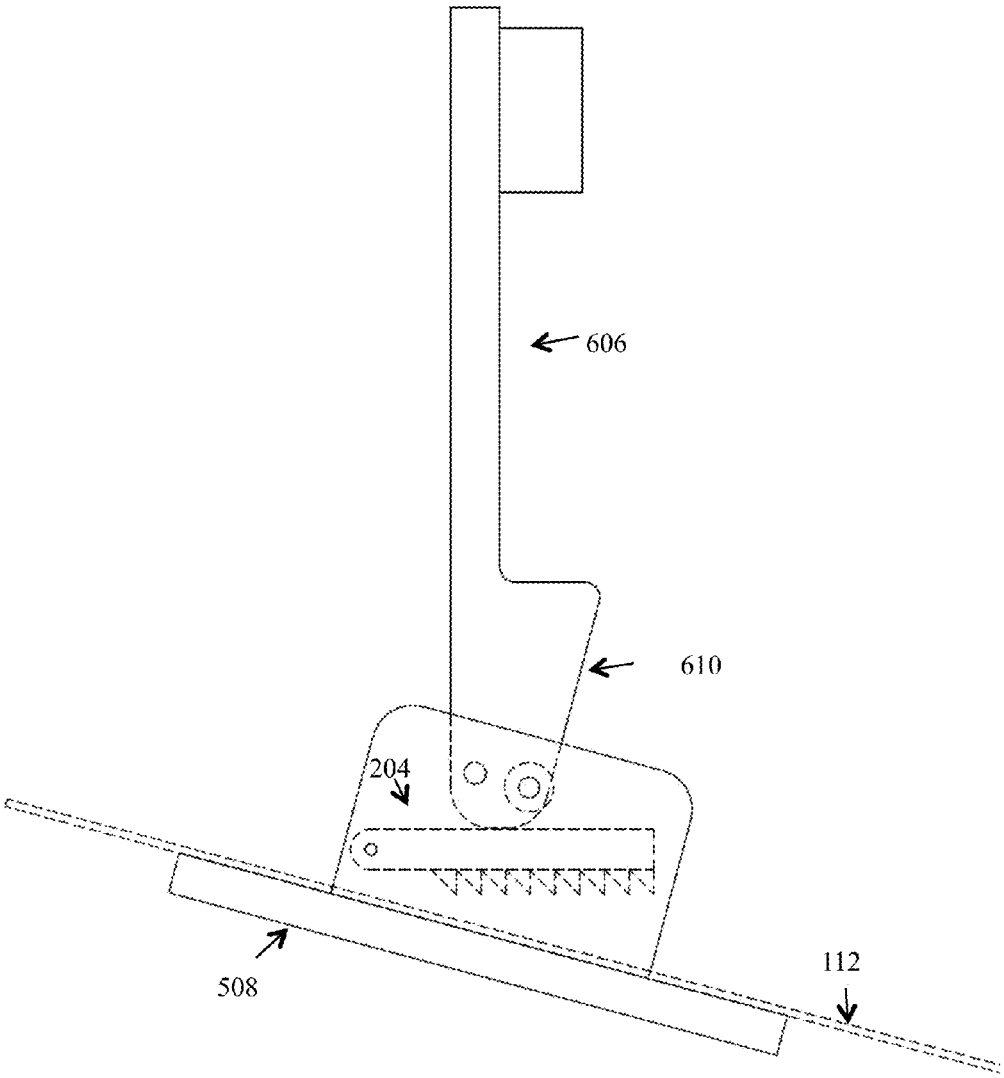
Figure 7A:
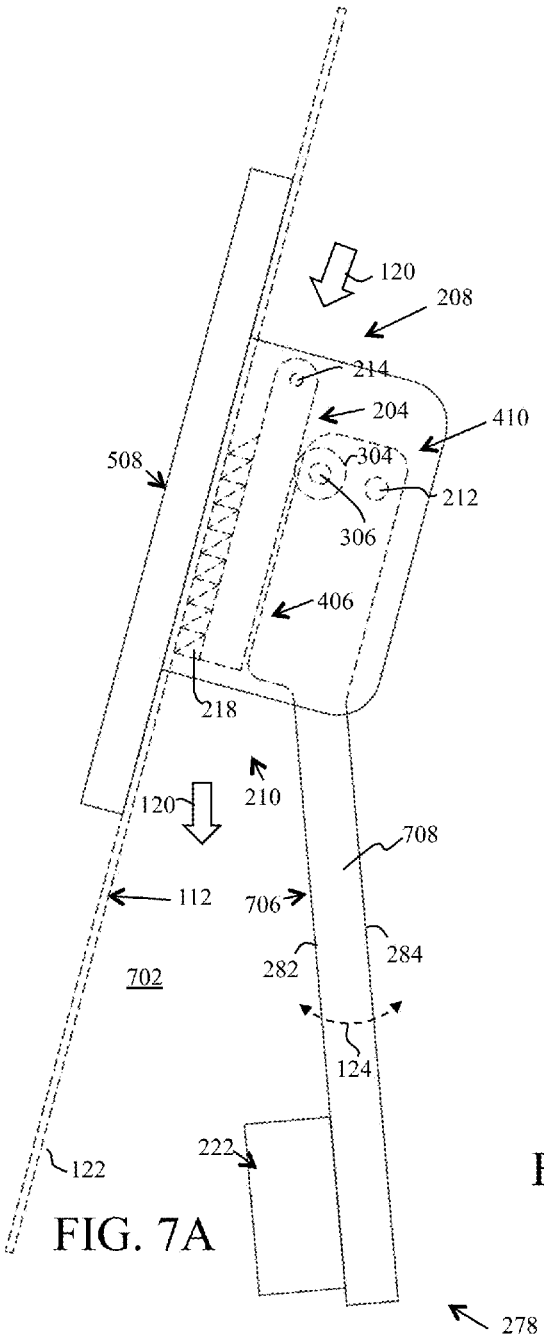
FIGS. 7A to 7E are non-limiting, exemplary, detailed illustrations of a retainer mechanism illustratively shown in FIGS. 1A to 1G, detailing another embodiment of a retainer member in accordance with one or more embodiments of the present invention.
Figure 7B:
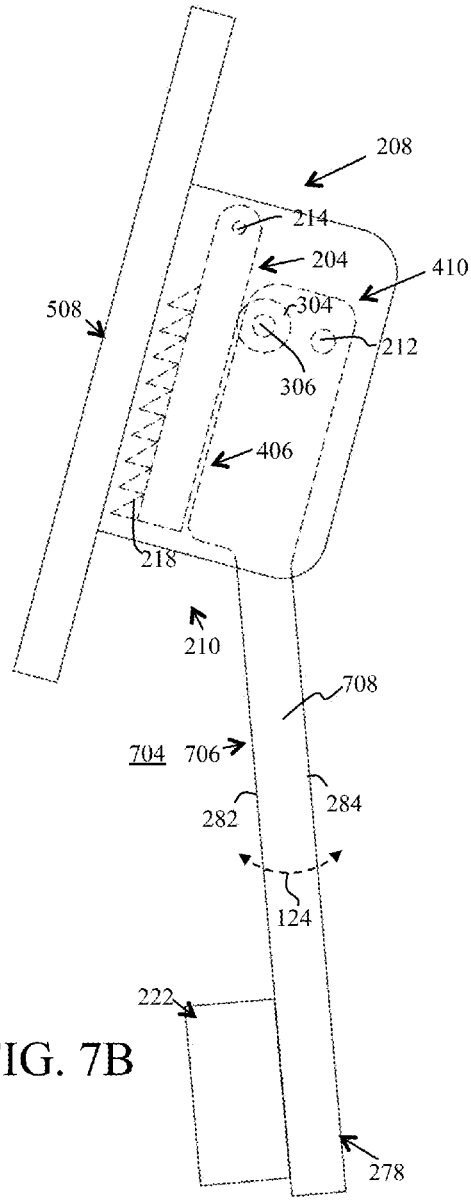
Figure 7C:
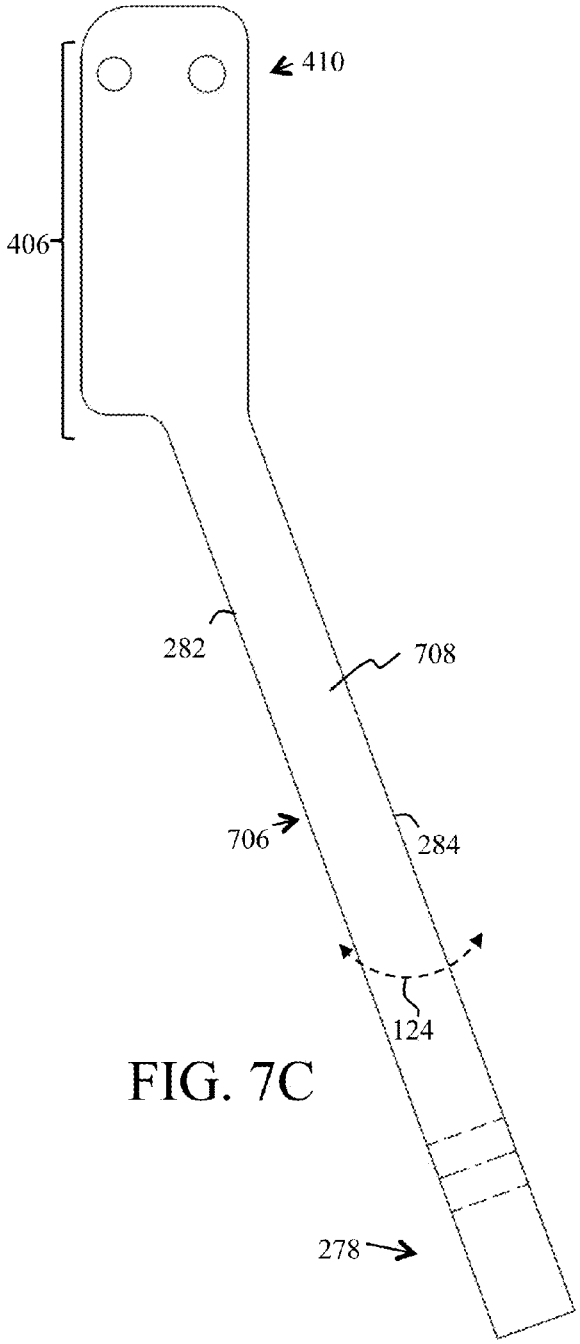
Figure 7D:
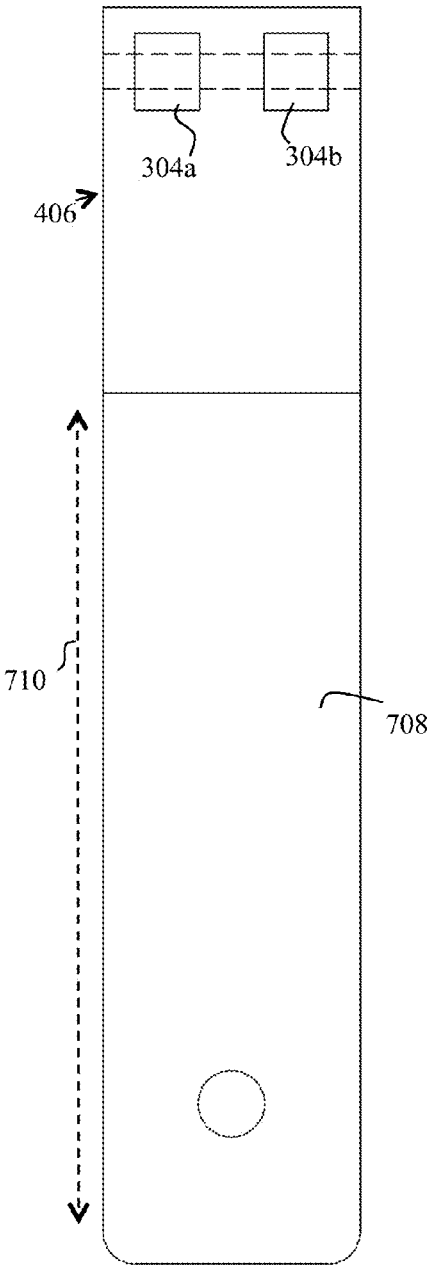
Figure 7E:
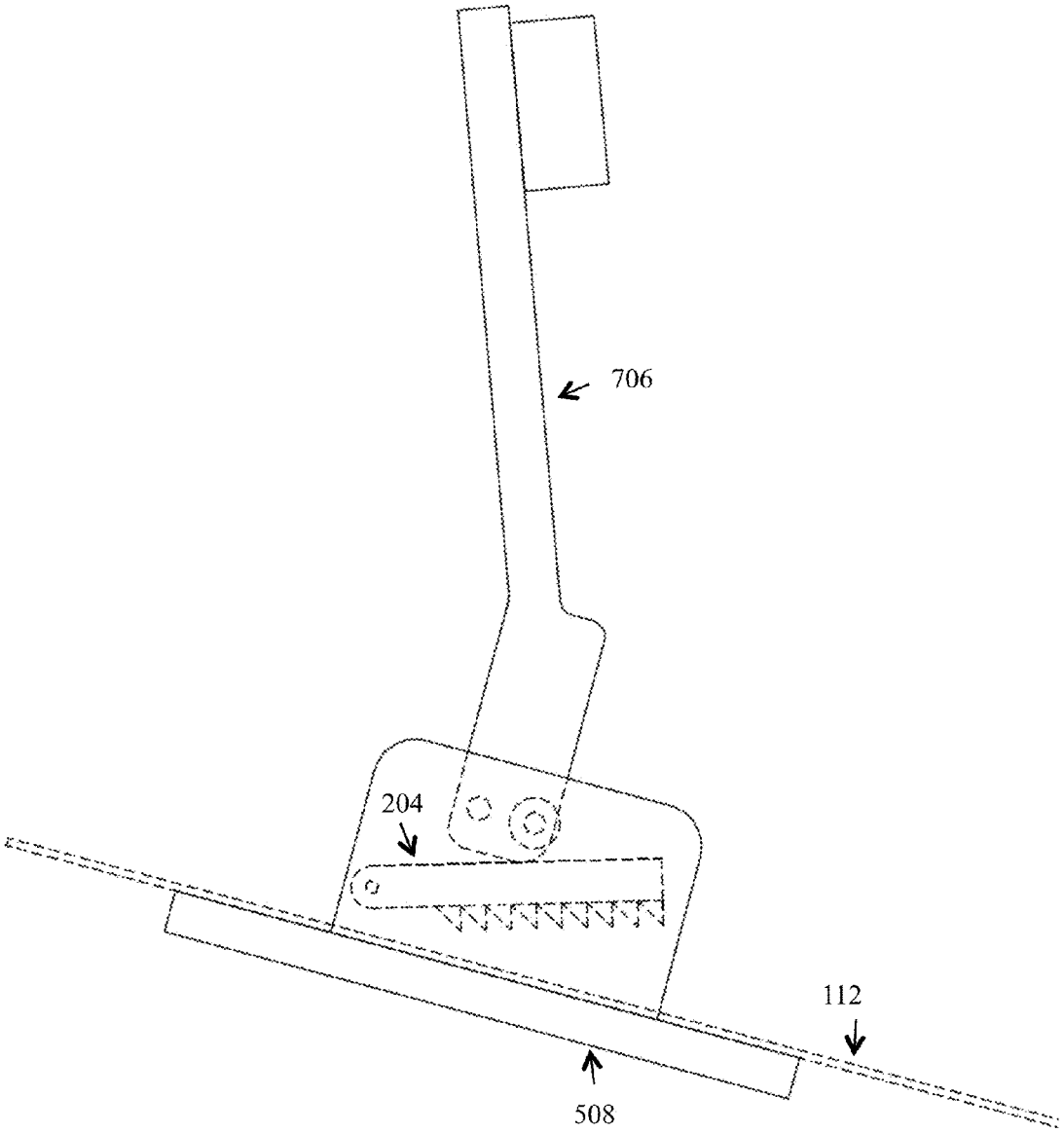

In this non-limiting, exemplary embodiment, a retainer mechanism 602 is disclosed that has a protruded hinged portion of an arm that is sloped, with the mounting support and the pivotal member substantially flat. As illustrated in FIGS. 6A to 6E, in this non-limiting, exemplary embodiment, a retainer member 604 includes a mounting support 508 with a base 510 and pivotal member 204 that are not angled but, instead, the hinged end (distal end) 608 of an arm 606 at the cam portion 610 is structured to be sloped at an angle. Accordingly, in the instance illustrated in FIGS. 6A to 6E instead of the mounting base 508 or the pivotal member 204 having a tilt to compensate for the tilting angle of the bin, it is the hinged end of the arm thickness may be varied instead to compensate for the bin tilt angle. That is, as best illustrated in FIG. 6D, the thickness 612 of the protruded portion 610 may be varied along its length portion 412 from its hinged end (the distal end 608) and ramp up at a desired angle to a higher thickness at the opposite end 616 of the protruded portion 610. In this instance, it is the bottom side 614 that progressively diverges away at an angle from the topside of the protruded portion 610, with the topside thereof remaining flat throughout the entire length 276 of the arm 606.

FIGS. 7A to 7E are non-limiting, exemplary, detailed illustrations of an embodiment of a retainer mechanism illustrated in FIGS. 1A to 1G, detailing an embodiment of a retainer member in accordance with an embodiment of the present invention. The retainer mechanism illustrated in FIGS. 7A to 7E includes similar corresponding or equivalent components, interconnections, functional, and or cooperative relationships as the retainer mechanisms 102, 203, 302, 402, 502, and 602 that are shown in FIGS. 1A to 6E, and described above. Therefore, for the sake of brevity, clarity, convenience, and to avoid duplication, the general description of FIGS. 7A to 7E will not repeat every corresponding or equivalent component, interconnections, functional, and or cooperative relationships that has already been described above in relation to retainer mechanisms 102, 203, 302, 402, 502, and 602 that are shown in FIGS. 1A to 6E.

In this non-limiting, exemplary embodiment, a retainer mechanism 702 is disclosed that has an arm 706 that is angled and with a mounting support 508, a pivotal member 204, and a hinged protruded portion 406 of the arm 706 substantially flat. As illustrated in FIGS. 7A to 7E, in this non-limiting, exemplary embodiment, a retainer member 704 includes a mounting support 508 and pivotal member 204 that are not slanted but, instead, the extended section 708 of the arm 706 is angled to compensate for the tilt angle of the bin. Accordingly, in the instance illustrated in FIGS. 7A to 7E instead of the mounting support 508, the pivotal member 204, or even the protruded hinged end 410 of the arm 706 having a tilt to compensate for the tilting angle of the bin, the extended section 706 of the arm itself is angled instead to compensate for the bin tilt angle.

Figures 1, 8A:
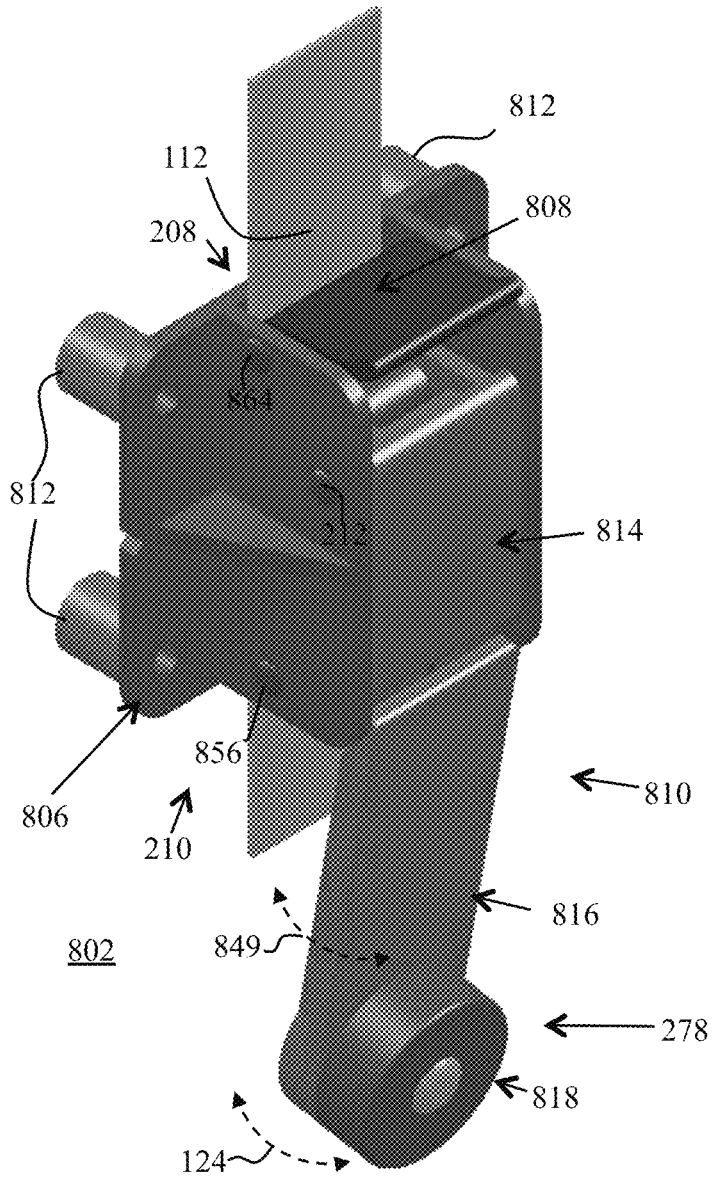
Figures 2, 8A:
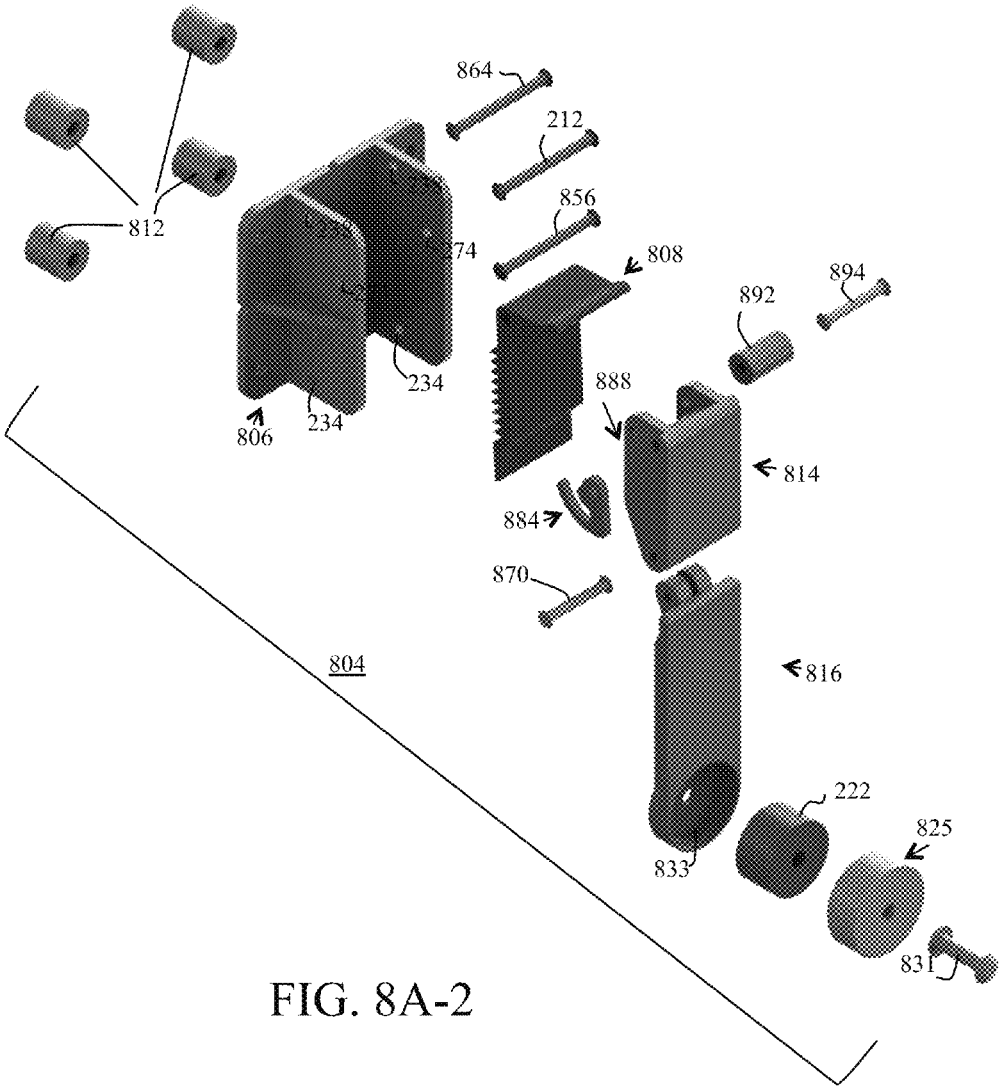
Figures 3, 8B:
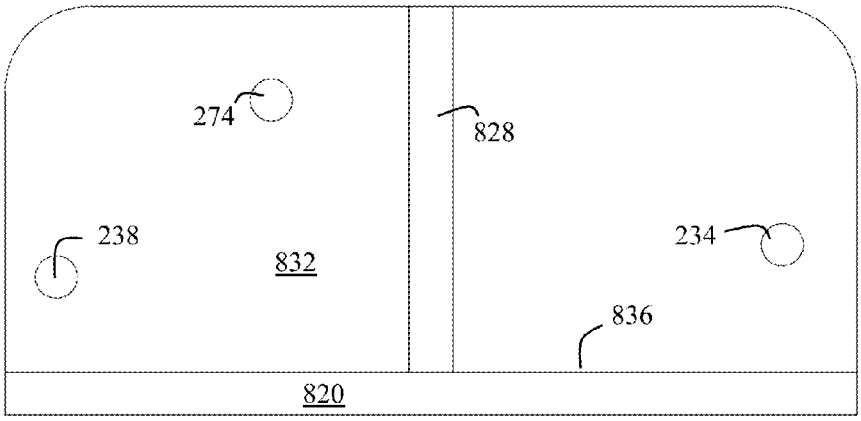
Figures 4, 8B:
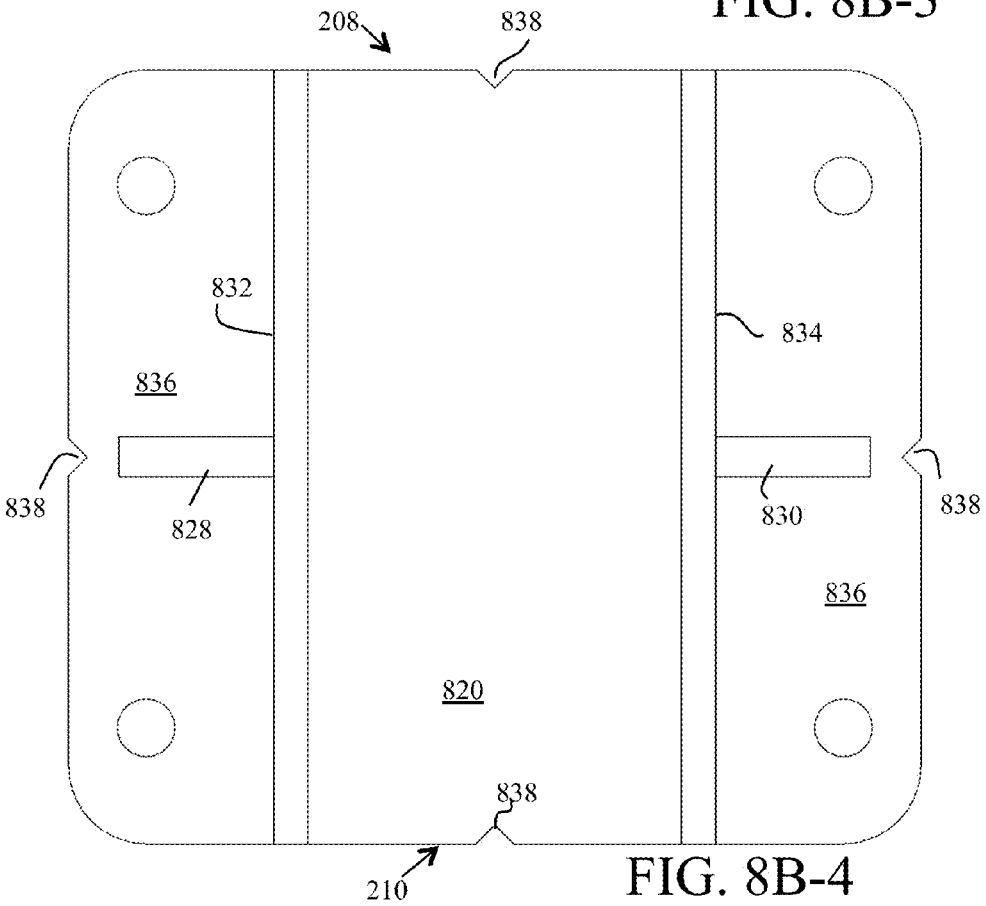
Figures 1, 9A:
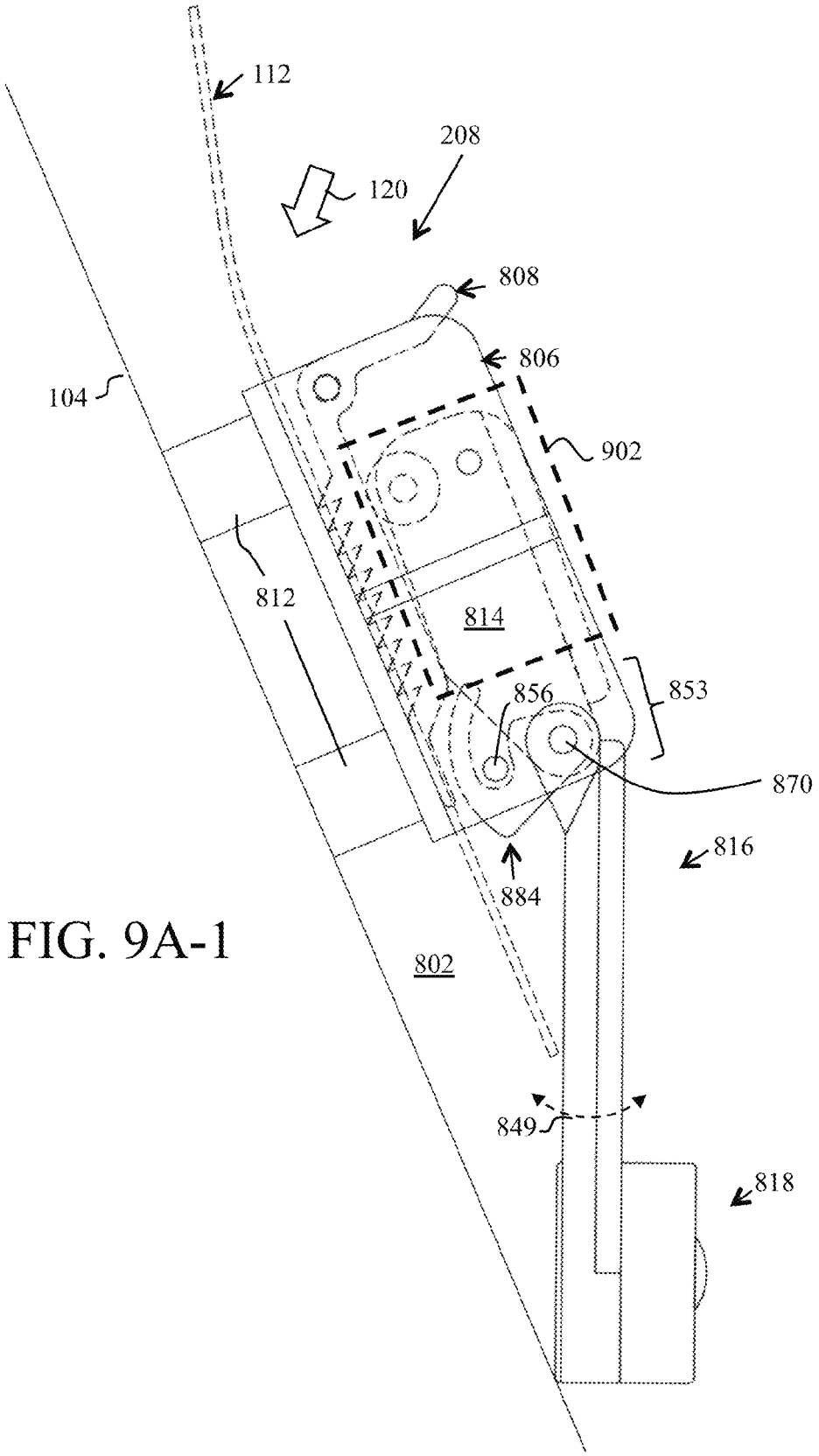
Figures 2, 9A:
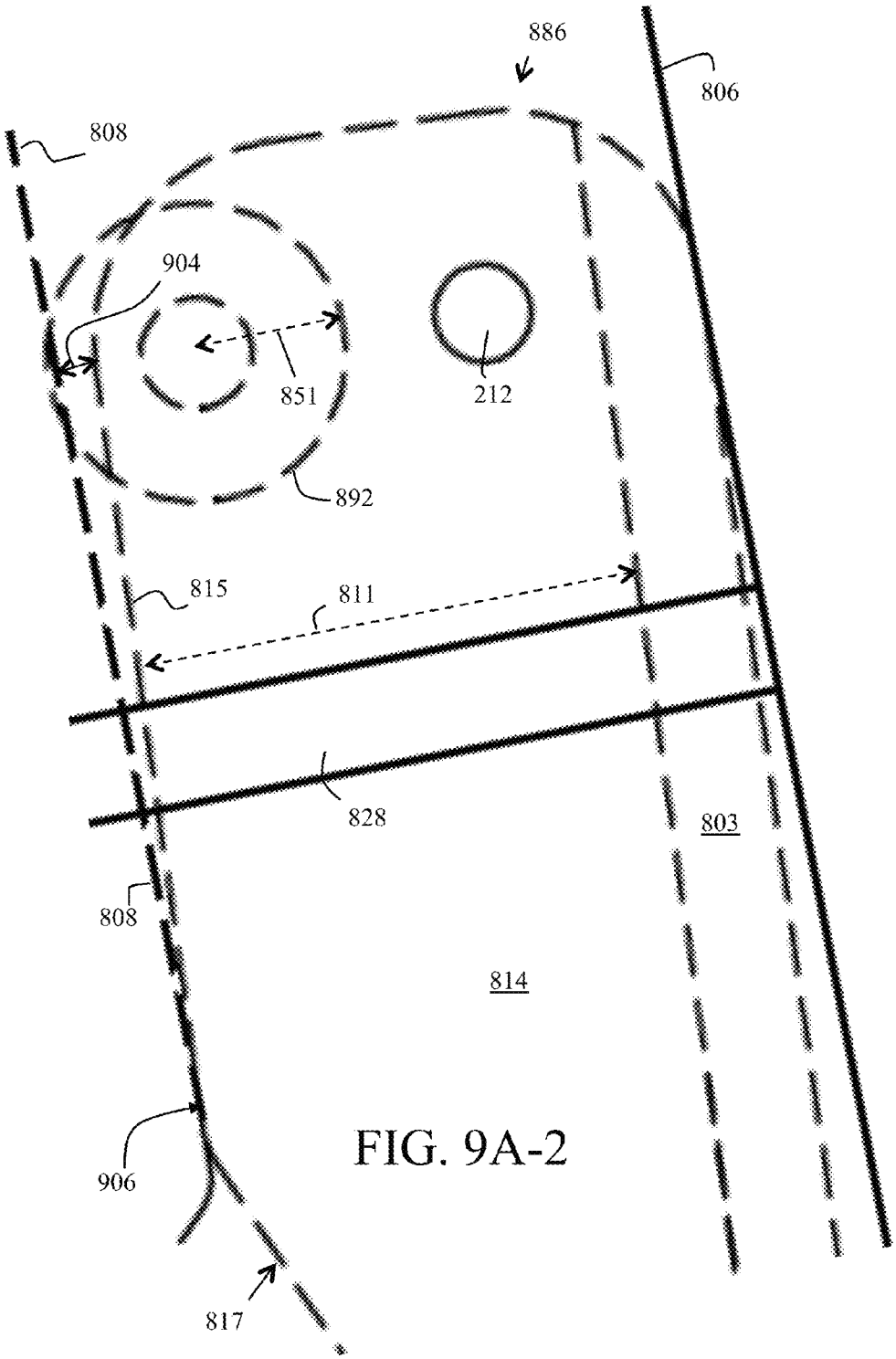
Figures 1, 9B:
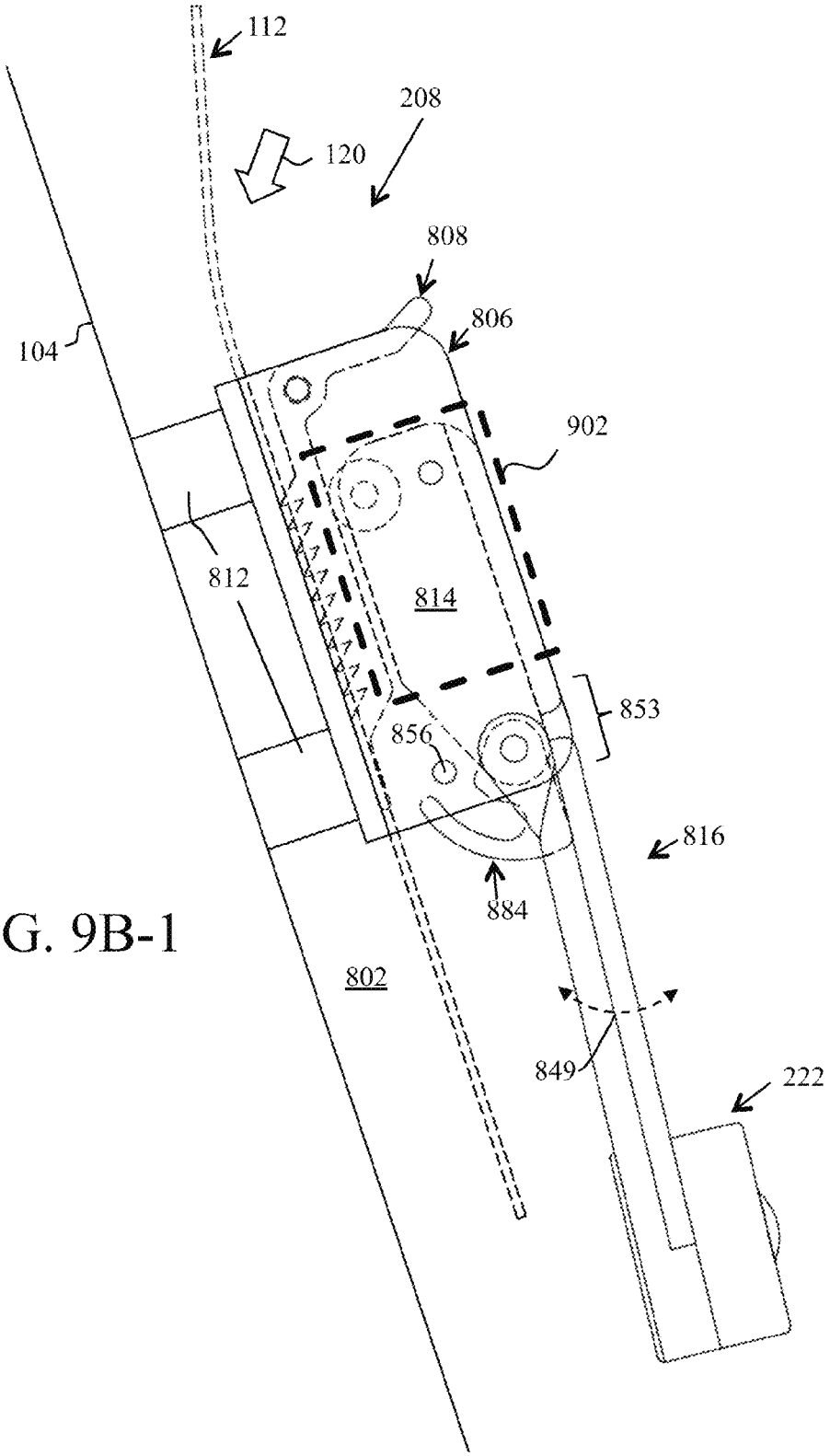
Figures 2, 9B:
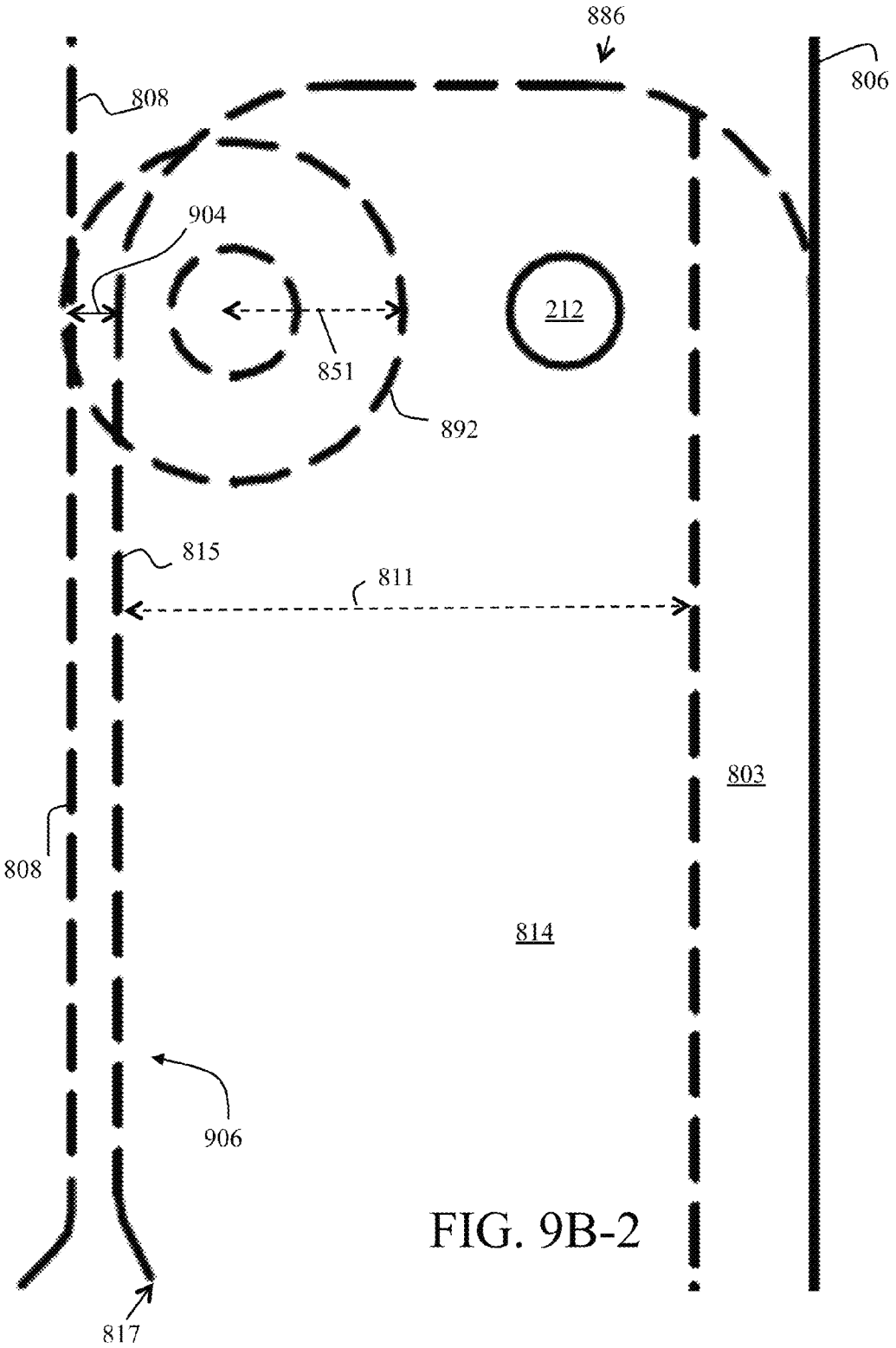
Figure 9C:
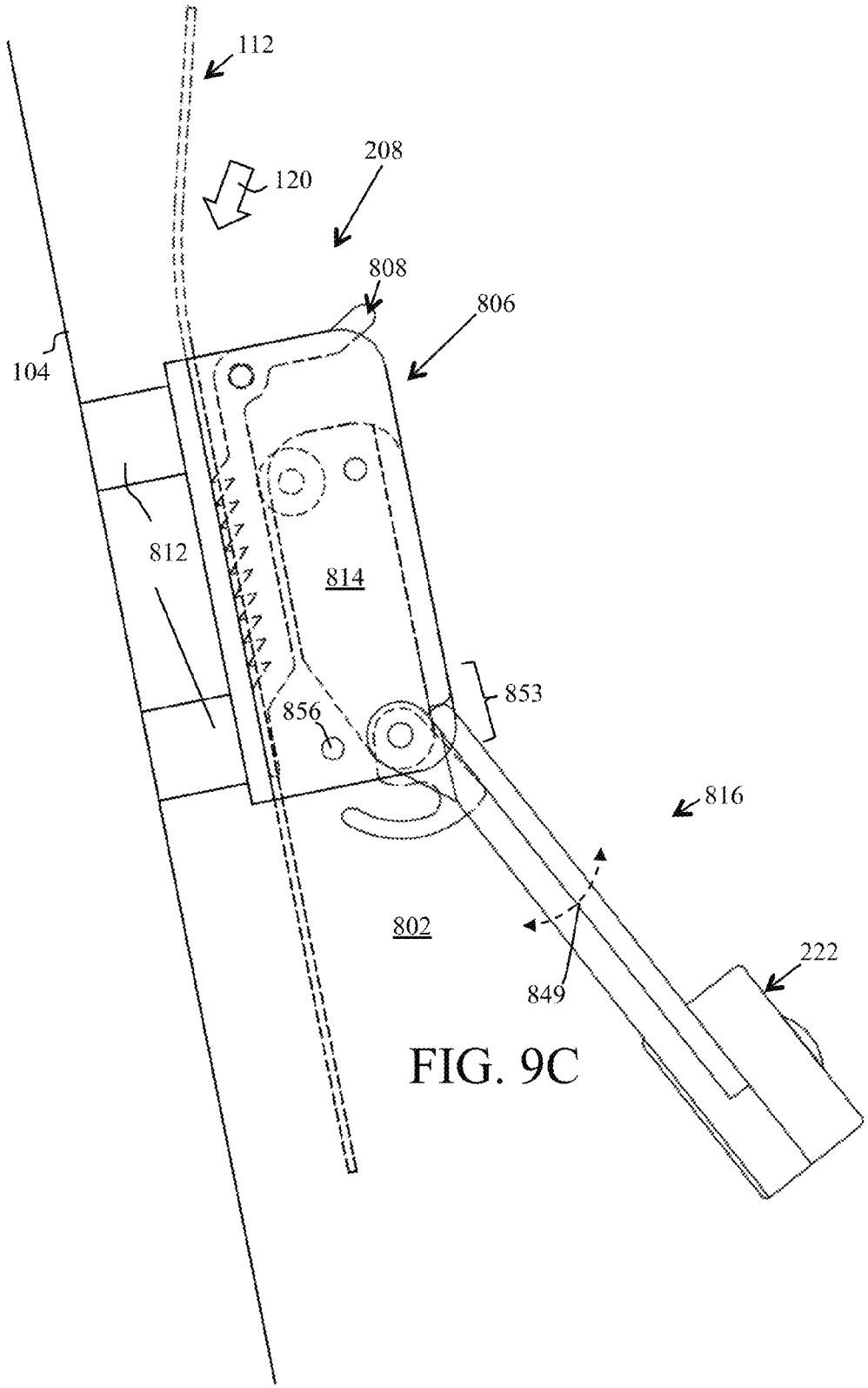
Figure 9D:
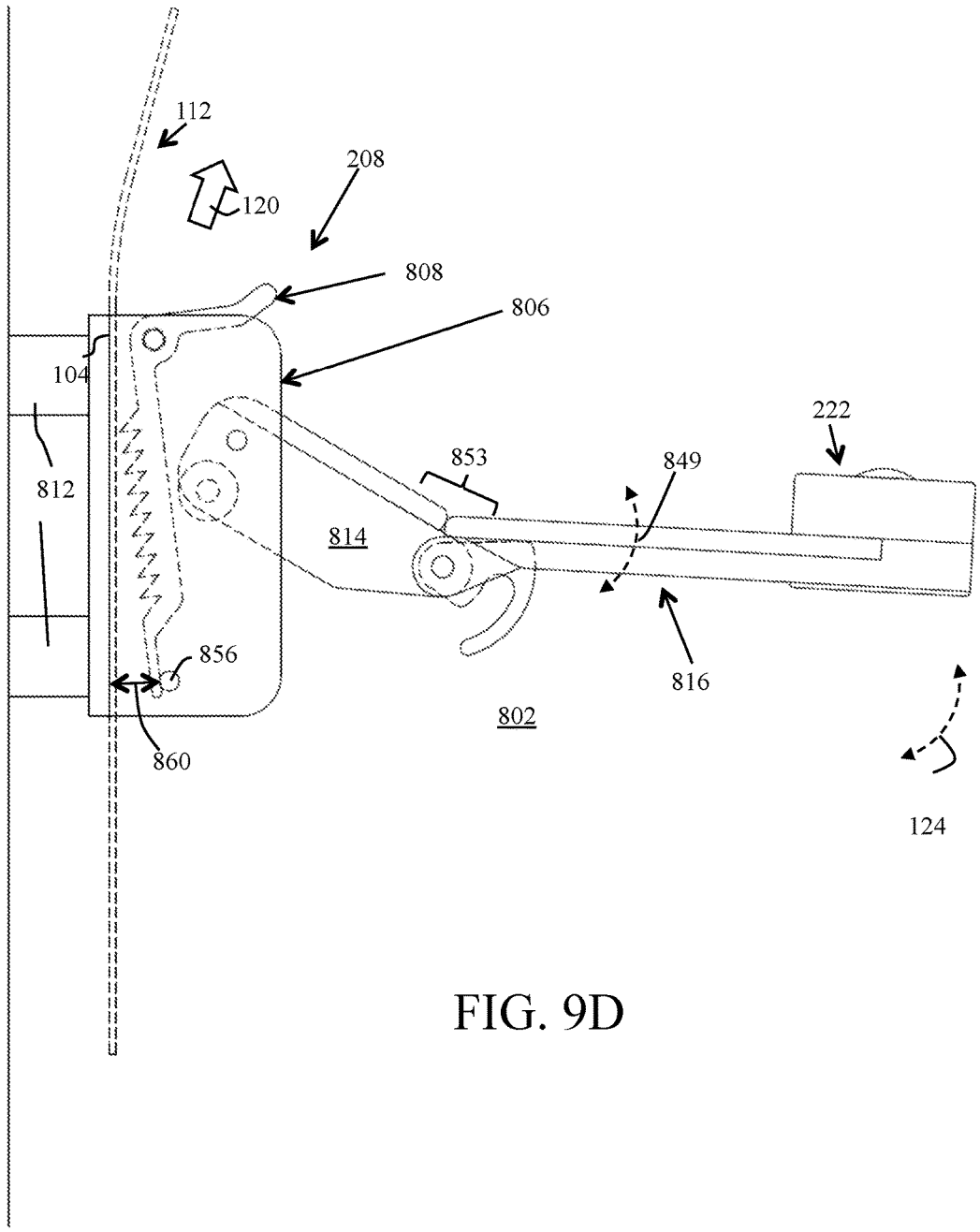

FIGS. 8A-1 to 9D are non-limiting, exemplary, detailed illustrations of an embodiment of a retainer mechanism illustrated in FIGS. 1A to 1G, detailing an embodiment of a retainer member in accordance with an embodiment of the present invention. The retainer mechanism illustrated in FIGS. 8A-1 to 9D includes similar corresponding or equivalent components, interconnections, functional, and or cooperative relationships as the retainer mechanisms 102, 203, 302, 402, 502, 602, and 702 that are shown in FIGS. 1A to 7E, and described above. Therefore, for the sake of brevity, clarity, convenience, and to avoid duplication, the general description of FIGS. 8A-1 to 9D will not repeat every corresponding or equivalent component, interconnections, functional, and or cooperative relationships that has already been described above in relation to retainer mechanisms 102, 203, 302, 402, 502, 602, and 702 that are shown in FIGS. 1A to 7E.

In this non-limiting, exemplary embodiment, a retainer mechanism 802 is disclosed where no component is at an angle for appropriately leveling an arm 810 but instead, spacers 812 are used for leveling. That is, none of the components of a retainer member 804 is sloped at an angle to commensurately offset an angular incline of a slanted side of the bin 104 with which the retainer member 804 is coupled to maintain the arm 810 at a hold (or engagement) position, but spacers 812 are used instead to provide the same functionality.

As illustrated in detail in FIGS. 8A to 9D, the retainer mechanism 802 is also comprised of the retainer member 804 through which is inserted the adjusting member 112 at the insertion side 208 and extracted or pulled out from the retainer member 804 at the extraction side 210. The retainer member 804 is comprised of a mounting support 806 and a pivotal member 808 that is associated with mounting support 806. Further included is an arm assembly 810 comprised of a first arm piece 814 and a second arm piece 816, with the first arm piece 814 and second arm piece 816 movably associated with one another and the mounting support 806.

FIG. 8A-2 is a non-limiting, exemplary illustration of an exploded view of the retainer member 804 shown in FIG. 8A-1 in accordance with one or more embodiments, and FIGS. 8B-1 to 8F-3 are non-limiting, exemplary illustration of various views of one or more components shown in FIG. 8A-2.

Figures 1, 8B:
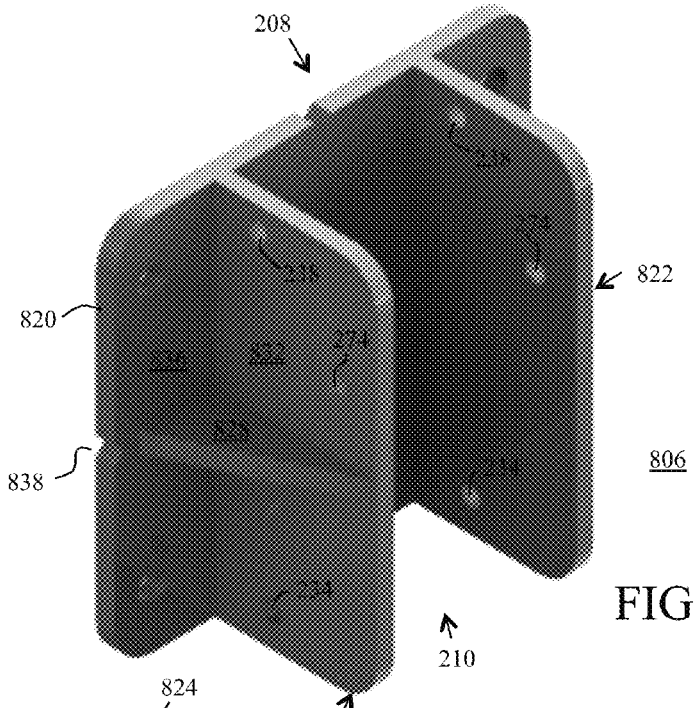
Figures 2, 8B:
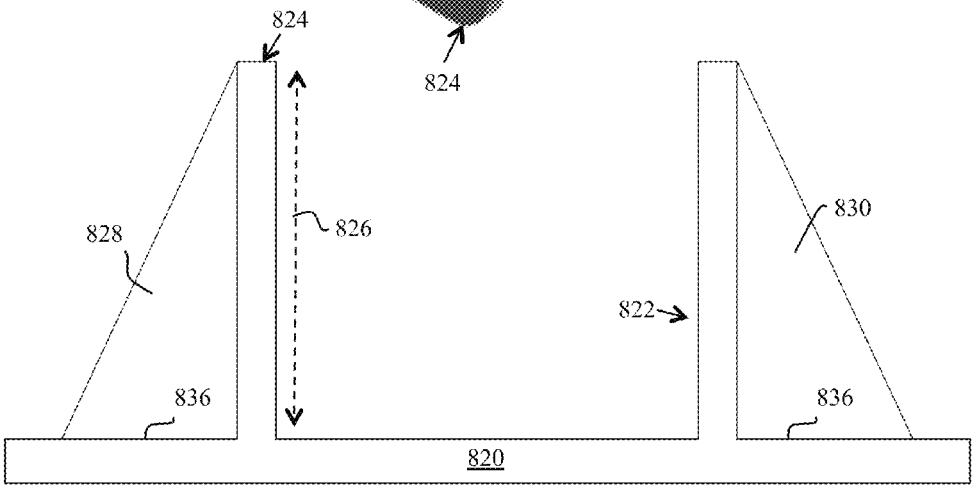

As best illustrated in FIGS. 8B-1 to 8B-4, the mounting support 806 includes a generally flat base 820 and a set of lateral supports 822 and 824 protruding in parallel from the base 820. The set of lateral supports 822 and 824 and base 820 form a confined space for securing the adjusting member 112 therein, defining the insertion side 208 of the retainer member 802 and the extraction side 210 of the retainer member 802. The lateral supports 822 and 824 have a generally lower profile defined by a shorter height 826 (compared with previously disclosed embodiments) that is also generally linearly uniform and symmetrical. In general, shorter and a more straight or linear height supports are easier to manufacture as there are less angles to be concerned when developing the mold thereof. The mounting support 806 is further comprised of stiffeners 828 and 830 associated with the lateral supports 824 and 822 that are connected between an exterior surface 832 and 834 of the lateral supports 824 and 822, and an upper surface 836 of the base 820. The upper surface 836 of the base 820 may include uneven surface (combination of protrusions and or indentations) for added friction. The base 820 of the mounting support 806 further includes a set of alignment notches 838, one per side, for facilitating alignment and mounting of the retainer member 804 in relation to the bin 104.

Figures 1, 8C:
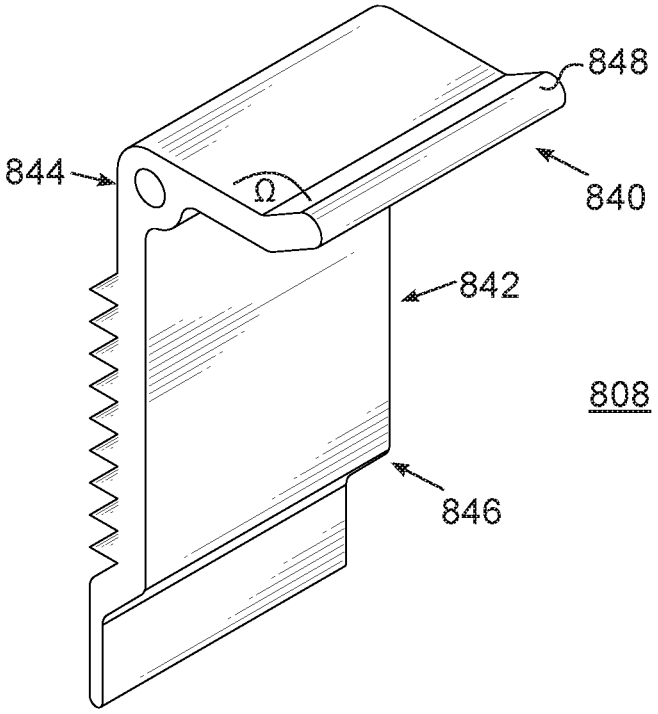
Figures 2, 8C:
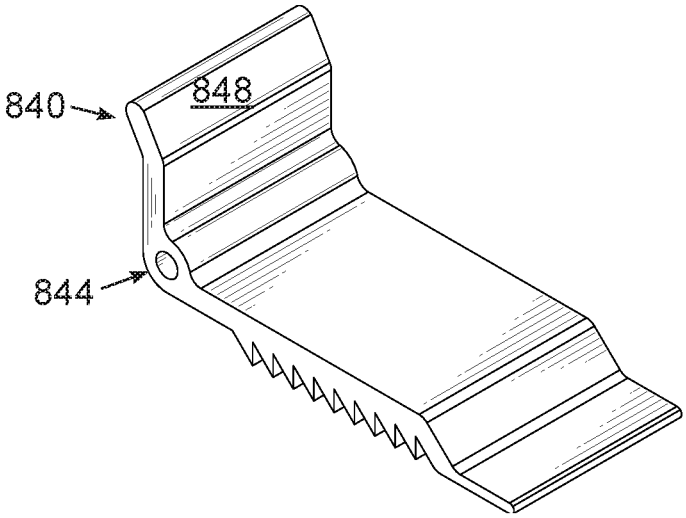
Figures 3, 8C:
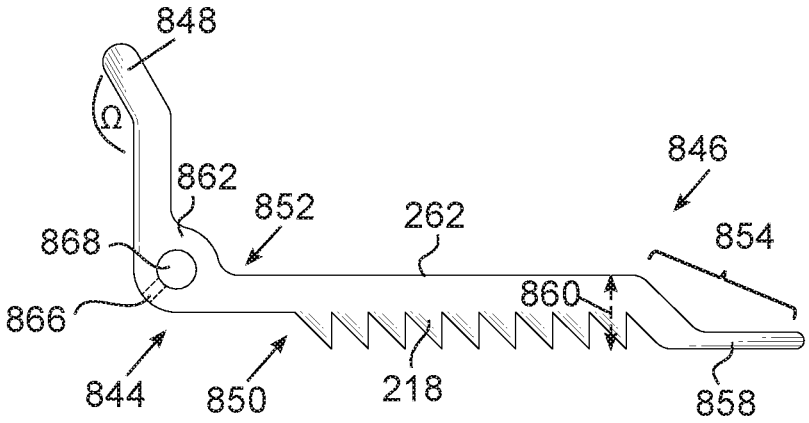
Figures 2, 8D:
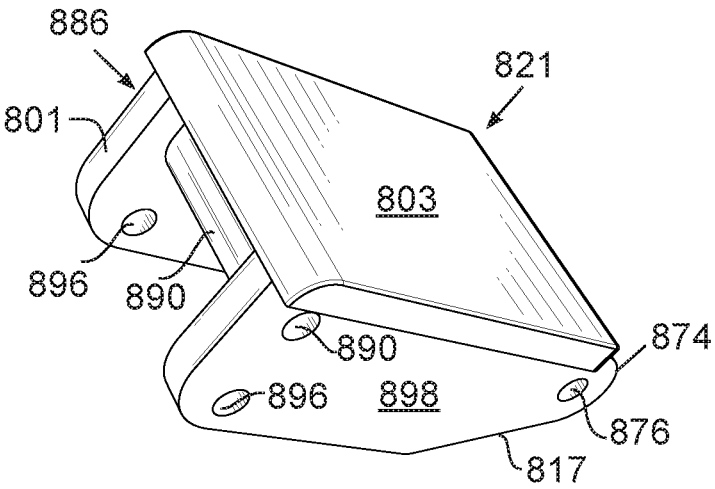
Figures 1, 8D:
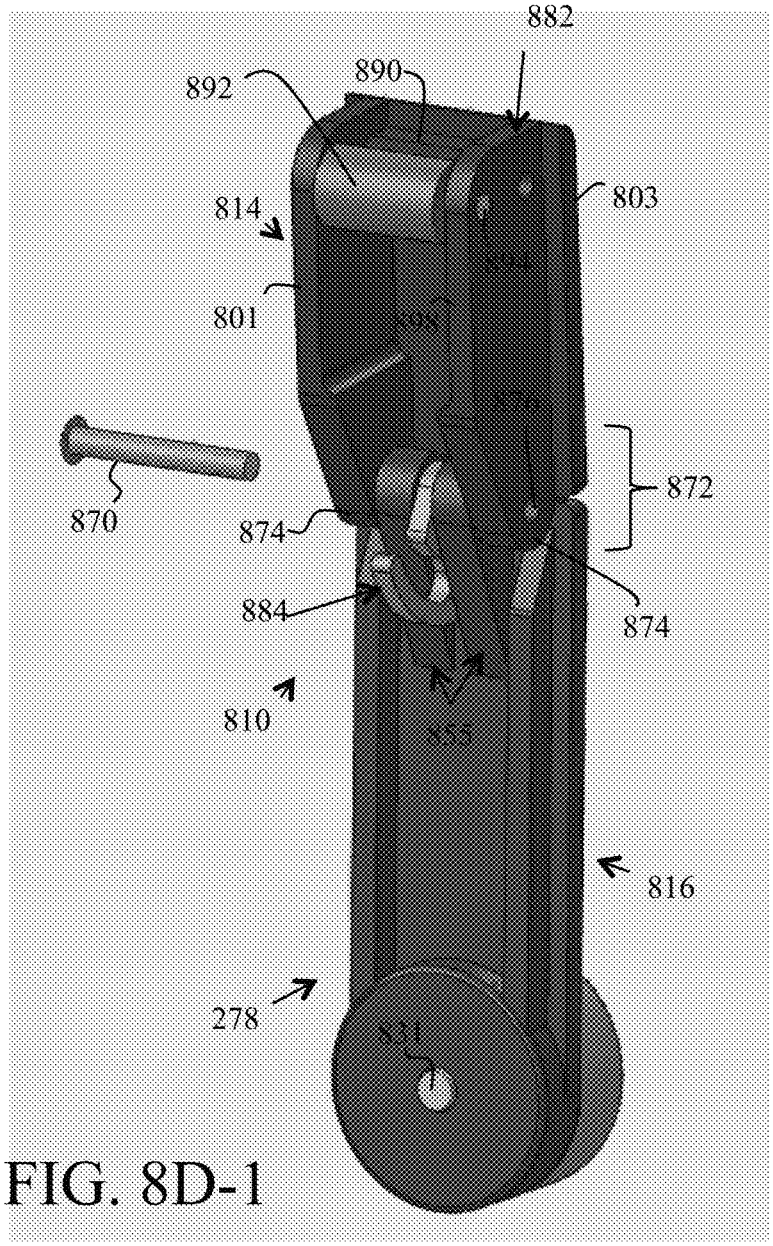
Figures 3, 8D:
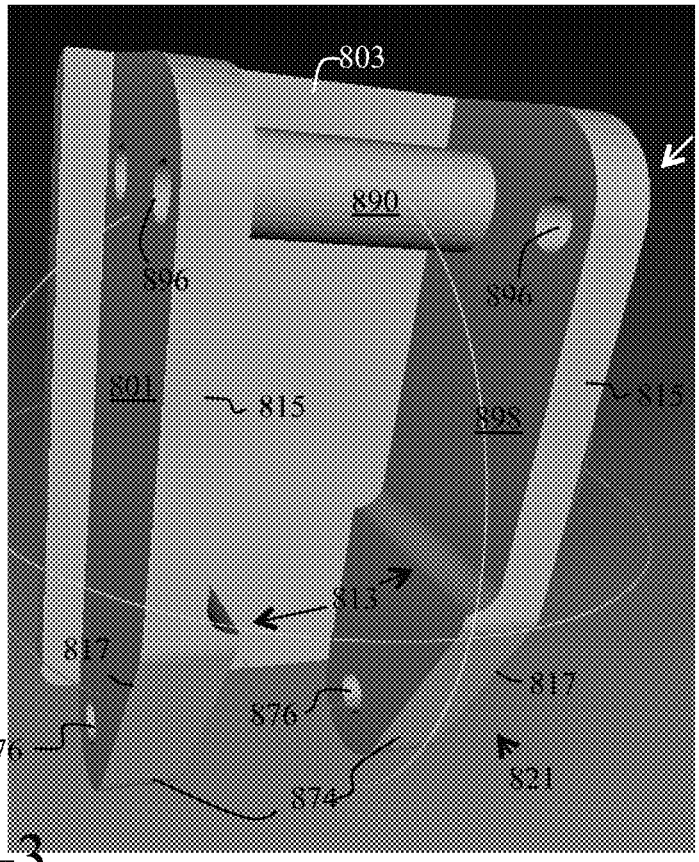
Figures 4, 8D:
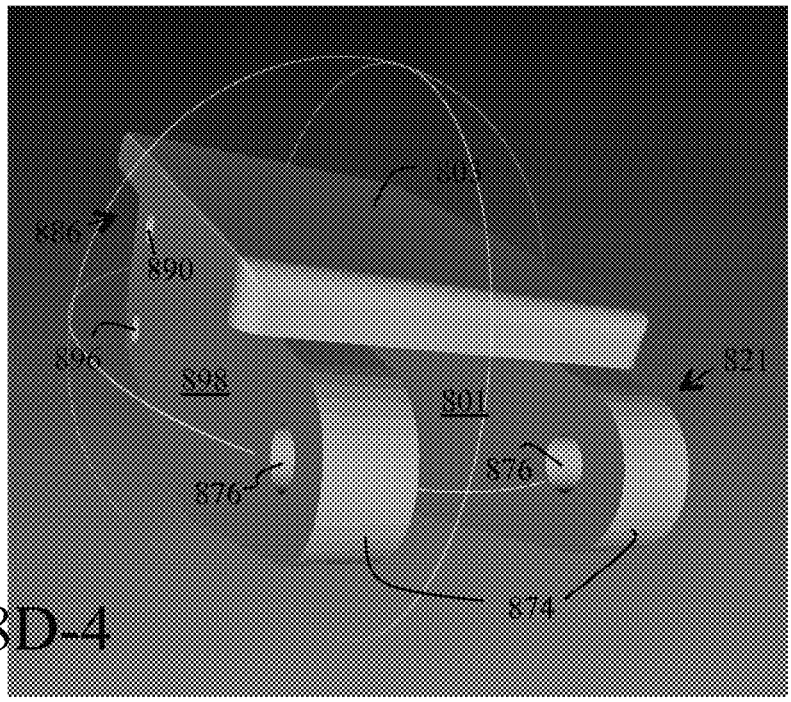
Figures 5, 8D:
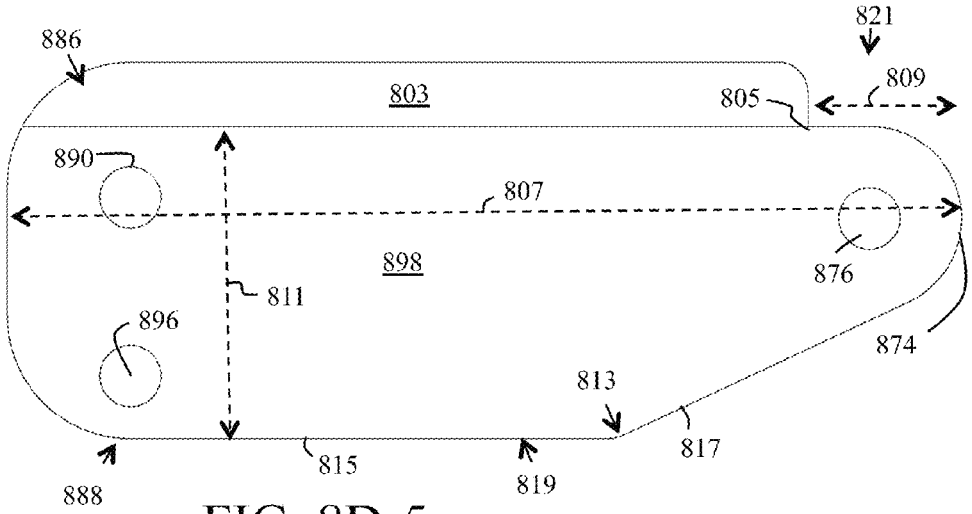
Figures 6, 8D:
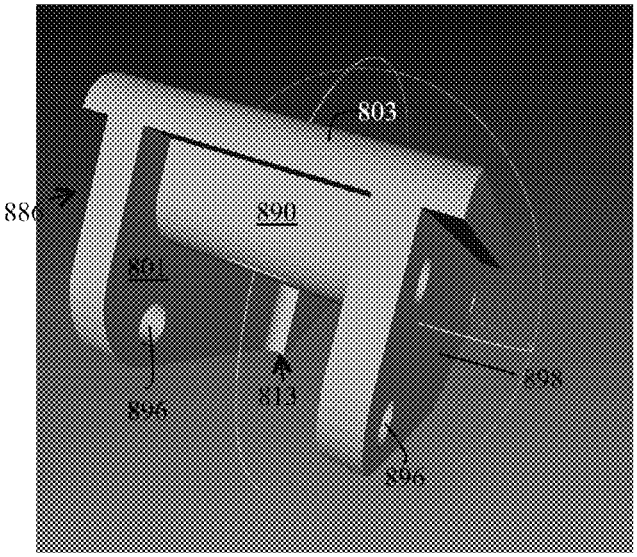
Figures 7, 8D:
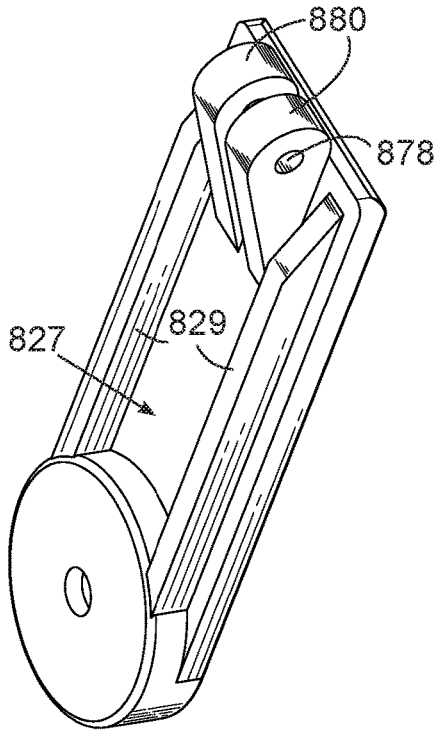
Figures 8, 8D:
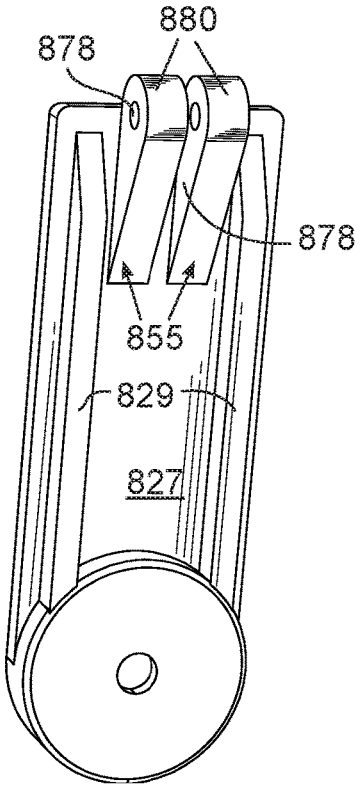
Figures 8, 8D, 9:
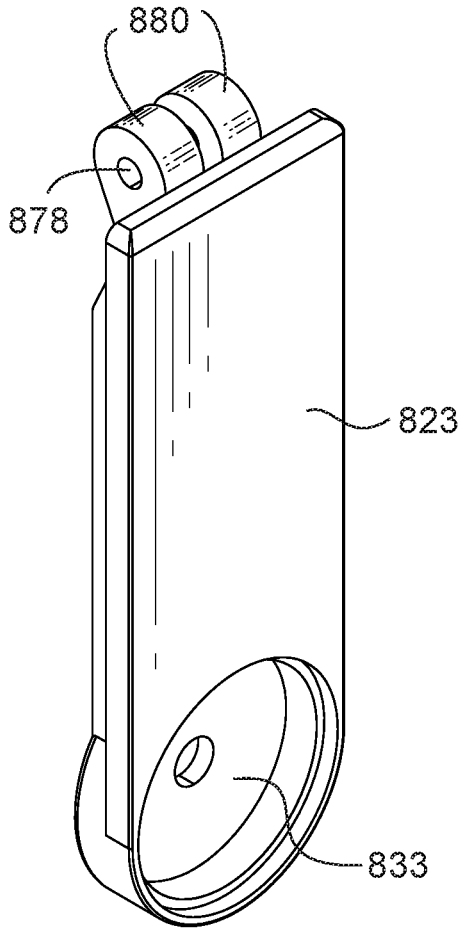
Figures 8, 8D, 9, 10:
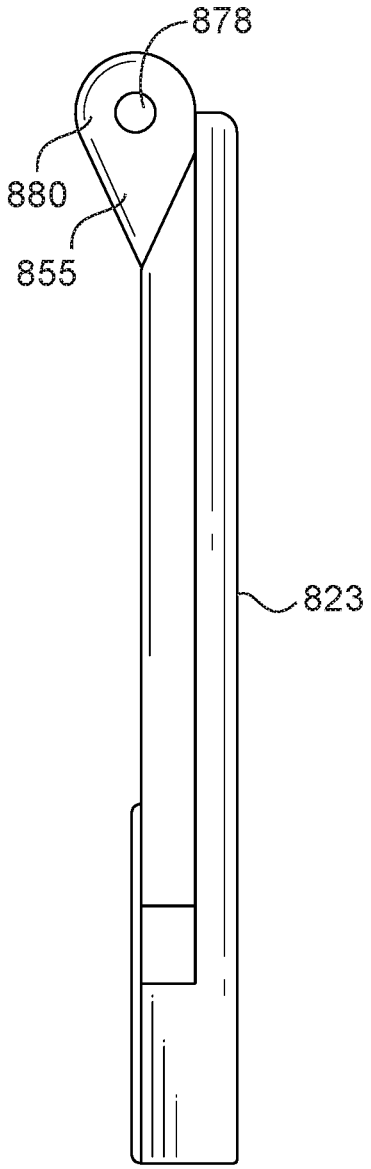

As best illustrated in FIGS. 8C-1 to 8C-3, the pivotal member 808 has a single, integral piece construction with a generally an "L" shaped cross-sectional profile that is comprised of a first section 840, a second section 842, and a hinge section 844. The first section 840 functions as a lever that facilitates in pivoting the pivotal member 808 at the hinge section 844 thereby raising the free distal end 846 of the second section 842 (at extraction side 210) of the pivotal member 808 for unimpeded (or unobstructed) maneuvering path for the adjusting member 112 passed through the retainer member 804 (best illustrated in FIG. 9D). The first section 840 also functions to define a single insertion "port" through which the adjusting member 112 may be inserted.

As further illustrated in FIGS. 8C-1 to 8C-3, the first section 840 further includes an optional angled extension or portion 848 (angled at Ω compared to the remaining first section 840) to ergonomically facilitate handling of the pivotal member 808 by a thumb of a user. The angled-portion 848 extends passed above the lateral supports 822 and 824 of the mounting support 806 and is a thumb rest when in use by the user to pivot the pivotal member 808.

The second section 842 of the pivotal member 808 is comprised of a free distal end 846 and a distal hinge end 852. A bottom surface 850 of the pivotal member 808 includes serrations 218 to improve grip with the associated adjusting member 112. The top surface 262 is generally smooth to reduce friction in relation to a cam action of the arm 810 (detailed below). As further illustrated, the free distal end 846 of the second section 842 of the pivotal member 808 includes a step-down sloped extension 854, which, in combination with the keeper 856 is used to guide the adjusting member 112 to pass out of the extraction side 210 underneath a keeper 856 of a latch mechanism rather than above it (best shown in FIG. 9D). The sloped, step-down extension 854 in combination with the keeper 856 also prevents the pivotal member 808 from over pivoting, which may block the insertion side 208 (best shown in FIG. 9D). In other words, the sloped, step-down extension 854 of the pivotal member 808 is to maintain the insertion side 208 open (by preventing over pivoting of the pivotal member 808) and also, prevents the adjusting member 112 from being maneuvered over the keeper 856 by the sloped, step-down extension 854 contacting the keeper 856 (best shown in FIG. 9D). The reason the sloped, step-down extension 854 is stepped down is to have maximum travel distance (pivoting) from the base 820 when pivoting, so to have the maximum clearance opening for the ease of maneuvering the adjusting member 112. Stated otherwise, the lower portion 858 of the step-down extension 854 enables the maximum travel distance (by a height 860, also shown in FIG. 9D) for the extraction side 210 of the pivotal member 808 when pivoting, which provides the maximum clearance (from the base 820 to the bottom of the surface of 858) for ease of insertion of the adjusting member 112. Without the step-down lower portion 854, the keeper 856 must be positioned at a higher level on the lateral supports 832 and 834, however that would mean an increase in the size of the serration heights to enable engagement with and a grip onto the adjusting member 112.

As indicated above, pivotal member 808 also includes a hinge section 844 that pivotally hinges the pivotal member 808 with the mounting support 806. The pivot action for the pivotal member 808 is required because the second section 842 thereof rests on the upper surface 836 of the base 820 of the mounting support 806, which would block the pathway at the extraction side 210 of the mounting support 806 for the adjusting member 112 to pass through and be extracted out. The hinge section 844 is comprised of hinge barrel 862 that receives a hinge pin 864 at the hinge orifice 868 for enabling pivoting the pivotal member 808. Distal ends of the hinge pin 864 are coupled with the holes 238 of the lateral supports 822 and 824 of the mouthing support 806. The hinge barrel 862 creates added bulk or mass to provide added strength. Alternatively, if strength is secondary and quick assembly is more important, a groove 866 that leads to the orifice 868 rather than a hinge barrel (fully closed-off) may be provided, enabling the groove 866 to snap onto the hinge pin 864 by a simply push onto the pivotal member 808. With the "snap-on" alternative, the mounting support 806 would include an already assembled hinge pin 864 where a user may simple press snap the transversal oriented groove 866 onto the hinge pin 864, which will be pressed into the orifice 868. In fact, with the embodiments illustrated throughout the disclosure, most hinge connections may be alternatively replaced by a snap-on or press-connect type hinge systems as described.

As indicated above and best illustrated in FIGS. 8D-1 to 8D-10, the retainer member 804 includes an arm assembly 810 comprised of a first arm piece 814 and a second arm piece 816, with the arm assembly 810 moveably associated with the mounting support 806 along the indicated reciprocating path 124. Further the first arm piece 814 and the second arm piece 816 are independently, movably associated with the mounting support 806 and with each other. More specifically, the arm 810 is coupled with the mounting support 806 through hinge pin 212, with the first arm piece 814 coupled with the second arm piece 816 by an arm piece hinge pin 870. The arm piece hinge 872 includes a set of barrels 874 with holes 876 on one of the first or second arm piece 814 or 816 aligned with a set of apertures 878 of a set of knuckles 880 on another of the second or first arm piece 816 or 814, with an arm-piece hinge pin 870 inserted through the barrel holes 876 and knuckle apertures 878. The knuckles 880 have a form with the illustrated added bulk portion 855 (FIG. 8D-8) as part of a body of the arm piece to improve structural integrity by the addition of mass, which improves strength.

By having the arm 810 that is comprised of two pieces 814 and 816 that are movable in relation to one another and the mounting support 806, the arm 810 and the arm hinge mechanism 882 is prevented from being damaged. For example, if the bin 104 falls forward to the ground where the free distal end 278 of the second arm piece 816 contacts the ground, the two piece arm would absorb the impact of the fall by allowing the second arm piece 816 the flexibility to bend at the arm piece hinge 872 to thereby protect the arm hinge mechanism 882 that connects the arm 810 to the mounting support 806 from disconnection or dislodging. By having the arm 810 flexible, the arm absorbs the impact of the external force (which is the fall of the bin with its weight) pressing against the ground by flexing at the arm piece hinge 872. A further advantage for a two-piece arm is that the second arm piece 816 would move in relation to the first arm piece 814 if a passerby comes into contact with the arm 810. That is, the second arm piece 816 would bend and not snag onto the clothing of a passerby.

As further illustrated, the first arm piece 814 is comprised of lateral walls 898 and 801 that extend from a bottom surface of a top 803. The top 803 extends from the rear or "insertion side" 886 of the first arm piece 814 to a point 805 (towards the "extraction side") or front 821 short of the full axial length 807 of the lateral walls 898 and 801 by an amount 809. A height 811 of the lateral walls 898 and 801 remain generally constant from the rear 886 of the first arm piece 814 to a point 813, progressively (or gradually) decreasing thereafter towards the front 821. That is, a second section 817 of lower periphery edge 819 of the lateral walls 898 and 801 is at an angle in relation to the first section 815. The slanting or sloping angle of the second section 817 of the lateral walls 898 and 801 of the first arm piece 814 accommodate the keeper 856 (best shown in FIG. 9A-1). The thickness of the lateral walls 898 and 801 also generally remain constant from the rear 886 of the first arm piece 814 to a point 813, but are thicker and have more mass thereafter for added structural integrity in terms of strength.

The first section 815 of the lower periphery of edge 819 of the lateral walls 898 and 801 constitute protruded portions 888 in this embodiment, which includes a hinge mechanism to pivotally couple the first arm piece 814 with the mounting support 806. The protruded portions 888 have a greater span (axial lengths), covering over a substantial part of the top surface 262 of the pivotal member 808. The enlarged axial lengths of each of the protruded portions 888 of each lateral wall 898 and 801, which continues to provide a cam action, eliminate the need for the alignment mechanism 216 as discussed in detail above. The hinge mechanism includes the hinge pin 212 that passes through the hinge barrel 890 and is coupled to the second pair of holes 274 on the lateral supports 822 and 824 of the mounting-support 806. The hinge barrel 890 has the added benefit of preventing the hinge pin 212 from bending under the stress of rivet-gun during assembly and manufacture (assuming that the hinge pin 212 is a rivet). The hinge barrel 890 supports the body of the rivet longitudinally and hence, prevents it from bending when being assembled using a rivet-gun. The hinge barrel 890 creates a constraint around the hinge pin 212, which prevents the middle of the hinge pin 212 from buckling during compression pressure from a rivet gun during assembly and manufacture. As indicated above however, the hinge barrel 890 may be replaced by a groove so that the first arm piece 814 is snapped on an already assembled hinge pin 212.

In this embodiment, the protruded portions 888 accommodate a rotating member 892 such as a wheel (or bearing, etc.). The rotating member 892 is coupled within the protruded portion 888 of the first arm piece 814 through an axle 894 that is inserted in an axle hole 896 at the protruded portion 888 (at the rear 886). Accordingly, the one or more rotating member 892 facilitate to further reduce friction between the protruded portion 888 and the top surface 262 of the pivotal member 808 by their rolling action, which would also enable the use of lesser weight 222 (on the second arm piece 816), reducing the required torque needed to move the arm 810 to the release position. In other words, the use of the rotating member 892 facilitates improved cam action of the protruded portion 888 while reducing friction. The rotating member 892 rotates on the top surface 262 of the pivotal member 808 to a release or disengagement position. As with previous embodiments, the rotating member 892 may be a single piece or comprised of two or more pieces.

Figures 1, 8E:
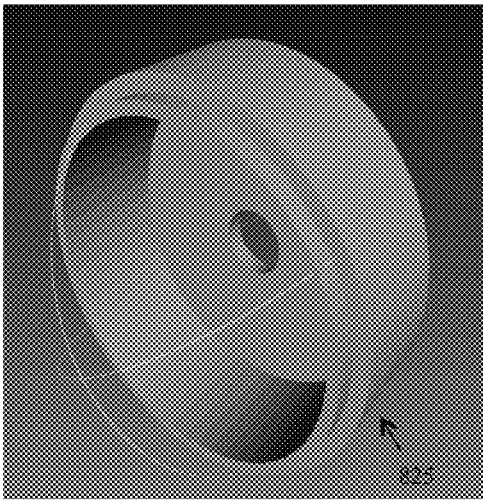
Figures 2, 8E:
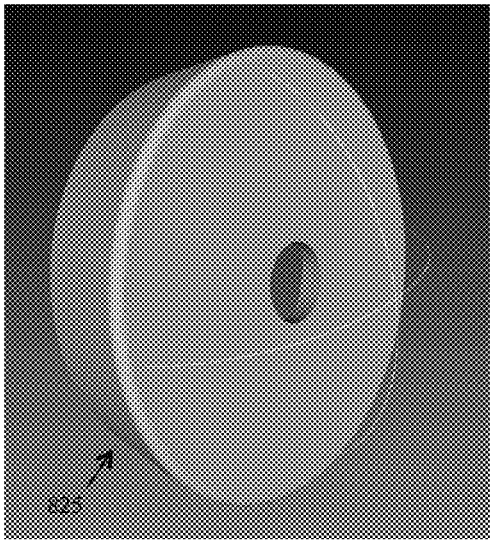
Figures 3, 8E:
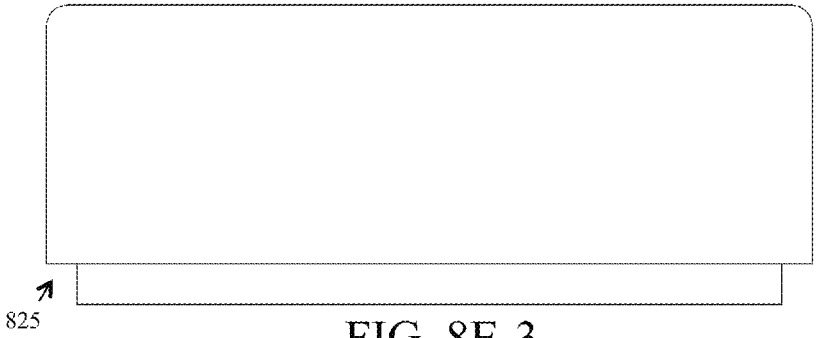

The second arm piece 816 has the arm piece hinge 872 at one end and a weight 222 at a distal end 278 at a top surface 823 of the second arm piece 816. The position of the weight 222 is switched to the top surface 823 in this embodiment to allow for maximum amount of travel or swing for the second arm piece 816 along a secondary reciprocating path 849. As further illustrated, the distal end 278 of the second arm piece 816 includes a cavity 833 that houses the weight 222, with a commensurately configured cap 825 (FIGS. 8E-1 to 8E-3) covering the weight 222 for esthetics and protection against the environment. The weight 222 and the cap 825 combination 818 are secured to the second arm piece 816 of the arm 810 through a fastener 831. A bottom surface 827 of the second arm piece 816 includes an optional set of stiffeners 829 that improve the structural integrity of the second arm piece 816 in terms of overall strength.

Figures 1, 8F:
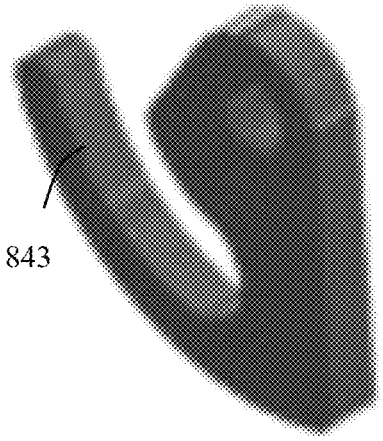
Figures 2, 8F:
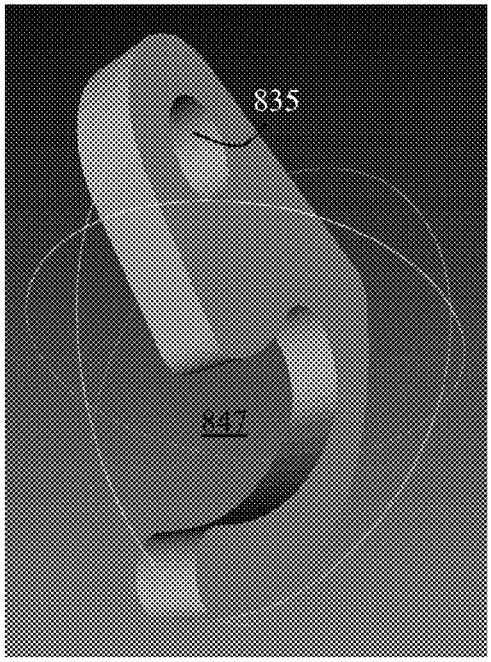
Figures 3, 8F:
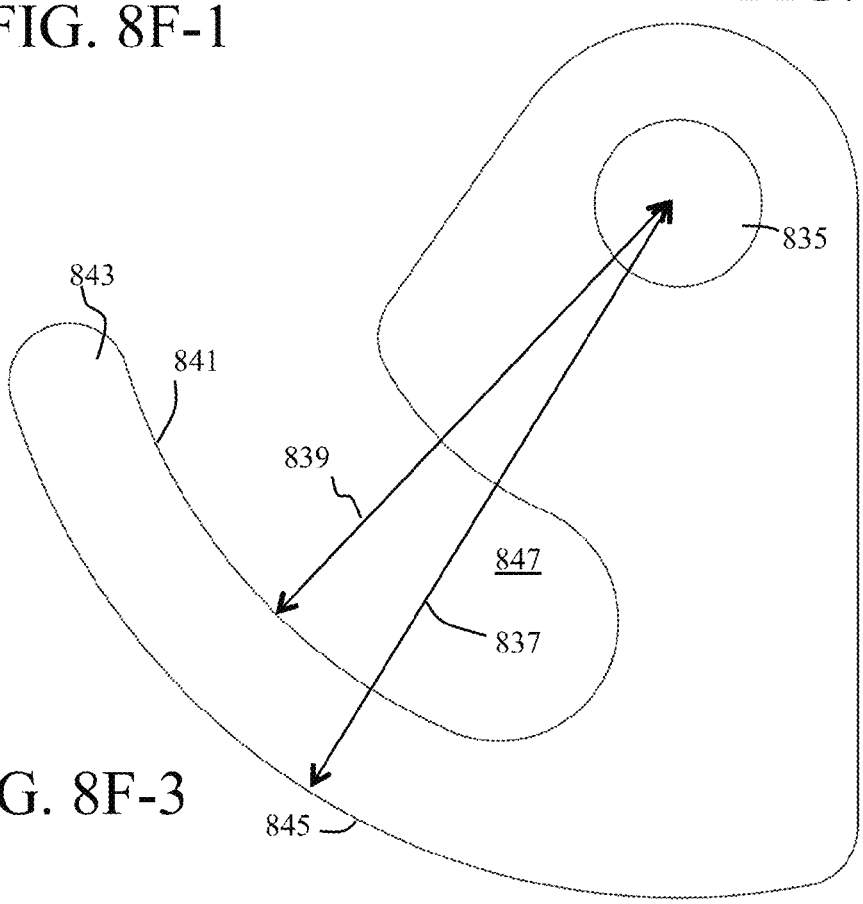

As indicated above and best illustrated in FIGS. 8F-1 to 8F-3, the retainer member 804 includes latch mechanism with the latch member 884 associated with the arm 810 that latches onto and engages the keeper 856 associated with the mounting support 806. The latch member 884 includes a coupling hole 835 that couples with the arm 810 by the arm piece hinge pin 870, with the latch member 884 freely moving from a latch to a release position (pivoting about the arm piece hinge pin 870) in between the set of knuckles 880 located on the second arm piece 816.

The latch member 884 includes an arc like hook structure 843 with an outer perimeter or circumference 845 that is equally distanced (radius 837) from the pivot point of the latch member 884 throughout the arc. This allows the latch member 884 to maneuver under the keeper 856 and not interfere with the pivotal member 808 and have and maintain a constant distance away from the pivotal member 808 (best shown in FIG. 9A-1). In other words, no matter the position of the latch member 884 along its reciprocating path from latch to release and vice versa, the formed arc with its constant radius 837 allows a constant distance between the outer perimeter 845 and the pivotal member 808. As to the inner perimeter or circumference 841 of the hook structure 843 defined by the inner radius 839, it is also uniformly structured so to smoothly receive and release the keeper 856 within the hook space 847. It should be noted that the latch member 884 is moved, and engages and latches onto the keeper 856 when the bin 104 is tilted and falls backward otherwise, it simply dangles under gravity. In other words, in an upright position, the latch member 884 will remain disengaged in normal operation due to gravity.

FIGS. 9A-1 to 9D are non-limiting, exemplary illustrations that progressively illustrate an operation of the retainer mechanism 802 from a hold or latch position to a release position in accordance with an embodiment of the present invention. As illustrated in FIG. 9A-1, when the arm 810 is in a fully hold position as illustrated, the latch member 884 continues to remain unlatch until the bin 104 falls backward at which time, the latch member 884 passively moves to engage or latch onto the keeper 856. As further illustrated, the second arm piece 816 is also moved along the reciprocating path 849 toward the bin 104 as the bin 104 is tilted backward, but easily moves back to a vertical position when the bin 104 is normally oriented.

FIG. 9A-2 is an enlarged illustration of the dashed portion 902 shown in FIG. 9A-1, illustrating the cam action of the first arm piece 814 at a hold position in accordance with an embodiment of the present invention. As illustrated in FIG. 9A-2, the rotating member 892 over travels, slips and overshoots to a "relief-hold" position to place and hold or maintain the first arm piece 814 in a fully hold position, with the rotating member 892 pressing against and over the surface 262 of the pivotal member 808, which, in turn engages with and presses over the adjusting member 112. When the rotating member 892 overshoots as illustrated, the first arm piece 814 tilts and is oriented at an angle in relation to the top surface 262 of the pivotal member 808 as shown, where the rear 886 of the first arm piece 814 has a separation distance of 904 from the pivotal member 808 compared to the general area 906 (which is zero separation, with full contact).

As illustrated, a radius 851 of the rotating member 892 is sufficiently long that the rotating member 892 extends by the amount 904 passed the first section 815 of the lower periphery of edge 819, passed beyond the total height 811 of the lateral walls 898 and 801. In other words, the large radius 851 of the rotating member 892 raises the overall profile of the first arm piece 814 at the rear 886, causing the front area 906 to tilt as shown when in hold position. When the first arm piece 814 is pressed towards hold position by users, the rotating member 892 slips further back to a relief-hold position by overshooting as shown, which creates a cam effect and provides a mechanical rest (or hold) position for the rotating member 892 until further exertion of an external opposite force to release it. In other words, the rotating member 892 finds relief from the compressive forces (applied by a user to move the arm 810 to a hold position) by slipping further back as illustrated, causing the front portion 906 to tilt as illustrated, which creates a cam action in addition to holding or maintaining the engagement position. The slippage of the rotating member 892 to a relief position occurs because the overall height (the height 811 of the lateral walls plus the amount 904 is longer than the actual space available to fit the combined height. In other words, a user applies a compression force to the first arm piece 814 that is transferred to the adjustable member 112, which is flexible, compressing the adjusting member 112. Further, the applied compression force allows the rotating member 892 to rotate and slip to the position illustrated to relief the pressure in the engagement direction as shown in FIG. 9A-2.

As illustrated in FIGS. 9B-1 and 9B-2, when the bin 104 is moved for emptying, the arm 810 passively disengages. In other words, the force generated to disengage the arm 810 to a release position by a mere tilting of the bin 104 causes the weight 222 at the distal end 278 of the second arm piece 816 to move in the reciprocating path 849, which functions as a lever in combination with the first arm piece 814 to create sufficient compressive force to commence rotation of the rotating member 892 to move it to position shown in FIG. 9B-2. At the position illustrated in FIG. 9B-2, slippage of the rotating member 892 to a "relief-release" position occurs because the overall height (the height 811 of the lateral walls plus the amount 904) is longer than the actual space available to fit the combined height. In other words, the force applied by the motion of the second arm piece 816 is transferred to the adjustable member 112, which is flexible, compressing the adjusting member 112 at the position shown in FIG. 9B-2. Further, the applied force allows the rotating member 892 to slip to relief-release position to relief the pressure in the disengagement direction as shown in FIGS. 9C and 9D. Accordingly, the force exerted to position the arm as illustrated in FIG. 9A-2 by the user must overcome the overshooting of the rotating member 892 to reverse the engagement to free the arm 810, which is easily accomplished when the bin 104 and the retainer mechanism 802 is appropriately oriented.

Accordingly, the above process in accordance with the present invention is a "wheel cam," which is a rotating or sliding piece 892 in mechanical linkage with a pivotal member 808 used in transforming rotary motion of the first arm piece 814 and the rotating member 892 into linear motion of the pivotal member 808 that presses against the adjustable member 112. The wheel-cam biasing scheme at the relief-hold position (FIGS. 9A-1 and 9A-2) maintains the engagement position of the arm 810 with the pivotal member 810, which in turn, maintains the position of the pivotal member 808 with the adjustable member 112 so that in case of vibrations or movement, the rotating member 892 does not move to loosen the pivotal member's grip on the adjustable member 112. Given that it is a rotating member, it can move easily and therefore, it is biased to engage the arm to a relief-hold position (FIGS. 9A-1 and 9A-2), until an appropriate force (a passive force applied by appropriately orienting the retainer mechanism 802) is exerted to overcome the biasing scheme to a relief-release position (FIG. 9D).

As best illustrated in FIG. 9C, when the second arm piece 816 swings along path 849 towards a release position, it pulls with it the first arm piece 814 (best shown in FIG. 9D), with the entire arm 810 moving along path 124, which completely removes any compression force applied to the pivotal member 808, allowing the pivotal member 808 to swing and pivot in the direction illustrated to a fully release position to release the adjusting member 112. The force of the pull from the second arm piece 816 on the first arm piece 814 disengages the rotating member 892 from the "relief-hold" position shown in FIGS. 9A-1 and 9A-2, to a full compression position shown in FIGS. 9B-1 and 9B-2, to a fully disengaged or "relief-release" position shown in FIG. 9D. It should be noted that the second arm piece 816 is able to move along path 849 prior to any movement of the first arm piece 814 due to the gap 853 between the top surfaces of the arm pieces. That is, as indicated above, the top 803 of the first arm piece 814 extends from the rear or "insertion side" 886 of the first arm piece 814 to a point 805 (towards the "extraction side") or front 821, short of the full axial length 807 of the lateral walls 898 and 801 by an amount 809. The amount 809 translates to the illustrate gap 853, which allows room for the second arm piece 816 to maneuver along path 849 as illustrated in FIG. 9C before any movement in the first arm piece 814.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. The cap for the weight may be secured to the second arm piece by a variety of mechanisms, including but not limited to a snap-on mechanism, glue, or others. The weight and the cap may have different configurations and need not be cylindrical. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A device, comprising:

a retainer member that is associated with a front exterior side of a bin; and an adjusting member that is flexible and associated with a front exterior side of a lid of the bin and the retainer member;

the retainer member includes:

a pivotal member that is moved by a moveable arm to hold the adjusting member;

the moveable arm is actively moved to one of hold or release positions to hold or release the pivotal member;

the moveable arm is passively moved to a release position by gravitational force operating on an associated weight of the moveable arm when the retainer member is tilted to a specific orientation only, which, in turn, releases the pivotal member to release the adjusting member, with the released adjusting member freeing the lid for opening the bin.

2. The device as set forth in claim 1, wherein:

the retainer member holds and securely maintains the adjusting member at a fixed position along a length of the adjusting member, which, in turn, holds and securely maintains the lid in relation to an opening of the bin.

3. The device as set forth in claim 1, wherein:

the retainer member holds and securely maintains the adjusting member at a fixed position along a length of the adjusting member, which, in turn, holds and securely maintains the lid in relation to an opening of an overfilled bin, further compacting and securing content of the bin as the adjusting member is tightened in relation to the retainer member.

4. The device as set forth in claim 1, wherein:

the adjusting member is frictionally engaged and held within the retainer member.

5. The device as set forth in claim 1, wherein:

the lid is hinged at one side of the opening of the bin forming a hinged lid, and the adjusting member is associated with the free, open front side of the lid.

6. The device as set forth in claim 1, wherein:

the arm is passively moved to the release position when the retainer member is tilted to a specific orientation to passively release the adjusting member.

7. The device as set forth in claim 1, wherein the retainer member further comprises:

a mounting support associated with the pivotal member and the movable arm.

8. The device as set forth in claim 7, wherein:

the one or more component of the retainer member is sloped at an angle to commensurately offset an angular incline of a slanted side of the bin with which the retainer member is coupled to maintain the arm at a hold position;

wherein: the adjusting member rests against a mounting support, and the mounting support maintains a resting point for the arm.

9. The device as set forth in claim 7, wherein:

the mounting support is comprise of mounting mechanism that facilitate the mounting of the mounting support with the bin.

10. The device as set forth in claim 7, wherein:

the mounting support includes an alignment mechanism that aligns an apex of a protruded portion of the arm in sliding contact with a top surface of the pivotal member to impart motion thereto and move the pivotal member in to a tight engagement with the adjusting member by providing maximum pressure on the top surface of the pivotal member.

11. The device as set forth in claim 10, wherein:

the protruded portion of the arm generates a cam action.

12. The device as set forth in claim 7, wherein:

the mounting support further includes lateral supports for supporting the arm, the pivotal member, and an alignment mechanism on the mounting support.

13. The device as set forth in claim 7, wherein:

a protruded portion of the arm at an arm hold position is maximally pressed against the pivotal member and substantially at a middle section of the pivotal member.

14. The device as set forth in claim 7, wherein:

the pivotal member is pivotally hinged at one end on the mounting support.

15. The device as set forth in claim 7, wherein:

the pivotal member is comprised of a serrated surface to improve grip.

16. The device as set forth in claim 15, wherein:

the serrated surface has a saw-tooth configuration with each serration including a first surface having a slope that ramps towards an apex, and a second surface that drops substantially vertically from the apex;

the first surface is inclined in an orientation opposite a directional movement that releases the adjusting mechanism.

17. The device as set forth in claim 7, wherein:

the pivotal member is comprised of:

a bottom surface that is serrated to improve grip with the associated adjusting mechanism;

top surface that is substantially smooth to reduce friction with a cam section of the lever; and a distal hinged end.

18. The device as set forth in claim 1, wherein:

the retainer member is comprised of a substantially rounded smooth edges.

19. The device as set forth in claim 7, wherein:

the arm includes a cam portion, and is pivotally hinged at the cam portion on the mounting support;

the cam portion includes one or more rotating member that facilitate to reduce friction between the cam portion that contacts a top surface of the pivotal member.

20. A device, comprising:

a retainer member; and an adjusting member associated with the retainer member;

the retainer member is comprised of:

a mounting support;

a pivotal member associated with the mounting support; and an arm assembly comprised of a first arm piece and a second arm piece, including a weight;

the arm assembly is actively moved to one of hold or release positions to hold or release the pivotal member, which, in turn, holds or releases the adjusting member, and is passively moved by gravitational force operating on the weight to a release position to release the pivotal member to release the adjusting member when the retainer member is tilted to a specific orientation only.

21. The device as set forth in claim 20, wherein:

the pivotal member is a single, integral piece that is comprised of:

a first section;

a second section; and a hinge.

22. The device as set forth in claim 21, wherein:

the first section is a lever that facilitates in pivoting the pivotal member at the hinge thereby raising an extraction side of the pivotal member for unimpeded maneuvering pivotal member for the adjusting member passing through.

23. The device as set forth in claim 22, wherein:

the lever includes an angled portion to ergonomically facilitate handling of the pivotal member.

24. The device as set forth in claim 21, wherein:

the second section is comprised of:

a bottom surface that is serrated to improve grip with the associated adjusting mechanism;

top surface that is substantially smooth to reduce friction with a cam section of the lever;

a distal hinged end, and an extension at the proximal extraction side of the retainer mechanism.

25. The device as set forth in claim 20, wherein:

first arm piece and the second arm piece are movable in relation to one another and with the mounting support.

26. The device as set forth in claim 20, wherein:

first arm piece is coupled with the second arm piece by an arm piece hinge.

27. The device as set forth in claim 20, wherein:

spacers of varying sizes are used for leveling.

28. A device, comprising:

an adjusting member that is flexible and detachably associated with a retainer member; the retainer member is comprised of:

a mounting support to connect the retainer member to a front exterior side of a bin;

a pivotal member moveably associated with the mounting support; and an arm that actuates the pivotal member to one of a hold or release positions;

wherein: the arm is actively moved to one of a hold or a release positions to hold or release the pivotal member to hold or release the adjusting member;

wherein: the arm is passively moved by gravitational force operating on a weight of the arm to the release position to release pivotal member to release the adjusting member when the retainer member is tilted to a specific orientation.

29. The device as set forth in claim 28, wherein:

the arm is an arm assembly comprised of a first moveable arm piece and a second moveable arm piece, with the arm assembly moveably associated with the mounting support.

* * * * *